US009962950B2

(12) United States Patent
Yamagata et al.

(10) Patent No.: US 9,962,950 B2
(45) Date of Patent: May 8, 2018

(54) RECORDING APPARATUS AND RECORDING METHOD

(71) Applicant: CANON KABUSHIKI KAISHA, Tokyo (JP)

(72) Inventors: Mayuko Yamagata, Inagi (JP); Satoshi Seki, Kawasaki (JP); Hirokazu Tanaka, Inagi (JP); Gou Sasaki, Kawasaki (JP); Tsukasa Doi, Tokyo (JP); Fumiko Suzuki, Kawasaki (JP); Kiichiro Takahashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/333,666

(22) Filed: Oct. 25, 2016

(65) Prior Publication Data

US 2017/0120642 A1 May 4, 2017

(30) Foreign Application Priority Data

Oct. 30, 2015 (JP) ..... 2015-214962
Oct. 30, 2015 (JP) ..... 2015-214964

(51) Int. Cl.
*B41J 2/21* (2006.01)
*B41J 19/14* (2006.01)

(52) U.S. Cl.
CPC ..... *B41J 2/2125* (2013.01); *B41J 2/2132* (2013.01); *B41J 19/145* (2013.01)

(58) Field of Classification Search
CPC ..... B41J 2/2125; B41J 2/2132; B41J 2/2135; B41J 19/145
See application file for complete search history.

(56) References Cited

U.S. PATENT DOCUMENTS

2009/0002417 A1* 1/2009 Uji ..... B41J 2/2132 347/12
2011/0134177 A1* 6/2011 Konno ..... B41J 2/2125 347/14
2011/0187777 A1* 8/2011 Shin ..... B41J 29/38 347/14

FOREIGN PATENT DOCUMENTS

JP 2003175592 A 6/2003
JP 2013159017 A 8/2013

* cited by examiner

*Primary Examiner* — Geoffrey Mruk
*Assistant Examiner* — Scott A Richmond
(74) *Attorney, Agent, or Firm* — Canon U.S.A., Inc. IP Division

(57) ABSTRACT

Driving orders of driving blocks are controlled with regard to each of multiple types of ink so that landing positions of ink from the driving blocks differ in multiple scans, and in the mask patterns used, there is a relatively small number of superimposed pixels among pixels regarding which a large number of discharge permitted has been stipulated regarding a mask pattern corresponding to one type of ink and one scan and pixels regarding which a large number of discharge permitted has been stipulated regarding a mask pattern corresponding to another type of ink and the one scan.

21 Claims, 35 Drawing Sheets

FIG. 6

| | | DISCHARGE ORIFICE ROW | |
|---|---|---|---|
| | | 2 pl | 5 pl |
| DATA | 0 | 0 | 0 |
| | 1 | 1 | 0 |
| | 2 | 1 | 1 |
| | 3 | 2 | 1 |
| | 4 | 2 | 2 |

FIG. 9A

| | | | |
|---|---|---|---|
| 700 | 701 | 702 | 703 |
| 704 | 705 | 706 | 707 |
| 708 | 709 | 710 | 711 |
| 712 | 713 | 714 | 715 |

FIG. 9B
IMAGE DATA

| | | | |
|---|---|---|---|
| 2 | 1 | 0 | 0 |
| 2 | 1 | 0 | 0 |
| 2 | 1 | 0 | 0 |
| 2 | 1 | 0 | 0 |

FIG. 9C-1
MASK PATTERN

| | | | | |
|---|---|---|---|---|
| 2 | 1 | 0 | 0 | MP1 |
| 0 | 2 | 1 | 0 | |
| 0 | 0 | 2 | 1 | |
| 1 | 0 | 0 | 2 | |

FIG. 9C-2

| | | | | |
|---|---|---|---|---|
| 1 | 0 | 0 | 2 | MP2 |
| 2 | 1 | 0 | 0 | |
| 0 | 2 | 1 | 0 | |
| 0 | 0 | 2 | 1 | |

FIG. 9C-3

| | | | | |
|---|---|---|---|---|
| 0 | 0 | 2 | 1 | MP3 |
| 1 | 0 | 0 | 2 | |
| 2 | 1 | 0 | 0 | |
| 0 | 2 | 1 | 0 | |

FIG. 9C-4

| | | | | |
|---|---|---|---|---|
| 0 | 2 | 1 | 0 | MP4 |
| 0 | 0 | 2 | 1 | |
| 1 | 0 | 0 | 2 | |
| 2 | 1 | 0 | 0 | |

FIG. 9D-1
RECORDING DATA

| | | | |
|---|---|---|---|
| 1 | 1 | 0 | 0 |
| 0 | 0 | 0 | 0 |
| 0 | 0 | 0 | 0 |
| 1 | 0 | 0 | 0 |

FIG. 9D-2

| | | | |
|---|---|---|---|
| 1 | 0 | 0 | 0 |
| 1 | 1 | 0 | 0 |
| 0 | 0 | 0 | 0 |
| 0 | 0 | 0 | 0 |

FIG. 9D-3

| | | | |
|---|---|---|---|
| 0 | 0 | 0 | 0 |
| 1 | 0 | 0 | 0 |
| 1 | 1 | 0 | 0 |
| 0 | 0 | 0 | 0 |

FIG. 9D-4

| | | | |
|---|---|---|---|
| 0 | 0 | 0 | 0 |
| 0 | 0 | 0 | 0 |
| 1 | 0 | 0 | 0 |
| 1 | 1 | 0 | 0 |

FIG. 9E
LOGICAL SUM OF RECORDING DATA
(NUMBER OF TIMES OF INK DISCHARGE)

| | | | |
|---|---|---|---|
| 2 | 1 | 0 | 0 |
| 2 | 1 | 0 | 0 |
| 2 | 1 | 0 | 0 |
| 2 | 1 | 0 | 0 |

FIG. 10

| ○: RECORDED<br>×: NOT RECORDED | | CODE VALUE OF MASK PATTERN | | |
|---|---|---|---|---|
| | | 0 | 1 | 2 |
| PIXEL VALUE OF IMAGE DATA | 0 | × | × | × |
| | 1 | × | ○ | × |
| | 2 | × | ○ | ○ |

FIG. 11A
| | DRIVING ORDER | DRIVING BLOCK NO. |
|---|---|---|
| DRIVING ORDER | 1 | 1 |
| | 2 | 2 |
| | 3 | 3 |
| | 4 | 4 |
| | 5 | 5 |
| | 6 | 6 |
| | 7 | 7 |
| | 8 | 8 |
| | 9 | 9 |
| | 10 | 10 |
| | 11 | 11 |
| | 12 | 12 |
| | 13 | 13 |
| | 14 | 14 |
| | 15 | 15 |
| | 16 | 16 |
FIG. 11B
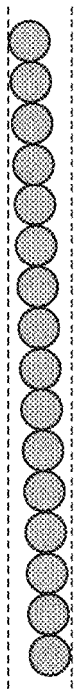
FIG. 11C
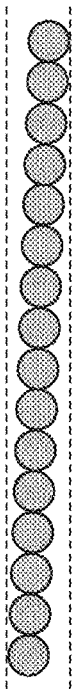
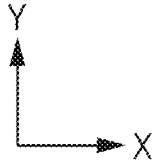

FIG. 12A1
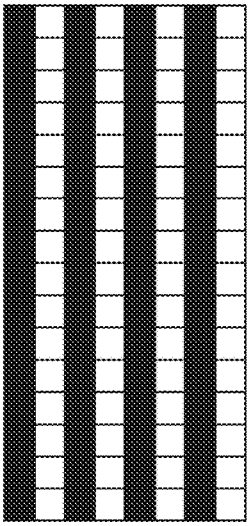
FIG. 12A2
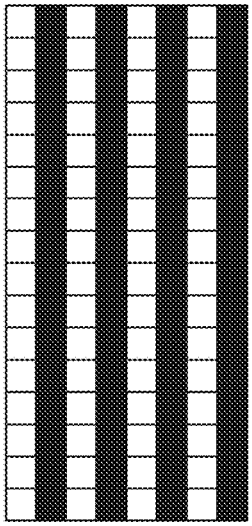
FIG. 12B1
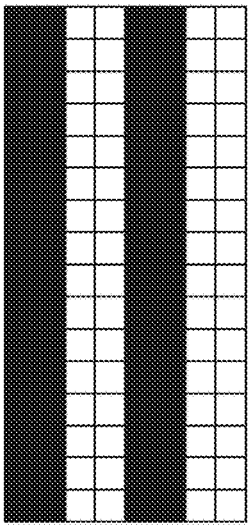
FIG. 12B2
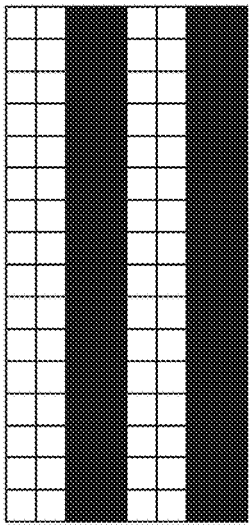
FIG. 12C
| | DRIVING ORDER | DRIVING BLOCK NO. |
|---|---|---|
| DRIVING ORDER A | 1 | 1 |
| | 2 | 2 |
| | 3 | 3 |
| | 4 | 4 |
| | 5 | 5 |
| | 6 | 6 |
| | 7 | 7 |
| | 8 | 8 |
| | 9 | 9 |
| | 10 | 10 |
| | 11 | 11 |
| | 12 | 12 |
| | 13 | 13 |
| | 14 | 14 |
| | 15 | 15 |
| | 16 | 16 |
FIG. 12D
| | DRIVING ORDER | DRIVING BLOCK NO. |
|---|---|---|
| DRIVING ORDER B | 1 | 16 |
| | 2 | 15 |
| | 3 | 14 |
| | 4 | 13 |
| | 5 | 12 |
| | 6 | 11 |
| | 7 | 10 |
| | 8 | 9 |
| | 9 | 8 |
| | 10 | 7 |
| | 11 | 6 |
| | 12 | 5 |
| | 13 | 4 |
| | 14 | 3 |
| | 15 | 2 |
| | 16 | 1 |
FIG. 12E
| | RECORDING DATA | | DRIVING ORDER | |
|---|---|---|---|---|
| | FORWARD SCAN | BACKWARD SCAN | FORWARD SCAN | BACKWARD SCAN |
| FIRST SET | (b1) | (b2) | (c) | (d) |
| SECOND SET | (a1) | (a2) | (c) | (d) |
| THIRD SET | (b1) | (b2) | (c) | (c) |
| FOURTH SET | (a1) | (a2) | (c) | (c) |

FIG. 19A
| | DRIVING ORDER | DRIVING BLOCK NO. |
|---|---|---|
| DRIVING ORDER | 1 | 1 |
| | 2 | 9 |
| | 3 | 6 |
| | 4 | 14 |
| | 5 | 3 |
| | 6 | 11 |
| | 7 | 8 |
| | 8 | 16 |
| | 9 | 5 |
| | 10 | 13 |
| | 11 | 2 |
| | 12 | 10 |
| | 13 | 7 |
| | 14 | 15 |
| | 15 | 4 |
| | 16 | 12 |
FIG. 19B
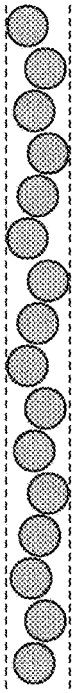
FIG. 19C
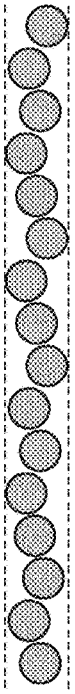
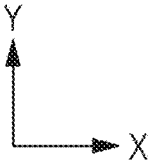

FIG. 23A
| | DRIVING ORDER | DRIVING BLOCK NO. |
|---|---|---|
| DRIVING ORDER | 1 | 1 |
| | 2 | 2 |
| | 3 | 3 |
| | 4 | 4 |
| | 5 | 5 |
| | 6 | 6 |
| | 7 | 7 |
| | 8 | 8 |
| | 9 | 9 |
| | 10 | 10 |
| | 11 | 11 |
| | 12 | 12 |
| | 13 | 13 |
| | 14 | 14 |
| | 15 | 15 |
| | 16 | 16 |
FIG. 23B
| | DRIVING ORDER | DRIVING BLOCK NO. |
|---|---|---|
| DRIVING ORDER | 1 | 8 |
| | 2 | 7 |
| | 3 | 6 |
| | 4 | 5 |
| | 5 | 4 |
| | 6 | 3 |
| | 7 | 2 |
| | 8 | 1 |
| | 9 | 16 |
| | 10 | 15 |
| | 11 | 14 |
| | 12 | 13 |
| | 13 | 12 |
| | 14 | 11 |
| | 15 | 10 |
| | 16 | 9 |
FIG. 23C
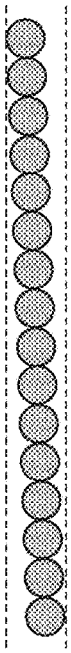
FIG. 23D
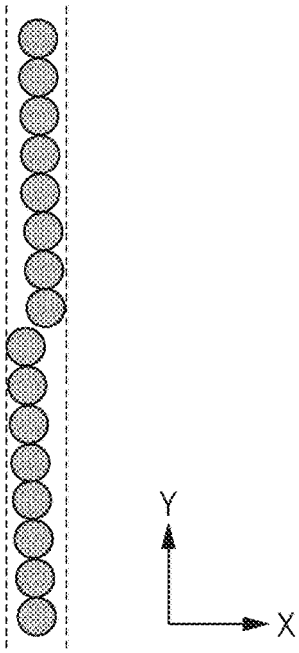

FIG. 34

| | | DISCHARGE ORIFICE ROW | | |
|---|---|---|---|---|
| | | 1 pl | 2 pl | 5 pl |
| DATA | 0 | 0 | 0 | 0 |
| | 1 | 1 | 0 | 0 |
| | 2 | 1 | 1 | 0 |
| | 3 | 0 | 1 | 1 |
| | 4 | 0 | 2 | 1 |
| | 5 | 0 | 2 | 2 |

FIG. 35

| ○: RECORDED<br>×: NOT RECORDED | | CODE VALUE OF MASK PATTERN | | | | | | | |
|---|---|---|---|---|---|---|---|---|---|
| | | 0 | 1 | 2 | 3 | 4 | 5 | 6 | 7 |
| PIXEL VALUE OF IMAGE DATA | 0 | × | × | × | × | × | × | × | × |
| | 1 | × | × | × | × | × | × | × | ○ |
| | 2 | × | × | × | × | × | × | ○ | ○ |
| | 3 | × | × | × | × | × | ○ | ○ | ○ |
| | 4 | × | × | × | × | ○ | ○ | ○ | ○ |
| | 5 | × | × | × | ○ | ○ | ○ | ○ | ○ |
| | 6 | × | × | ○ | ○ | ○ | ○ | ○ | ○ |
| | 7 | × | ○ | ○ | ○ | ○ | ○ | ○ | ○ |

RECORDING APPARATUS AND RECORDING METHOD

BACKGROUND OF THE INVENTION

Field of the Invention

The present invention relates to a recording apparatus and a recording method.

Description of the Related Art

There is conventionally known a recording apparatus that records images by discharging ink onto a recording medium by driving recording elements, using a recording head having a recording element row where multiple recording elements that generate energy for discharging ink are arrayed. There also is known so-called multi-pass recording in such recording apparatuses, where multiple recording scans are performed as to a unit region to form images.

It is known in such multi-pass recording to generate recording data using image data expressed as multi-bit information that stipulates how many times ink is to be discharged to each pixel, and multiple mask patterns expressed as multi-bit information that stipulates how many times ink is permitted to be discharged to each pixel, corresponding to multiple scans. For example, Japanese Patent Laid-Open No. 2003-175592 discloses generating recording data using image data and mask patterns, the image data and mask patterns each expressed as 2-bit information.

On the other hand, there is commonly known the so-called time-division driving method for a driving method for driving multiple recording elements within a recording element row, where the multiple recording elements are divided into multiple driving blocks, and the recording elements belonging to different driving blocks are driven at different timings from each other. This time-division driving method enables the number of recording elements being driven at the same time to be reduced, thereby enabling a recording apparatus to be provided with a driving power source of a smaller size.

In a case of recording using the above multi-pass recording, there are cases where a deviation in the discharging position of ink can occur between one type of scan and another type of scan in the multiple scans over a unit region, due to various factors. For example, in a case where floating (cockling) of the recording medium occurs in an arrangement where the recording head is reciprocally scanned in the forward direction and backward direction, the ink discharge direction slightly shifts between the forward direction and backward direction, so there is ink discharge position deviation between a region where recording has been performed by a forward direction scan and a region where recording has been performed by a backward direction scan.

In comparison with this, Japanese Patent Laid-Open No. 2013-159017 describes an arrangement to suppress ink discharge position deviation among two types of scans such as the forward scan and the backward scan described above. In this arrangement, recording data is generated where ink is discharged in the same pixel region by these two types of scans, and further the above-described time-division driving is performed so that the landing positions of dots formed by each of the driving blocks in each of the two types of scans differ from each other. Now, in order for the landing positions of dots formed by each of the driving blocks to differ in a case of the recording head being reciprocally scanned in the forward direction and backward direction, the driving order of multiple driving blocks when scanning in the backward direction is described as being different from the reverse order for the driving order of multiple driving blocks when scanning in the forward direction. Also, in order for the landing positions of dots formed by each of the driving blocks to differ in a case of the recording head being scanned only in one direction, the driving order of multiple driving blocks in a certain type of scan is described as being different from the driving order of multiple driving blocks in another certain type of scan. According to Japanese Patent Laid-Open No. 2013-159017, recording can be realized where ink discharge position deviation between two types of scans is suppressed when performing recording using multi-pass recording and time-division driving.

However, Japanese Patent Laid-Open No. 2013-159017 only describes a case of discharging a certain one type of ink. Accordingly, Japanese Patent Laid-Open No. 2013-159017 makes no mention whatsoever of how to generate recording data for discharging respective inks in a case of discharging multiple types of ink. Although Japanese Patent Laid-Open No. 2013-159017 enables discharge position deviation to be controlled between two types of scans in a case of discharging one type of ink, there may be adverse effects on image quality in a case of discharging multiple types of ink. For example, Japanese Patent Laid-Open No. 2003-175592 does not describe the relationship between recording data for discharging cyan ink and recording data for discharging magenta ink, so discharge position deviation occurring between cyan ink and magenta ink may be uncontrollable. As another example, Japanese Patent Laid-Open No. 2003-175592 does not describe the relationship between recording data for discharging ink of large dot size and recording data for discharging ink of small dot size, so discharge position deviation occurring between ink of large dot size and ink of small dot size may be uncontrollable.

SUMMARY OF THE INVENTION

In various aspects of the present application, it has been found desirable in performing recording to suppress discharge position deviation among ink of two types of scans, without causing other image defects, even when discharging ink of multiple types, such as multiple colors or multiple dot sizes.

In various embodiments, a recording apparatus includes a recording head, a scanning unit, first and second generating units, a driving unit, and a control unit. The recording head includes a first recording element row where a plurality of recording elements configured to generate energy to discharge a first type of ink are arrayed in a predetermined direction, and a second recording element row where a plurality of recording elements configured to generate energy to discharge a second type of ink, that is different from the first type of ink, are arrayed in the predetermined direction. The scanning unit is configured to execute a first scan of the recording head over a unit region on a recording medium, K ($K \geq 1$) times in a first direction following an intersecting direction intersecting the predetermined direction, and a second scan of the recording head over the unit region, L ($L \geq 1$) times in a second direction opposite to the first direction. The first generating unit is configured to generate K+L sets of first recording data stipulating discharge or non-discharge of the first type of ink, as to each of a plurality of pixels, corresponding to the K+L scans by the scanning unit, based on first image data that corresponds to an image to be recorded in the unit region and stipulates a plurality of combinations of number of times of discharge of the first type of ink to each of the plurality of pixel regions, and K+L first mask patterns corresponding to the K+L scans by the scanning unit and stipulating a plurality of combinations of number of times of discharge of the first type ink to each of the plurality of pixel regions. The second generating unit is configured to generate K+L sets of second recording data stipulating discharge or non-discharge of the second type of ink, as to each of a plurality of pixels, corresponding to the K+L scans by the scanning unit, based on second image data that corresponds to an image to be recorded in the unit region and stipulates a plurality of combinations of number of times of discharge of the second type of ink to each of the plurality of pixel regions, and K+L second mask patterns corresponding to the K+L scans by the scanning unit and stipulating a plurality of combinations of number of times of discharge of the second type ink to each of the plurality of pixel regions. The driving unit is configured to drive a plurality of first recording elements corresponding to the unit region the K first scans within the first and second recording element rows, at a first driving order, and drive a plurality of second recording elements corresponding to the unit region the L second scans within the first and second recording element rows, at a second driving order that is different from the opposite order from the first driving order. The control unit is configured to effect control to discharge the first and second types of ink to a plurality of pixel regions equivalent to the plurality of pixels within the unit region by driving the plurality of recording elements within the first and second recording element rows, based on the K+L sets of first and second recording data, in the K+L scans by the scanning unit. An array of pixels regarding which an M ($M \geq 1$) number of ink discharge permitted is stipulated by one of the K first mask patterns corresponding to the K first scans, and an array of pixels regarding which an N ($N > M$) number of ink discharge permitted is stipulated by one of the L first mask patterns corresponding to the L second scans, correspond to each other. An array of pixels regarding which an M number of ink discharge permitted is stipulated by one of the K second mask patterns corresponding to the K first scans, and an array of pixels regarding which an N number of ink discharge permitted is stipulated by one of the L second mask patterns corresponding to the L second scans, correspond to each other. An array of pixels regarding which an N number of ink discharge permitted is stipulated by one of the K first mask patterns corresponding to the K first scans, and an array of pixels regarding which an N number of ink discharge permitted is stipulated by one of the K second mask patterns corresponding to the K first scans, are different from each other.

Further features of the present invention will become apparent from the following description of exemplary embodiments with reference to the attached drawings.

BRIEF DESCRIPTION OF THE DRAWINGS

FIG. 6 is a diagram illustrating a rasterization table in an embodiment.

FIGS. 9A through 9E are diagrams for describing recording data generating steps in multi-pass recording.

FIG. 10 is a diagram illustrating a decoding table.

FIGS. 11A through 11C are diagrams for describing correlation between driving order and ink landing position.

FIGS. 12A1 through 12E are diagrams for describing correlation of recording data, driving order, and ink discharge position.

FIGS. 19A through 19C are diagrams for describing driving order in an embodiment.

FIGS. 23A through 23D are diagrams for describing driving order in an embodiment.

FIG. 34 is a diagram illustrating a rasterization table in an embodiment.

FIG. 35 is a diagram illustrating a decoding table applied in an embodiment.

DESCRIPTION OF THE EMBODIMENTS

First Embodiment

Figure 1:
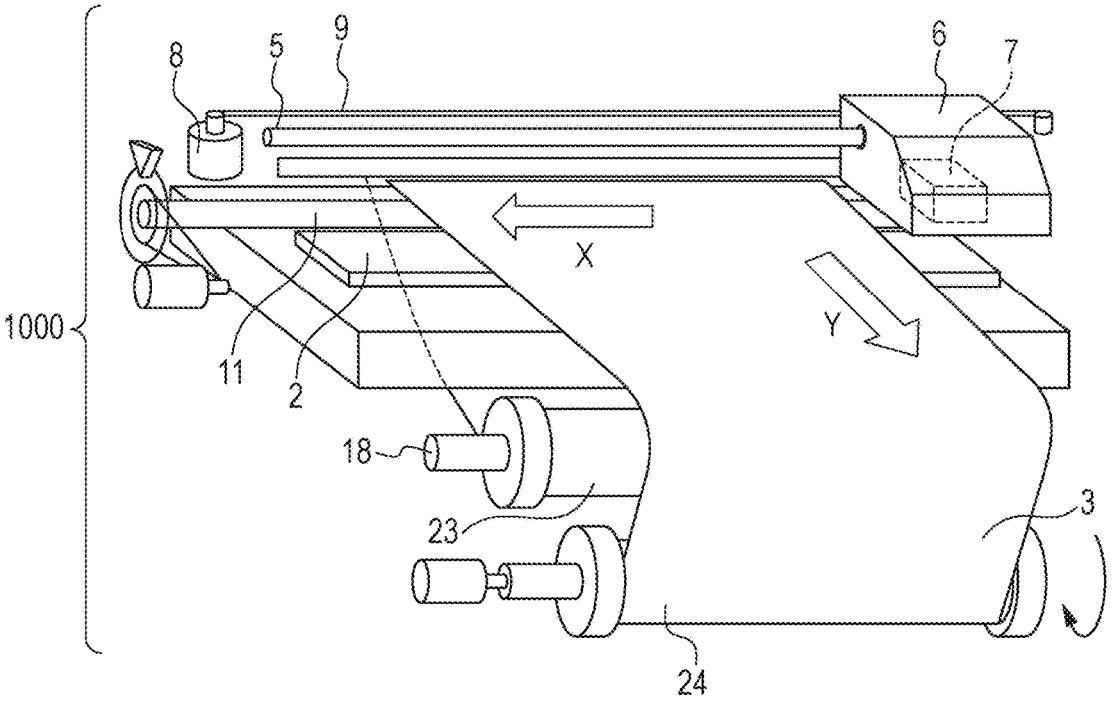
FIG. 1 is a perspective view of a recording apparatus according to an embodiment.
Figure 2:
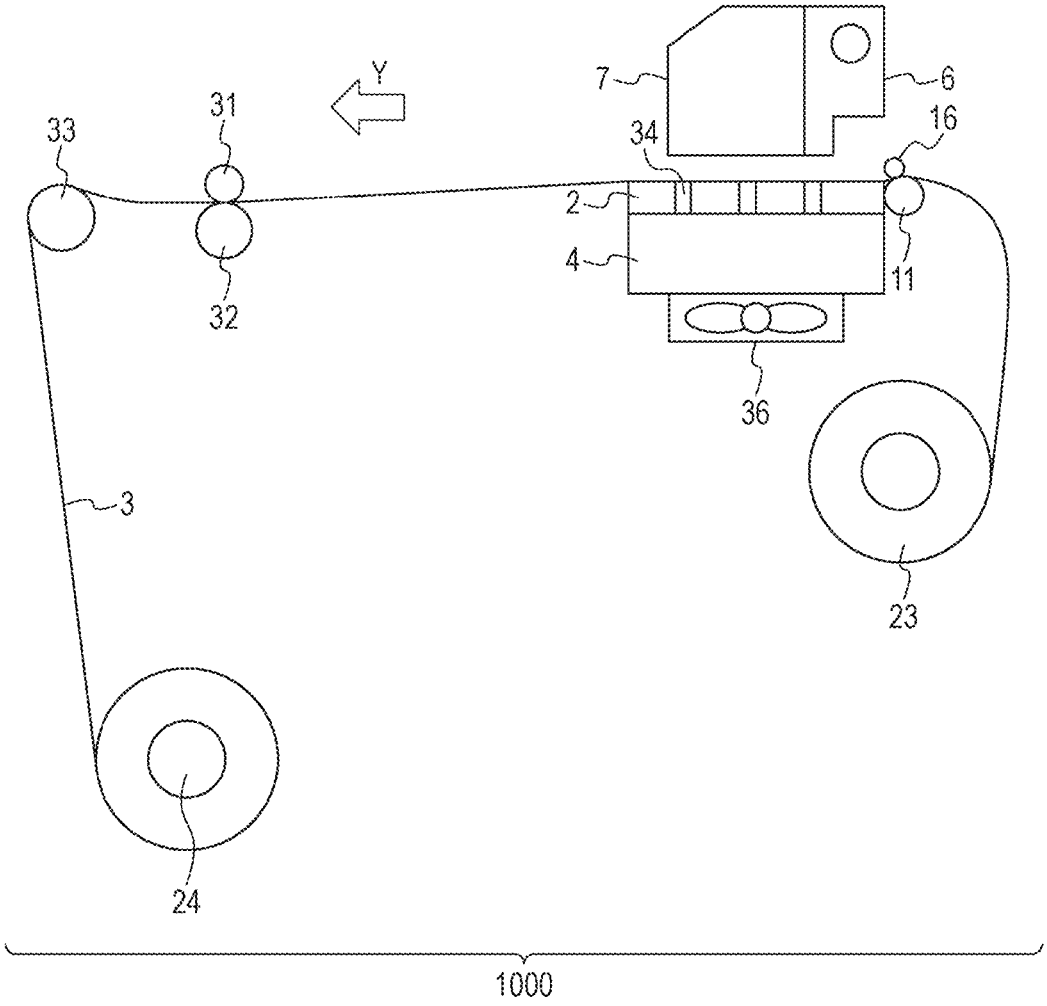
FIG. 2 is a schematic diagram illustrating the internal configuration of the recording apparatus according to an embodiment.

A first embodiment of the present invention will be described in detail below with reference to the drawings. FIG. 1 is a perspective view partially illustrating the internal configuration of a recording apparatus 1000 according to the first embodiment of the present invention. FIG. 2 is a cross-sectional diagram partially illustrating the internal configuration of the recording apparatus 1000 according to the first embodiment of the present invention.

A platen 2 is disposed within a recording apparatus 1000. A great number of suction holes 34 are formed in the platen 2 so that a recording medium 3 can be suctioned and thus prevented from floating up. The suction holes 34 are connected to a duct, below which a suction fan 36 is disposed. The recording medium 3 is suctioned to the platen 2 by this suction fan 36 operating.

A carriage 6 is supported by a main rail 5 disposed extending in the width direction of sheets, and is configured so as to be capable of reciprocal scanning (reciprocal movement) in the forward direction and backward direction along an X direction (intersecting direction). Mounted on the carriage 6 is an ink jet recording head 7 which will be described later. Various recording methods can be used in the recording head 7, including the thermal jet method using heating elements, the piezoelectric method using piezoelectric elements, and so forth. A carriage motor 8 is a drive source for moving the carriage 6 in the X direction. The rotational driving force thereof is transmitted to the carriage 6 by a belt 9.

The recording medium 3 is supplied by being unwound off of a rolled medium 23. The recording medium 3 is conveyed in a Y direction (conveyance direction) intersecting the X direction on the platen 2. The recording medium 3 is nipped by a pinch roller 16 and conveyance roller 11, and is conveyed by the conveyance roller 11 being driven. Downstream in the Y direction from the platen 2, the recording medium 3 is nipped by a roller 31 and discharge roller 32, and further is wound onto a take-up roller 24 by way of a turn roller 33.

Figure 3A:
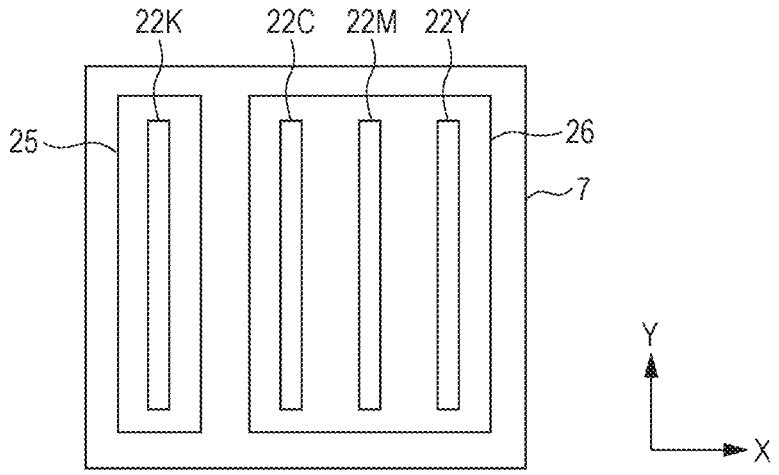
FIGS. 3A through 3C are schematic diagrams of a recording head according to an embodiment.
Figure 3B:
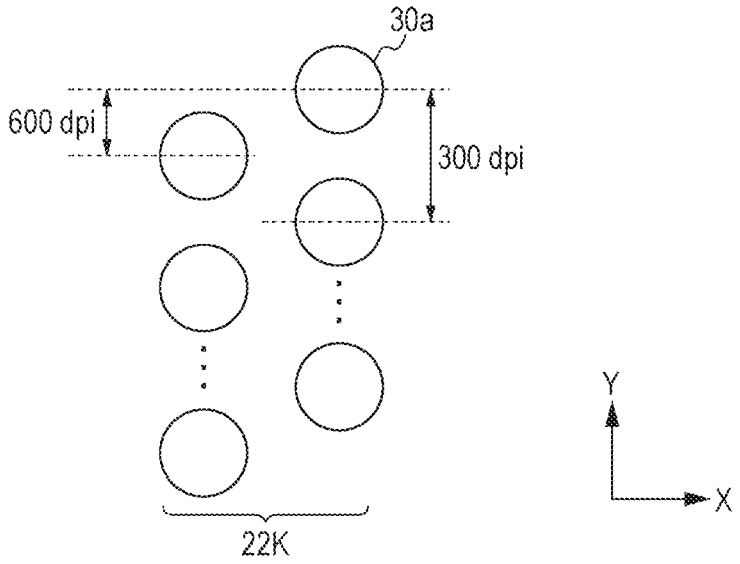
Figure 3C:
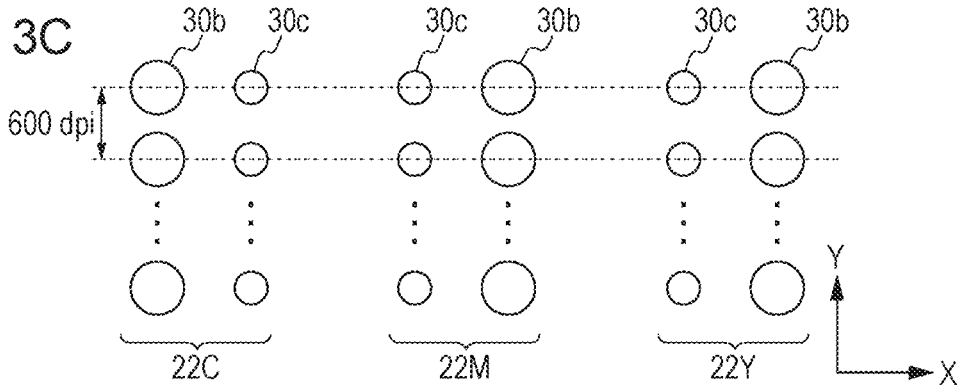

FIG. 3A is a perspective view illustrating the recording head 7 according to the present embodiment. FIG. 3B is an enlarged view of a chip 25 on which is disposed a discharge orifice row 22K for black ink inside the recording head 7. FIG. 3C is an enlarged view of a chip 26 on which are disposed a discharge orifice row 22C for cyan ink, a discharge orifice row 22M for magenta ink, and a discharge orifice row 22Y for yellow ink, inside the recording head 7.

It can be seen from FIG. 3A that a recording chip 25 for discharging black ink (Bk chip) and a recording chip 26 for discharging color ink (C1 chip) are provided separately within the recording head 7, in the present embodiment.

K discharge orifice rows 22K for black ink are formed extending on the Bk chip 25 in the Y direction (predetermined direction), shifted at a recording resolution of 600 per inch (600 dpi) as to each other, as illustrated in FIG. 3B. These two rows each have 300 discharge orifices 30*a* arrayed in the Y direction (predetermined direction) per inch (300 dpi). The discharge orifices 30*a* are capable of discharging approximately 25 picoliters (hereinafter "pl") of ink. The diameter of a dot formed by a discharge orifice 30*a* discharging one droplet of ink onto the recording medium is approximately 60 μm. Although only six discharge orifices 30*a* are illustrated in FIG. 3B for the sake of brevity, in reality 128 discharge orifices 30*a* are arrayed to make up the discharge orifice row 22K.

A discharge orifice row 22C for discharging cyan ink is formed on the C1 chip 26. The discharge orifice row 22C is made up of a row where discharge orifices 30*b* are arrayed in the Y direction at a density of 1/600 inch (equivalent to 600 dpi) and a row where discharge orifices 30*c* are arrayed in the Y direction at a density of 1/600 inch (equivalent to 600 dpi), as illustrated in FIG. 3C. The discharge orifices 30*b* are capable of discharging approximately 5 pl of ink, and the diameter of a dot formed by a discharge orifice 30*b* discharging one droplet of ink onto the recording medium is approximately 50 μm. The discharge orifices 30*c* are capable of discharging approximately 2 pl of ink, and the diameter of a dot formed by a discharge orifice 30*c* discharging one droplet of ink onto the recording medium is approximately 35 μm. Although only three discharge orifices 30*b* and three discharge orifices 30*c* are illustrated in FIG. 3C for the sake of brevity, in reality 128 discharge orifices 30*b* and 128 discharge orifices 30C are arrayed to make up the discharge orifice row 22C. Moreover, a discharge orifice row 22M for discharging magenta ink, and a discharge orifice row 22Y for discharging yellow ink, are formed on the C1 chip 26.

Recording elements (omitted from illustration) are disposed directly below the discharge orifices 30*a*, 30*b*, and 30*c*. Thermal energy generated by the recording elements being driven causes the ink immediately above to bubble, which discharges ink from the discharge orifices. In order to simplify description hereinafter, a row of multiple recording elements formed directly below multiple discharge orifices making up a row that discharges ink of the same color and same dot size will be referred to as "recording element row".

Figure 4:
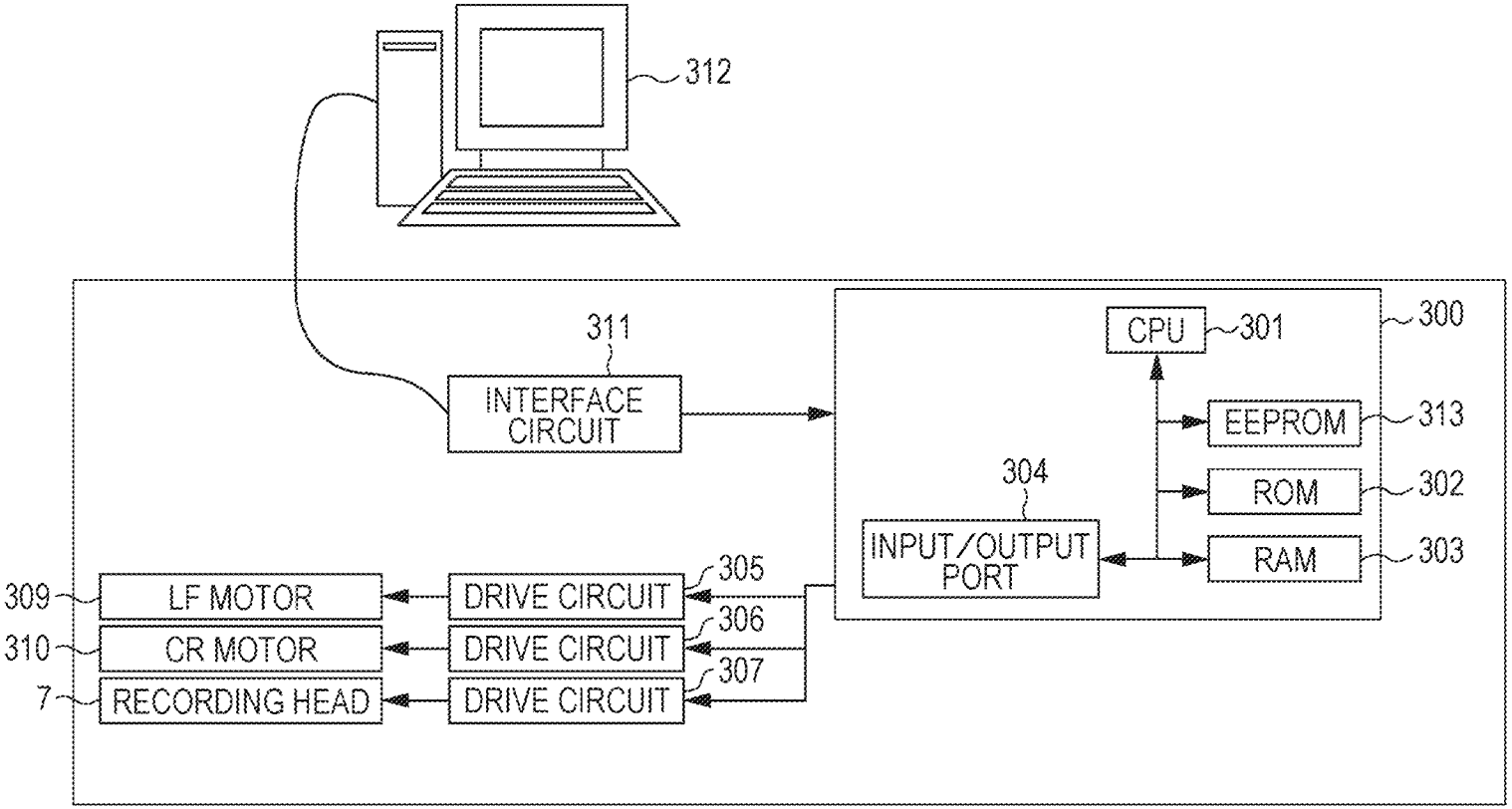
FIG. 4 is a diagram illustrating a recording control system in an embodiment.

FIG. 4 is a block diagram illustrating a schematic configuration of a control system in the present embodiment. A main control unit 300 includes a central processing unit (CPU) 301 that executes processing operations such as computation, selection, determination, control, and so forth, read-only memory (ROM) 302 that stores control programs and the like to be executed by the CPU 301, random access memory (RAM) 303 used to buffer recording data and so forth, an input/output port 304, and so forth. Electrically Erasable Programmable ROM (EEPROM) 313 stores image data, mask patterns, faulty nozzle data, and so forth, which will be described later. Drive circuits 305, 306, 307, respectively corresponding to a conveyance motor (LF motor) 309, a carriage motor (CR motor) 310, and the recording head 7, are connected to the input/output port 304. The main control unit 300 is further connected to a personal computer (PC) 312 that is a host computer, via an interface circuit 311.

Figure 5:
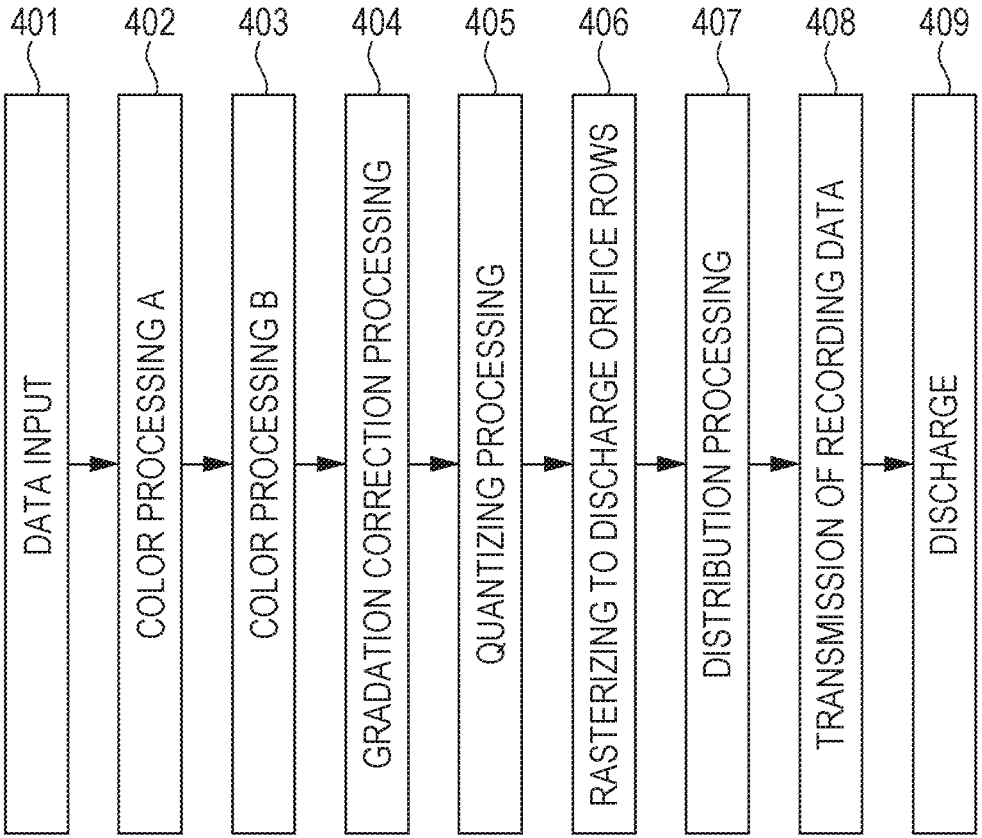
FIG. 5 is a diagram illustrating data processing steps in an embodiment.

FIG. 5 is a flowchart illustrating data processing steps that the CPU 301 executes in the present embodiment.

In step 401, original image signals that have 256 gradation levels (0 through 255) for each of red, green, and blue (RGB) acquired from an image input device such as a digital camera or scanner or the like, or by computer processing or the like, are input at resolution of 600 dpi.

In step 402, the RGB original image signals input in step 401 are converted to R'G'B' signals by color conversion processing A.

In color conversion processing B in the following step 403, the R'G'B' signals are converted into signal values corresponding to the respective color inks. The recording modes used in the present embodiment are the three colors of cyan (C), magenta (M), and yellow (Y). Accordingly, the signals after conversion are data C1, M1, and Y1, corresponding to the cyan, magenta, and yellow ink colors. Each of data C1, M1, and Y1 have 256 gradation levels (0 through 255) and resolution of 600 dpi. Specific color processing B involves using a three-dimensional look-up table (omitted from illustration) showing the relationship between the input values of R, G, and B, and the output values of C, M, Y. The output values for input values not within grid point values of the table are calculated by interpolation from the output values of surrounding table grid points. Description will be made with data C1 representing the data C1, M1, and Y1.

In step 404, gradation correction using a gradation correction table is performed on the data C1, thereby obtaining post-gradation-correction data C2.

In step 405, the data C2 is subjected to quantization processing by error diffusion to obtain gradation data C3 having five gradations (gradation levels 0, 1, 2, 3, 4) and resolution of 600 dpi×600 dpi. Although error diffusion has been described as being used here, dithering may be used instead.

In step 406, the gradation data C3 is converted into image data C4 for the discharge orifice rows in accordance with the discharge orifice row rasterization table illustrated in FIG. 6. In the present embodiment, image data C4_2 for 2 pl discharge orifice rows and image data C4_5 for 5 pl discharge orifice rows are each rasterized in the three gradations of "0", "1", and "2". Specifically, in a case where the gradation level of the gradation data C3 is 0, rasterization is performed so that the image data C4_2 for 2 pl discharge orifice rows is "0" and image data C4_5 for 5 pl discharge orifice rows is "0". In a case where the gradation level of the gradation data C3 is 1, rasterization is performed so that the image data C4_2 for 2 pl discharge orifice rows is "1" and image data C4_5 for 5 pl discharge orifice rows is "0". In a case where the gradation level of the gradation data C3 is 2, rasterization is performed so that the image data C4_2 for 2 pl discharge orifice rows is "1" and image data C4_5 for 5 pl discharge orifice rows is "1". In a case where the gradation level of the gradation data C3 is 3, rasterization is performed so that the image data C4_2 for 2 pl discharge orifice rows is "2" and image data C4_5 for 5 pl discharge orifice rows is "1". In a case where the gradation level of the gradation data C3 is 4, rasterization is performed so that the image data C4_2 for 2 pl discharge orifice rows is "2" and image data C4_5 for 5 pl discharge orifice rows is "2".

Now, the image data C4_2 and C4_5 is made up of three types of 2-bit information "00", "01", and "10", at resolution of 600 dpi×600 dpi. In a case where the 2-bit information making up the image data is "00" at a certain pixel, the value which that information indicates (hereinafter also referred to as "pixel value") is "0". Also, in a case where the 2-bit information making up the image data is "01" at a certain pixel, the value which that information indicates (pixel value) is "1". In a case where the 2-bit information making up the image data is "10" at a certain pixel, the value which that information indicates (pixel value) is "2". Details of the image data C4_2 and C4_5 will be described later.

In step 407, later-described distribution processing is performed regarding each of image data C4_2 for 2 pl of cyan ink and image data C4_5 for 5 pl of cyan ink, and recording data C5_2 and C5_5 stipulating discharge or non-discharge of cyan ink for 2 pl and 5 pl for each pixel region in each scan is generated. In the same way, recording data M5_2 for 2 pl of magenta ink and recording data M5_5 for 5 pl of magenta ink, recording data Y5_2 for 2 pl of yellow ink and recording data Y5_5 for 5 pl of yellow ink, and recording data K5_25 for 25 pl of black ink is also generated.

Thereafter, the recording data C5_2, C5_5, M5_2, M5_5, Y5_2, Y5_5, and K5_25, is transmitted to the recording head in step 408, and in step 409 ink is discharged in accordance with the recording data. The PC 312 may perform all of the processing of steps 401 through 407, or part of the processing of steps 401 through 407 may be performed by the PC 312 and the remainder by the recording apparatus 1000. In the following, description will be made regarding just the recording data C5_2 for 2 pl of cyan ink and recording data C5_5 for 5 pl of cyan ink for the sake of brevity.

Recording is performed using time-division driving and multi-pass recording in the present embodiment. Control of each of these will be described in detail below.

Time-Division Driving

In a case of using a recording head where a great number of recording elements are arranged as illustrated in FIGS. 3A through 3C, performing ink discharging by driving all of the recording elements at the same time and discharging ink at the same timing would require a large-capacity power source. As a way to reduce the size of the power source, it is commonly known to perform so-called time-division driving, where the recording elements are divided into multiple driving blocks, and the timing at which each driving block is driven to record is made to differ within the same row. This time-division driving method enables the number of recording elements being driven at the same time to be reduced, so the size of the power source necessary for the recording apparatus can be reduced.

Figure 7A:
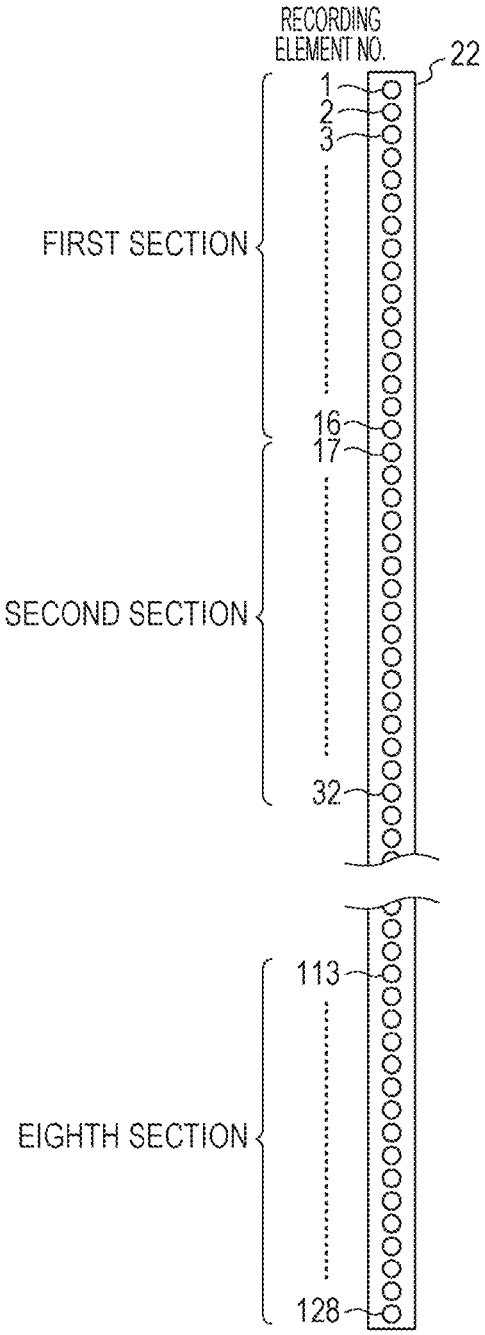
FIGS. 7A through 7C are diagrams for describing a common time-division driving method.
Figure 7B:
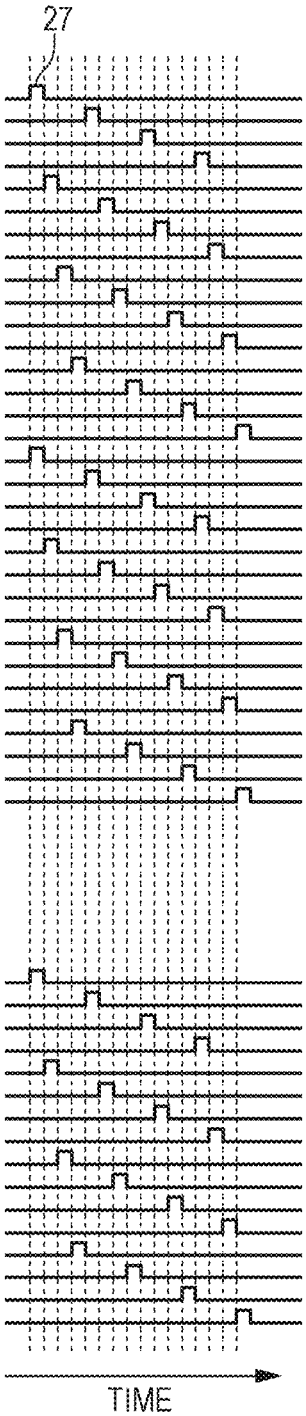
Figure 7C:
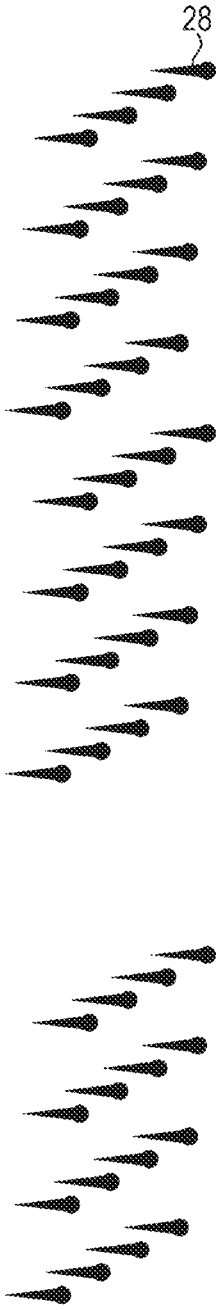

FIGS. 7A through 7C are diagrams for describing time-division driving according to the present embodiment. FIG. 7A is a diagram schematically illustrating 128 recording elements making up a single recording element row, FIG. 7B is a diagram schematically illustrating drive signals applied to the recording elements, and FIG. 7C is a diagram schematically illustrating actual ink droplets being discharged. Note that in the following description, the recording element farthest downstream in the Y direction of the 128 recording elements will be numbered recording element No. 1, with the numbers increasing toward the upstream in the Y direction in the manner of recording elements No. 2, No. 3, and so on, through No. 126, No. 127, and recording element No. 128 is the recording element farthest upstream in the Y direction, as illustrated in FIG. 7A.

In the present embodiment, the 128 recording elements are classified into eight sections from a first section through eighth section, each section being made up of 16 consecutive recording elements in the Y direction. Recording elements positioned at the same relative position in each of the eight sections form a driving block, and thus the 128 recording elements are divided into a total of 16 driving blocks, from driving block No. 1 through driving block No. 16.

In detail, the recording element farthest downstream in the Y direction of each of the eight sections from the first section through the eighth section are taken as recording elements belonging to driving block No. 1. As for a specific example, recording element No. 1, recording element No. 17, and so on through recording element No. 113, are recording elements belonging to driving block No. 1. In other words, recording elements satisfying recording element No. (16×a+1), where "a" is an integer of 0 through 7, are recording elements belonging to driving block No. 1.

Also, the recording element second farthest downstream in the Y direction of each of the eight selections from the first section through the eighth section are taken as recording elements belonging to driving block No. 2. That is to say, recording element No. 2, recording element No. 18, and so on through recording element No. 114, are recording elements belonging to driving block No. 2. In other words, recording elements satisfying recording element No. (16×a+2), where "a" is an integer of 0 through 7, are recording elements belonging to driving block No. 2. This holds for the other driving blocks No. 3 through No. 16. Specifically, recording elements satisfying recording element No. (16× a+b), where "a" is an integer of 0 through 7, are recording elements belonging to driving block No. b.

Driving of the recording elements is controlled in time-division driving according to the present embodiment so that the recording elements belonging to different driving blocks are sequentially driven at different timings from each other, following a preset driving order. The driving order settings are stored in the ROM 302 within the recording apparatus 1000 in the present embodiment, and are transmitted to the recording head 7 via the drive circuit 307. Block enable signals are transmitted to the recording head 7 at predetermined intervals, and the driving signals according to the AND of the block enable signals and recording data are applied to the recording elements. FIG. 7B illustrates recording elements belonging to the driving blocks being driven by driving signals 27 applied in the driving order of driving block Nos. 1, 5, 9, 13, 2, 6, 10, 14, 3, 7, 11, 15, 4, 8, 12, 16. As a result, ink droplets 28 are discharged as illustrated in FIG. 7C.

Multi-Pass Recording

Figure 8:
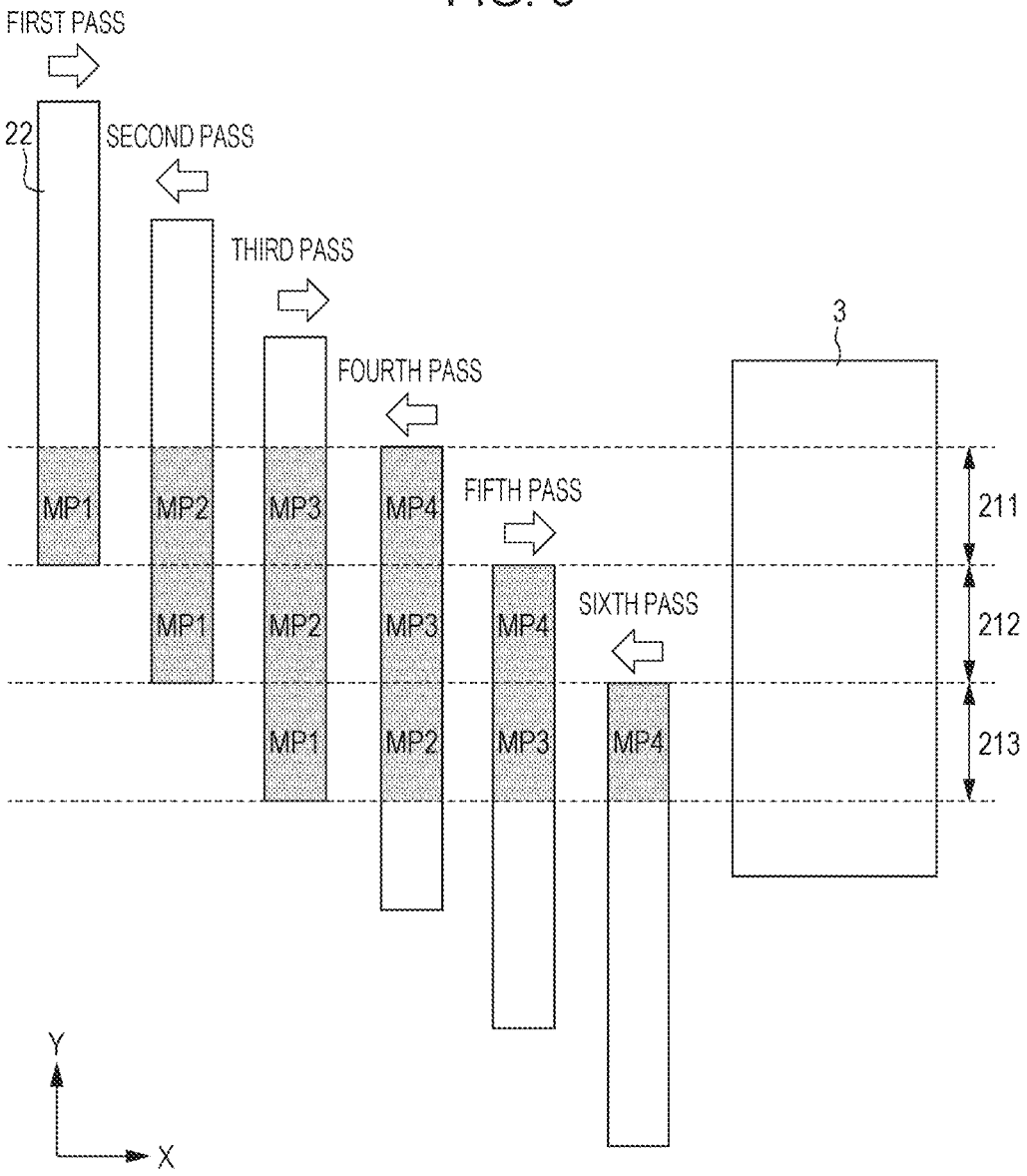
FIG. 8 is a diagram for describing multi-pass recording according to an embodiment.

Recording is performed in the present embodiment using multi-pass recording, where a unit region on a recording medium is recorded by multiple scans. FIG. 8 is a diagram for describing general multi-pass recording, illustrating an example where recording is performed within a unit region by four scans. Multi-pass recording according to the present embodiment involves alternating scans from the upstream side in the X direction to the downstream side (hereinafter, also referred to as scanning in the "forward" direction) and scans from the downstream side in the X direction to the upstream side (hereinafter, also referred to as scanning in the "backward" direction).

The recording elements provided in recording element row 22 are divided into first, second, third, and fourth recording element groups in the Y direction. The first recording element group is made up of recording elements No. 97 through 128, the second recording element group is made up of recording elements No. 65 through 96, the third recording element group is made up of recording elements No. 33 through 64, and the fourth recording element group is made up of recording elements No. 1 through 32. The length of each of the first through fourth recording element groups in the Y direction is L/4, where the Y-directional length of the recording element row 22 is L.

In the first recording scan (first pass), ink is discharged from the first recording element group to a unit region 211 on the recording medium 3. This first pass is made from the upstream side toward the downstream side in the X direction.

Next, the recording medium 3 is conveyed relative to the recording head 7, from the upstream side toward the downstream side in the Y direction, by a distance L/4. Although a case is illustrated here where the recording head 7 has been conveyed over the recording medium 3 from the downstream side toward the upstream side in the Y direction for the sake of brevity, the relative positional relationship of the recording medium 3 as to the recording head 7 after conveyance is the same as the recording medium 3 having been conveyed in downstream in the Y direction.

Thereafter, the second recording scan is performed. In the second recording scan (second pass), ink is discharged from the second recording element group to the unit region 211, and from the first recording element group to a unit region 212, on the recording medium 3. This second pass is made from the downstream side toward the upstream side in the X direction.

The reciprocal scanning of the recording head 7 and the relative conveyance of the recording medium 3 are alternately performed thereafter. As a result, after the fourth recording scan (fourth pass) has been performed, ink has been discharged onto the unit region 211 of the recording medium 3 once from each of the first through fourth recording element groups. Although a case of performing recording by four scans has been described here, recording can be performed in the same way by a different number of scans.

1-bit recording data to use in each scan is generated from the image data in the above-described multi-pass recording according to the present embodiment, using image data having n (n≥2) bits of information per pixel, mask patterns having m (m≥2) bits of information per pixel, and a decoding table stipulating discharging or non-discharging of ink in accordance with a combination of values indicated by multiple bits of information in each of the image data and mask pattern. The information of n bits per pixel of the image data corresponds to the number of times of discharge of ink to each pixel. Also, the information of m bits per pixel in the mask pattern corresponds to the number of ink discharge permitted to each pixel. A case will be described below where both the image data and mask pattern are made up of 2-bit information.

FIGS. 9A through 9E are diagrams illustrating the process of generating recording data using image data and mask patterns, each having multiple bits of information. FIG. 10 is a diagram illustrating a decoding table used to generate recording data such as illustrated in FIGS. 9A through 9E.

FIG. 9A is a diagram schematically illustrating 16 pixels 700 through 715 in a certain unit region. Although a unit region made up of pixel regions equivalent to 16 pixels is used for description here, for sake of brevity, the unit region according to the present embodiment has a size corresponding to 32 recording elements, as described with reference to FIG. 8, so the unit region in the present embodiment actually is made up of pixel regions equivalent to 32 pixels in the Y direction.

FIG. 9B is a diagram illustrating an example of image data corresponding to the unit region. In a case where the 2-bit information making up image data corresponding to a certain pixel is "00", i.e., the pixel value is "0", the number of times of ink discharge to that pixel is zero in the present embodiment. In a case where the 2-bit information making up image data corresponding to a certain pixel is "01", i.e., the pixel value is "1", the number of times of ink discharge to that pixel is once. Further, in a case where the 2-bit information making up image data corresponding to a certain pixel is "10", i.e., the pixel value is "2", the number of times of ink discharge to that pixel is twice. Accordingly, the pixel value for pixel 703, for example, in the image data in FIG. 9B is "0", so the number of times that ink is discharged to the pixel region corresponding to pixel 703 is zero. Also, the pixel value for pixel 700 for example is "2", so the number of times that ink is discharged to the pixel region corresponding to pixel 700 is twice.

FIGS. 9C1 through 9C4 are diagrams illustrating mask patterns to be applied to the image data illustrated in FIG. 9B, corresponding to the first through fourth scans, respectively. That is to say, the mask pattern MP1 corresponding to the first scan illustrated in FIG. 9C1 is applied to the image data illustrated in FIG. 9B, thereby generating recording data used in the first scan. In the same way, the mask patterns MP2, MP3, and MP4, corresponding to the second, third and fourth scan illustrated in FIGS. 9C2 through 9C4, are applied to the image data illustrated in FIG. 9B, thereby generating recording data used in the second, third and fourth scan, respectively.

Each of the pixels in the mask patterns illustrated in FIGS. 9C1 through 9C4 have 2-bit information set to one of "00", "01", and "10". In a case where the 2-bit information is "10", the value that the information indicates (hereinafter also referred to as "code value") is "2". In a case where the 2-bit information is "01", the value that the information indicates (code value) is "1". In a case where the 2-bit information is "00", the value that the information indicates (code value) is "0".

It can be seen by referencing the decoding table in FIG. 10 that in a case where the code value is "0", no ink is discharged, regardless of whether the pixel value corresponding to that pixel is "0", "1", or "2". That is to say, the code value "0" in the mask pattern corresponds to not permitting ink discharge at all (the number of ink discharge permitted is zero). In the following description, a pixel in a mask pattern to which the code value "0" has been allocated is also referred to as a "recording non-permitted pixel".

On the other hand, it can be seen by referencing the decoding table in FIG. 10 that in a case where the code value is "2", no ink is discharged if the pixel value of the corresponding pixel is "0" or "1", but ink is discharged if "2". That is to say, the code value of "2" corresponds to permitting discharge of ink once (the number of ink discharge permitted is once) as to three pixel values.

Further, in a case where the code value is "1", no ink is discharged if the pixel value of the corresponding pixel is "0", but ink is discharged if "1" or "2". That is to say, the code value of "1" corresponds to permitting discharge of ink twice (the number of ink discharge permitted is twice) as to three pixel values ("0", "1", and "2"). That is to say, the code value "1" is a code value that sets the largest number of times permitted, out of the number of times permitted that is reproduced by the 2-bit information making up the mask pattern. In the following description, a pixel in a mask pattern to which a code value "1" or "2" has been allocated is also referred to as a "recording permitted pixel".

Now, a mask pattern having m-bit information that is used in the present embodiment is set based on the following Condition 1 and Condition 2.

Condition 1

Two of the four pixels at the same position in each of the four mask patterns illustrated in FIGS. 9C1 through 9C4 are allocated one code value each of "1" and "2" (recording permitted pixels), and the remaining two pixels (i.e., 4−2=2) are allocated the code value "0" (recording non-permitted pixel). For example, the pixel 700 is allocated the code value of "2" in the mask pattern illustrated in FIG. 9C1, and allocated "1" in the mask pattern illustrated in FIG. 9C2. The code value "0" is the allocated in the mask patterns in FIGS. 9C3 and 9C4. The pixel 700 thus is a recording permitted pixel in the mask patterns illustrated in FIGS. 9C1 and 9C2, and is a recording non-permitted pixel in the mask patterns illustrated in FIGS. 9C3 and 9C4.

Also, the pixel 701 is allocated the code value of "2" in the mask pattern illustrated in FIG. 9C4, and allocated "1" in the mask pattern illustrated in FIG. 9C1. The code value "0" is then allocated in the mask patterns in FIGS. 9C2 and 9C3. The pixel 701 thus is a recording permitted pixel in the mask patterns illustrated in FIGS. 9C1 and 9C4, and is a recording non-permitted pixel in the mask patterns illustrated in FIGS. 9C2 and 9C3. According to this configuration, recording data can be generated to discharge ink at a pixel region corresponding to certain pixel, regardless of whether the pixel value of that pixel is "0", "1", or "2", for a number of times of discharge corresponding to that pixel value.

Condition 2

The mask patterns illustrated in FIGS. 9C1 through 9C4 are each arranged so that the number of recording permitted pixels corresponding to the code value "1" is about the same number in each. More specifically, the code value "1" is allocated to the four pixels 701, 706, 711, and 712 in the mask pattern illustrated in FIG. 9C1. The code value "1" is allocated to the four pixels 700, 705, 710, and 715 in the mask pattern illustrated in FIG. 9C2. Further, the code value "1" is allocated to the four pixels 703, 704, 709, and 714 in the mask pattern illustrated in FIG. 9C3. Moreover, the code value "1" is allocated to the four pixels 702, 707, 708, and 713 in the mask pattern illustrated in FIG. 9C4. In other words, there are four recording permitted pixels corresponding to the code value "01" in each of the four mask patterns illustrated in FIGS. 9C1 through 9C4. In the same way, the mask patterns illustrated in FIGS. 9C1 through 9C4 are each arranged so that the number of recording permitted pixels corresponding to the code value "2" is the same number in each.

Although the same number of recording permitted pixels corresponding to each of the code values "1" and "2" are arranged in the mask patterns in the above description, in practice a number that is about the same will suffice. Accordingly, when generating recording data by distributing the image data over four scans using the mask patterns illustrated in FIGS. 9C1 through 9C4, the recording ratio can be made to be about the same for the four scans.

FIGS. 9D1 through 9D4 are diagrams illustrating recording data generated by applying the mask patterns illustrated in each of FIGS. 9C1 through 9C4 to the image data illustrated in FIG. 9B. For example, looking at the pixel 700 in the recording data corresponding to the first scan illustrated in FIG. 9D1, the pixel value of the image data is "2" and the code value of the mask pattern is "2", so ink discharge ("1") is set for the pixel 700 in accordance with the decoding table in FIG. 10. For the pixel 701, the pixel value of the image data is "1" and the code value of the mask pattern is "1", so ink discharge ("1") is set. For the pixel 704, the pixel value of the image data is "2" and the code value of the mask pattern is "0", so ink non-discharge ("0") is set.

Ink is discharged in the first through fourth scans following the recording data illustrated in FIGS. 9D1 through 9D4, that has been generated in this way. For example, ink is discharged to the pixel regions on the recording medium corresponding to pixels 700, 701, and 712 in the first scan, which can be seen from the recording data illustrated in FIG. 9D1.

FIG. 9E is a diagram showing the logical sum of recording data illustrated in each of FIGS. 9D1 through 9D4. By discharging ink according to the recording data illustrated in FIGS. 9D1 through 9D4, the pixel regions corresponding to the pixels receive discharge of ink as many times as shown in FIG. 9E.

For example, discharging of ink is set for the pixel 700 in recording data corresponding to the first and second scans illustrated in FIGS. 9D1 and 9D2. Accordingly, ink is discharged twice to the pixel region corresponding to the pixel 700, as illustrated in FIG. 9E. Also, discharging of ink is set for the pixel 701 in recording data corresponding to the first scan illustrated in FIG. 9D1. Accordingly, ink is discharged once to the pixel region corresponding to the pixel 701, as illustrated in FIG. 9E.

Comparing the recording data illustrated in FIG. 9E with the image data illustrated in FIG. 9B reveals that the recording data has been generated so that ink is discharged to each pixel in accordance with the number of times of discharge corresponding to the pixel value of the image data. For example, the pixel value of the image data in FIG. 9B for the pixels 700, 704, 708, and 712 is "2", and the number of times of discharge of ink indicated by the logical sum of the generated recording data also is twice. According to this configuration, 1-bit recording data used for each of multiple scans can be generated based on image data and mask patterns that have multi-bit information.

Discharge Deviation of Ink in Reciprocal Scanning

Next, deviation of ink discharge positions among forward scanning and backward scanning (between reciprocal scans) will be described in detail. The present embodiment suppresses deviation of ink discharge positions between reciprocal scans by the driving order of driving blocks in time-division driving control, and mask pattern used in multi-pass recording. First, the correlation between the driving order of driving blocks in time-division driving control and ink landing positions in each driving block in the same row extending in the Y direction will be described with reference to FIGS. 11A through 11C.

FIG. 11A is a diagram illustrating an example of driving order in time-division driving control. FIG. 11B is a schematic diagram illustrating the way in which dots are formed in a case of driving recording element No. 1 through No. 16 while scanning from the upstream side toward the downstream side in the X direction (forward direction scan) following the driving order shown in FIG. 11A. FIG. 11C is a schematic diagram illustrating the way in which dots are formed in a case of driving recording element No. 1 through No. 16 while scanning from the downstream side toward the upstream side in the X direction (backward direction scan) following the driving order shown in FIG. 11A. Note that the recording element No. is larger in the upstream direction in the Y direction, as illustrated in FIG. 7A, so in the case of both FIGS. 11B and 11C, the dot situated at the position farthest downstream in the Y direction is a dot formed by the recording element No. 1, the farther upstream in the Y direction from that position the dots are, the larger the recording element No. of the recording element forming that dot will be, and the dot situated at the end position farthest upstream in the Y direction is a dot formed by the recording element No. 16.

An example will be described here where time-division driving is performed in the driving order of driving block No. 1, driving block No. 2, driving block No. 3, driving block No. 4, driving block No. 5, driving block No. 6, driving block No. 7, driving block No. 8, driving block No. 9, driving block No. 10, driving block No. 11, driving block No. 12, driving block No. 13, driving block No. 14, driving block No. 15, and driving block No. 16, as illustrated in FIG. 11A. When scanning in the forward direction, ink droplets discharged by recording elements that are driven earlier are discharged at the upstream side in the X direction. Accordingly, in a case of performing time-division driving of the recording elements No. 1 through No. 16 in the driving order illustrated in FIG. 11A, the dot formed by the recording element No. 1 is situated farthest upstream in the X direction, the larger the recording element No. is, the farther the dots are shifted in the downstream side in the X direction, and the dot formed by the recording element No. 16 is situated farthest downstream in the X direction, as illustrated in FIG. 11B.

On the other hand, when scanning in the backward direction, ink droplets discharged by recording elements that are driven earlier are discharged at the downstream side in the X direction. Accordingly, in a case of performing time-division driving of the recording elements No. 1 through No. 16 in the driving order illustrated in FIG. 11A, the dot formed by the recording element No. 1 is situated farthest downstream in the X direction, the larger the recording element No. is, the farther the dots are shifted in the upstream side in the X direction, and the dot formed by the recording element No. 16 is situated farthest upstream in the X direction, as illustrated in FIG. 11C. Thus, the earlier in the order of having driven the driving blocks when scanning in the forward direction, the more upstream in the X direction the position of the dots formed will be. On the other hand, the earlier in the order of having driven the driving blocks when scanning in the backward direction, the more downstream in the X direction the position of the dots formed will be.

It can thus be seen that even if the driving order is the same, the ink landing position from the driving blocks under time-division driving control will be reversed if the scan direction is different. Now, it can be understood that if the driving order of driving blocks when scanning in the backward direction is changed to be the reverse of the driving order of driving blocks when scanning in the forward direction, the landing positions of ink from the driving blocks under time-division driving control will be the same in forward direction scanning and backward direction scanning. More specifically, for example, in the case of time-division driving of the recording elements No. 1 through No. 16 in the driving order illustrated in FIG. 11A when scanning in the forward direction, the ink landing positions when scanning in the backward direction can be made to be the same as in the forward direction by performing time-division driving in the driving order of driving block No. 16, driving block No. 15, driving block No. 14, driving block No. 13, driving block No. 12, driving block No. 11, driving block No. 10, driving block No. 9, driving block No. 8, driving block No. 7, driving block No. 6, driving block No. 5, driving block No. 4, driving block No. 3, driving block No. 2, and driving block No. 1.

In light of the above, description will be made regarding ink landing position deviation from each driving block among reciprocal scans in time-division driving for multiple combinations set between recording data and driving order. FIGS. 12A1 through 12E are diagrams for describing combinations of recording data and driving order. FIGS. 12A1 and 12A2 illustrate an example of recording data corresponding to forward scanning and backward scanning, and FIGS. 12B1 and 12B2 illustrate another example of recording data corresponding to forward scanning and backward scanning. Note that the solid pixels in FIG. 12A1 through 12B2 indicate ink discharge (the recording data is "1"). FIG. 12C illustrates an example of driving order in time-division driving, and FIG. 12D illustrates another example of driving order in time-division driving. FIG. 12E illustrates the contents of the four sets with different recording data and driving order. It can be seen from FIG. 12E that four sets recording data and driving order are set, from a first set through a fourth set.

For the first set, the recording data illustrated in FIGS. 12B1 and 12B2 are used as recording data for forward scanning and backward scanning, respectively, with the driving order for the forward scan being the driving order illustrated in FIG. 12C, and the driving order for the backward scan being the driving order illustrated in FIG. 12D.

The recording data illustrated in FIGS. 12B1 and 12B2 is data where pixels set for recording are consecutive in the X direction (dispersion in the X direction of pixels set for recording is low). The driving order for the forward scan (FIG. 12C) and the driving order for the backward scan (FIG. 12D) are opposite from each other as described above, so the ink landing positions from the driving blocks in time-division driving control is the same among reciprocal scans.

For the second set, the recording data illustrated in FIGS. 12A1 and 12A2 are used as recording data for forward scanning and backward scanning, respectively, with the driving order for the forward scan being the driving order illustrated in FIG. 12C, and the driving order for the backward scan being the driving order illustrated in FIG. 12D. The recording data illustrated in FIGS. 12A1 and 12A2 is data where pixels set for recording are non-consecutive in the X direction (dispersion in the X direction of pixels set for recording is high). The driving order for the forward scan (FIG. 12C) and the driving order for the backward scan (FIG. 12D) are opposite from each other as described above, so the ink landing positions from the driving blocks in time-division driving is the same among reciprocal scans.

For the third set, the recording data illustrated in FIGS. 12B1 and 12B2 are used as recording data for forward scanning and backward scanning, respectively, with the driving order for the forward scan and backward scan being the driving order illustrated in FIG. 12C. The recording data illustrated in FIGS. 12B1 and 12B2 is data where pixels set for recording are consecutive in the X direction (dispersion in the X direction of pixels set for recording is low). The driving order for the forward scan and the backward scan (FIG. 12C) are the same as described above, so the ink landing positions from the driving blocks in time-division driving are opposite among reciprocal scans.

For the fourth set, the recording data illustrated in FIGS. 12A1 and 12A2 are used as recording data for forward scanning and backward scanning, respectively, with the driving order for the forward scan and backward scan being the driving order illustrated in FIG. 12C. The recording data illustrated in FIGS. 12A1 and 12A2 is data where pixels set for recording are non-consecutive in the X direction (dispersion in the X direction of pixels set for recording is high). The driving order for the forward scan and the backward scan (FIG. 12C) are the same as described above, so the ink landing positions from the driving blocks in time-division driving are opposite among reciprocal scans.

Images recorded in a case where deviation occurs between forward scans and backward scans in the four combinations of recording data and driving order will be described with reference to FIGS. 13A through 16D. FIGS. 13A through 13D illustrate the images recorded in the case of the first set, FIGS. 14A through 14D the second set, FIGS. 15A through 15D the third set, and FIGS. 16A through 16D the fourth set. In each of FIGS. 13A through 16D, the "A"s schematically illustrate images recorded in a case where there is no deviation between the forward scan and the backward scan, the "B"s illustrate images recorded in a case where there is deviation of approximately 1/4 dots in the X direction between the forward scan and the backward scan, the "C"s illustrate images recorded in a case where there is deviation of approximately 2/4 dots in the X direction between the forward scan and the backward scan, and the "D"s illustrate images recorded in a case where there is deviation of approximately 3/4 dots in the X direction between the forward scan and the backward scan. In all of the illustrations, the circles with vertical lines inside represent dots formed in the forward scan, and the circles with horizontal lines inside represent dots formed in the backward scan.

Figure 13A:
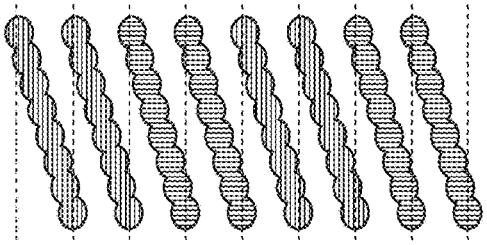
FIGS. 13A through 13D are diagrams for describing the degree of ink discharge position deviation among scans.
Figure 13B:
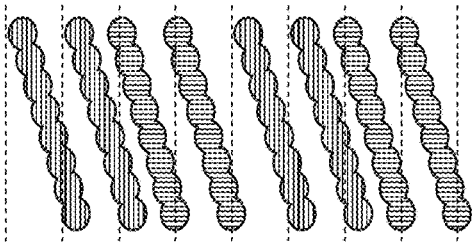
Figure 13C:
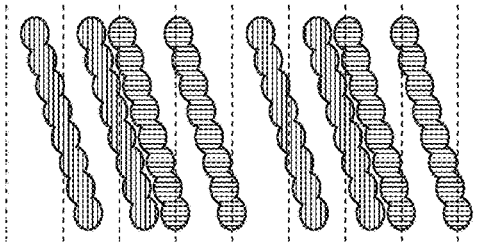
Figure 13D:
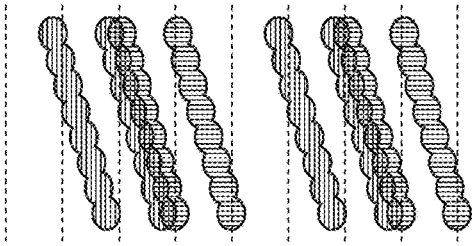
Figure 13D:
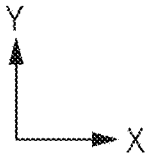

First, the first set will be described. In a case where there is no positional deviation between the forward scan and the backward scan, an ideal image can be recorded where the distance between dots in the X direction is uniformly dispersed, as illustrated in FIG. 13A according to the first set. However, as the deviation in the X direction between reciprocal scans increases, as illustrated in FIGS. 13B, 13C, and 13D, the distances between dots all become shorter among some pixels, while the distances between dots all become longer among other pixels. For example, the distances between dots all become shorter between the second pixel and third pixel from the left as the deviation in the X direction between reciprocal scans increases. The distances between dots all become longer between the fourth pixel and fifth pixel from the left as the deviation in the X direction between reciprocal scans increases. As a result, in a case where there is approximately 3/4 dots worth of deviation in the X direction for example, dot which should have been formed at different pixels in the image being recorded become overlapped as illustrated in FIG. 13D, and coverage by dots is quite different from that illustrated in FIG. 13A. Accordingly, the image quality of the obtained image is markedly low. Thus, the settings of the first set can obtain preferable images in a case where there is no deviation in the X direction between reciprocal scans, but the desired image quality may not be able to be obtained in a case where there is deviation in the X direction between reciprocal scans.

Figure 14A:
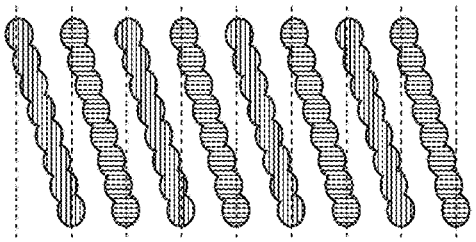
FIGS. 14A through 14D are diagrams for describing the degree of ink discharge position deviation among scans.
Figure 14B:
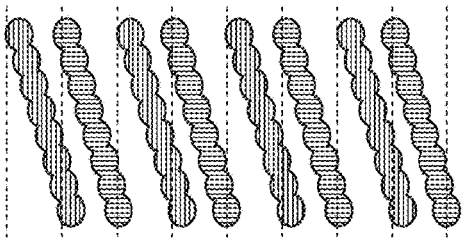
Figure 14C:
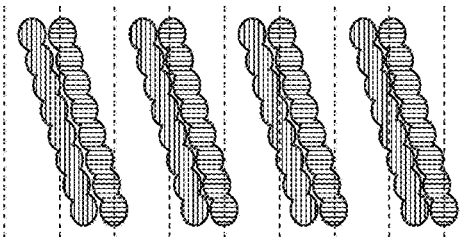
Figure 14D:
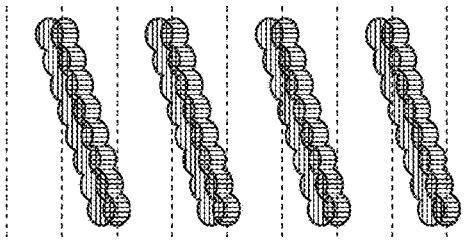
Figure 14D:
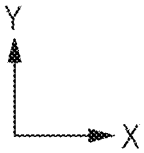

Next, the second set will be described. In a case where there is no positional deviation between the reciprocal scans, an ideal image can be recorded where the distance between dots in the X direction is uniformly dispersed, as illustrated in FIG. 14A, according to the second set, in the same way as with the first set in FIG. 13A. However, as the deviation in the X direction between reciprocal scans increases, as illustrated in FIGS. 14B, 14C, and 14D, the distances between dots all become shorter among some pixels, while the distances between dots all become longer among other pixels. For example, the distances between dots all become shorter between the first pixel and second pixel from the left as the deviation in the X direction between reciprocal scans increases. The distances between dots all become longer between the second pixel and third pixel from the left as the deviation in the X direction between reciprocal scans increases. Thus, the settings of the second set also can obtain preferable images in a case where there is no deviation in the X direction between reciprocal scans, but cannot suppress deterioration in image quality in a case where there is deviation in the X direction between reciprocal scans.

Figure 15A:
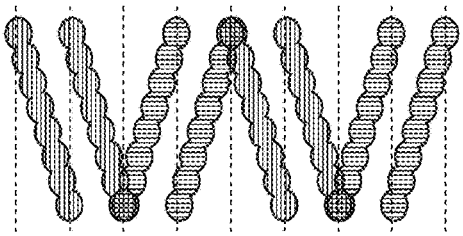
FIGS. 15A through 15D are diagrams for describing the degree of ink discharge position deviation among scans.
Figure 15B:
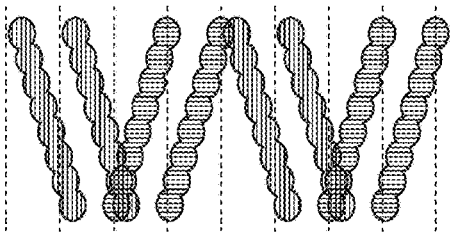
Figure 15C:
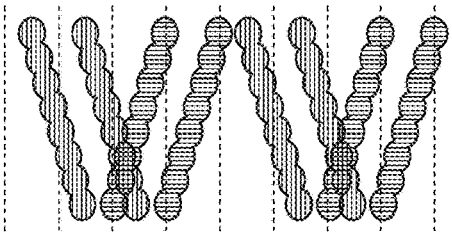
Figure 15D:
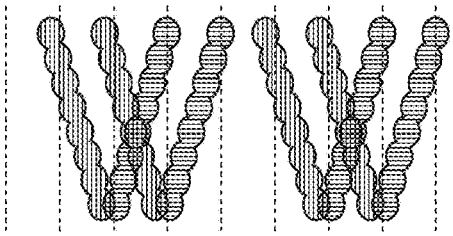
Figure 15D:
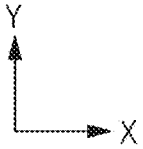

Next, the third set will be described. In a case where there is no positional deviation between the reciprocal scans, the distance between dots in the X direction is non-uniform, as illustrated in FIG. 15A, according to the third set. For example, between the second pixel and third pixel from the left, the distances between dots become long at the topmost side, while the distances between dots become short at the bottommost side. On the other hand, in a case where there is deviation in the X direction between reciprocal scans, difference in coverage of dots does not occur as readily as in the settings of the first and second sets, as illustrated in FIGS. 15B and 15C. Accordingly, deterioration in image quality due to deviation in the X direction between reciprocal scans can be suppressed to a certain degree by the settings according to the third set. However, in a case where deviation in the X direction between reciprocal scans is relatively great as illustrated in FIG. 15D, the sparseness of dots differs depending on the region. For example, at the lower side of the first through fourth pixels, the dots are dense while dots at the upper side are sparse, so there is unevenness in density. Accordingly, the obtained image quality is undesirable.

Figure 16A:
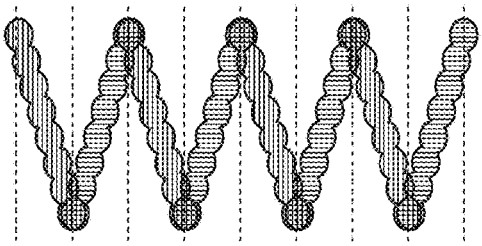
FIGS. 16A through 16D are diagrams for describing the degree of ink discharge position deviation among scans.
Figure 16B:
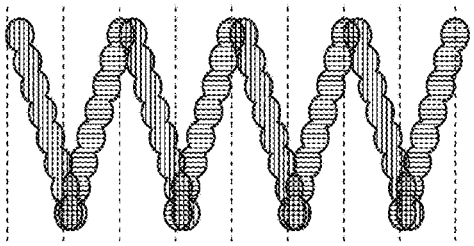
Figure 16C:
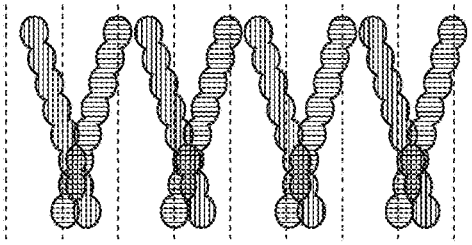

Finally, the fourth set will be described. In a case where there is no positional deviation between the reciprocal scans, the distance between dots in the X direction is non-uniform according to the fourth set, as illustrated in FIG. 16A, in the same way as the third set in FIG. 15A. For example, between the first pixel and second pixel from the left, the distances between dots become long at the topmost side, while the distances between dots become short at the bottommost side. Also, between the second pixel and third pixel from the left, the distances between dots become short at the topmost side, while the distances between dots become long at the bottommost side. Accordingly, there is some deterioration in image quality compared to the settings of the first set and second set in a case where there is no positional deviation in between reciprocal scans, but the width of an actual pixel is not that great, so the deterioration in image quality is not very conspicuous. Further, according to the settings of the fourth set, even in a case where there is deviation in the X direction between reciprocal scans illustrated in FIGS. 16B through 16D, recording can be performed with no difference in coverage of dots and no unevenness in density, as compared with FIG. 16A.

It can be thus seen from the images recorded by the settings according to the first, second third, and fourth sets, the settings according to the fourth set is most preferable with regard to suppressing image quality deterioration due to deviation in the X direction between reciprocal scans. Accordingly, recording data is generated in the present embodiment such that dots formed in the forward scans and dots recorded in the backward scans alternate in the X direction, and further, time-division driving is performed so that the dot landing positions from the driving blocks differ between reciprocal scans. Now, the driving order of the driving blocks in scanning in the forward direction and scanning in the backward direction is not opposite to each other in the present embodiment. Thus, the discharge positions of dots recorded in the forward scan and the backward scan can be made to be different, as described with reference to FIGS. 11A through 11C.

Mask Patterns Applied in Present Embodiment

In the present embodiment, a mask pattern applied to the image data C4_2 for 2 pl of cyan ink and a mask pattern applied to the image data C4_5 for 5 pl of cyan ink are different from each other. The reason for this will be described later. First, mask patterns MP1_2 through MP4_2 corresponding to 2 pl of cyan ink will be described.

Figure 17A:
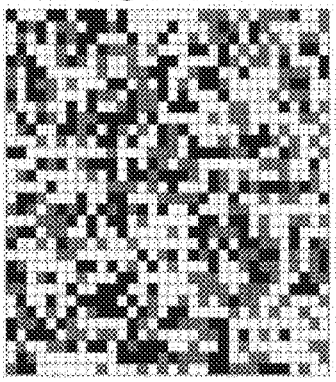
FIGS. 17A through 17F are diagrams illustrating mask patterns applied in an embodiment.
Figure 17B:
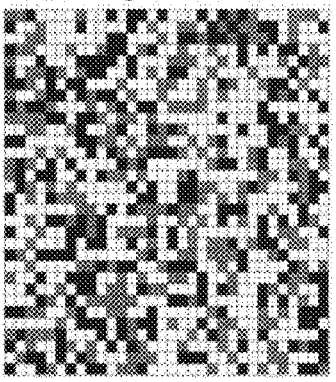
Figure 17C:
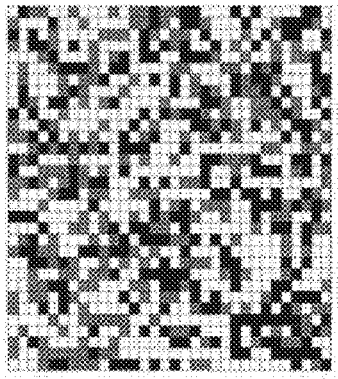
Figure 17D:
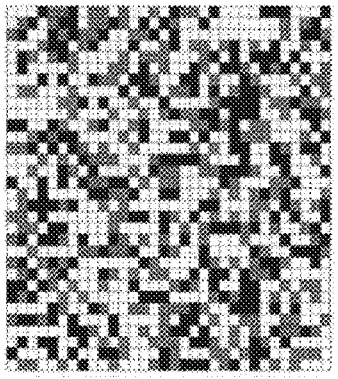
Figure 17E:
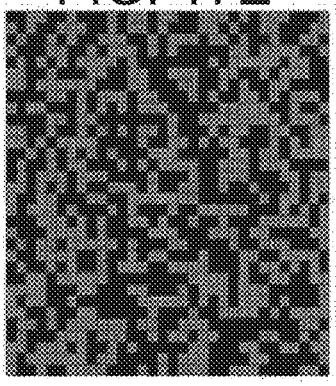
Figure 17F:
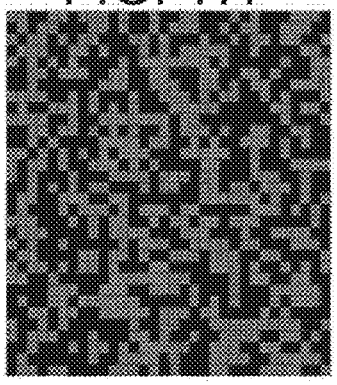
Figure 17F:
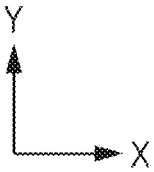

FIGS. 17A through 17F are diagrams illustrating mask patterns used for image data C4_2 of cyan ink in the present embodiment. Note that FIG. 17A illustrates a mask pattern MP1_2 for 2 pl of cyan ink corresponding to the first scan, FIG. 17B illustrates a mask pattern MP2_2 for 2 pl of cyan ink corresponding to the second scan, FIG. 17C illustrates a mask pattern MP3_2 for 2 pl of cyan ink corresponding to the third scan, and FIG. 17D illustrates a mask pattern MP4_2 for 2 pl of cyan ink corresponding to the fourth scan. Also, FIG. 17E illustrates a logical sum pattern MP1_2+MP3_2 obtained as the logical sum of the number of times of permitted discharge of ink stipulated in the mask pattern MP1_2 corresponding to the first scan in FIG. 17A and the mask pattern MP3_2 corresponding to the third scan in FIG. 17C. Further, FIG. 17F illustrates a logical sum pattern MP2_2+MP4_2 obtained as the logical sum of the number of times of permitted discharge of ink stipulated in the mask pattern MP2_2 corresponding to the second scan in FIG. 17B and the mask pattern MP4_2 corresponding to the fourth scan in FIG. 17D. In FIGS. 17A through 17F, the white pixels indicate pixels to which the code value "0" has been allocated, the gray pixels indicate pixels to which the code value "1" has been allocated, and the black pixels indicate pixels to which the code value "2" has been allocated. It can be seen from these FIGS. 17A through 17F that an arrangement 32 pixels in the X direction and 32 pixels in the Y direction, for a total of 1024 pixels, to which the number of permitted times of ink discharge has been set, is used as a repetitive increment of a mask pattern, and this repetitive increment is repeated in the X direction and the Y direction.

The logical sum of the number of permitted times of ink discharge means the result of calculating the sum of the permitted number of times indicated by the code values within the corresponding multiple mask patterns. For example, the code value is "2" (number of permitted ink discharges is once) for the pixel at the farthest upper left of the mask pattern MP1_2 illustrated in FIG. 17A, and the code value is "0" (number of permitted ink discharges is zero) for the pixel at the farthest upper left of the mask pattern MP3_2 illustrated in FIG. 17C, so the code value is "2" (number of permitted ink discharges is once) for the pixel at the farthest upper left of the logical sum pattern MP1_2+MP3_2 illustrated in FIG. 17E. Also, for example, the code value is "1" (number of permitted ink discharges is once) for the pixel at the farthest upper left of the mask pattern MP2_2 illustrated in FIG. 17B, and the code value is "0" (number of permitted ink discharges is zero) for the pixel at the farthest upper left of the mask pattern MP4_2 illustrated in FIG. 17D, so the code value is "1" (number of permitted ink discharges is twice) for the pixel at the farthest upper left of the logical sum pattern MP2_2+MP4_2 illustrated in FIG. 17F.

The mask patterns MP1_2 through MP4_2 illustrated in FIGS. 17A through 17D are set so as to satisfy the above-described Condition 1 and Condition 2 of mask patterns MP1_2 through MP4_2. That is to say, code values are allocated to the pixels such that, of four pixels at the same position in the mask patterns illustrated in FIGS. 17A through 17D, one each of code values "1" and "2" is allocated to two pixels, and code value "0" is allocated to the remaining two (i.e., 4−2=2) pixels (Condition 1). Further, code values are allocated to the pixels such that, among the mask patterns MP1_2 through MP4_2 illustrated in FIGS. 17A through 17D, the number of pixels to which the code value "1" has been allocated is about the same, and the number of pixels to which the code value "2" has been allocated is about the same (Condition 2).

In order to suppress ink discharge position deviation between reciprocal scans in the present embodiment, recording data is generated so as to discharge ink at the same pixel region in the forward direction scans (first and third scans) and backward scans (second and fourth scans), when recording images at high concentration. In light of this, code values are allocated to the pixels so that, of four pixels at the same position in the mask patterns MP1_2 through MP4_2 used in the present embodiment, a pixel to which code value "1" is allocated in either one of mask patterns MP1_2 and MP3_2 corresponding to forward scans is allocated code value "2" in either one of the mask patterns MP2_2 and MP4_2 corresponding to backward scans, and a pixel to which code value "2" is allocated in either one of mask patterns MP1_2 and MP3_2 corresponding to forward scans is allocated code value "1" in either one of mask patterns MP2_2 and MP4_2 corresponding to backward scans. Accordingly, recording data can be generated where one pixel region receives discharge of ink one time each in a forward scan and a backward scan, in a case of receiving input of image data that is high in concentration, such as where the pixel value is "2", for example.

Further, the mask patterns MP1_2 through MP4_2 illustrated in FIGS. 17A through 17D are set such that pixels allocated code value "1" in the logical sum pattern MP1_2+MP3_2 do not occur alternately in the X direction with pixels allocated code value "1" in the logical sum pattern MP2_2+MP4_2. More specifically, the pixels in the mask patterns MP1_2 through MP4_2 have code values allocated such that the pixels allocated code value "1" in the logical sum pattern MP1_2+MP3_2 have an array with random white noise properties, and the pixels allocated code value "1" in the logical sum pattern MP2_2+MP4_2 have an array with random white noise properties.

To describe this in detail, the logical sum pattern MP1_2+MP3_2 according to the present embodiment has the code value "1" allocated to 513 of the 1024 pixels therein, and of these, 119 pixels to which the code "1" has been allocated are adjacent at both sides in the X direction to a pixel that has been allocated code value "1" in the logical sum pattern MP2_2+MP4_2. On the other hand, of the 513 pixels to which the code value "1" has been allocated in the logical sum pattern MP1_2+MP3_2, 119 pixels to which the code "1" has been allocated are not adjacent in the X direction to a pixel that has been allocated code value "1" in the logical sum pattern MP2_2+MP4_2. That is to say, in the present embodiment, of the pixels to which the code value "1" has been allocated in the logical sum pattern MP1_2+MP3_2, the number of pixels adjacent at both sides in the X direction to a pixel that has been allocated code value "1" in the logical sum pattern MP2_2+MP4_2, and the number of pixels not adjacent in the X direction, is the same number.

For example, in the row at the edge portion of the logical sum pattern MP1_2+MP3_2 farthest downstream in the Y direction (the top in FIG. 17E), the code value "1" is allocated to the 3rd, 4th, 7th, 11th, 13th, 14th, 16th, 17th, 20th, 21st, 22nd, 24th, 26th, 27th, 28th, and 32nd pixels from the upstream side in the X direction (left side in FIG. 17E). On the other hand, the row at the edge portion of the logical sum pattern MP2_2+MP4_2 farthest downstream in the Y direction (the top in FIG. 17E), the code value "1" is allocated to the 1st, 2nd, 5th, 6th, 8th, 9th, 10th, 12th, 15th, 18th, 19th, 23rd, 25th, 29th, 30th, and 31st pixels from the upstream side in the X direction (left side in FIG. 17E).

Now, of the row at the edge portion of the logical sum pattern MP1_2+MP3_2 farthest downstream in the Y direction (the top in FIG. 17E), the 7th, 11th, 24th, and 32nd pixels allocated code value "1" from the upstream side in the X direction (left side in FIG. 17E) are adjacent in the X direction at both sides to pixels in the logical sum pattern MP2_2+MP4_2 to which the code value "1" has been allocated. That is to say, of the pixels allocated code value "1" in the row at the edge portion of the logical sum pattern MP1_2+MP3_2 farthest downstream in the Y direction (the top in FIG. 17E), the number of pixels adjacent in the X direction at both sides to pixels in the logical sum pattern MP2_2+MP4_2 in the row farthest downstream in the Y direction (the top in FIG. 17E) to which the code value "1" has been allocated, is four.

On the other hand, of the row at the edge portion of the logical sum pattern MP1_2+MP3_2 farthest downstream in the Y direction (the top in FIG. 17E), the 21st and 27th pixels allocated code value "1" from the upstream side in the X direction (left side in FIG. 17E) are not adjacent in the X direction to pixels in the logical sum pattern MP2_2+MP4_2 to which the code value "1" has been allocated. That is to say, of the pixels allocated code value "1" in the row at the edge portion of the logical sum pattern MP1_2+MP3_2 farthest downstream in the Y direction (the top in FIG. 17E), the number of pixels not adjacent in the X direction to pixels in the logical sum pattern MP2_2+MP4_2 in the row farthest downstream in the Y direction (the top in FIG. 17E) to which the code value "1" has been allocated, is two.

Performing the same calculation for each row within the logical sum pattern MP1_2+MP3_2 shows that, of the pixels to which the code value "1" has been allocated in the logical sum pattern MP1_2+MP3_2, the number of pixels adjacent at both sides in the X direction to a pixel in the logical sum pattern MP2_2+MP4_2 to which the code value "1" has been allocated is 119, and the number of pixels not adjacent in the X direction also is 119.

In the same way, the logical sum pattern MP2_2+MP4_2 according to the present embodiment has the code value "1" allocated to 511 of the 1024 pixels therein, and of these, 120 pixels to which the code "1" has been allocated are adjacent at both sides in the X direction to a pixel that has been allocated code value "1" in the logical sum pattern MP1_2+MP3_2. On the other hand, of the 511 pixels to which the code value "1" has been allocated in the logical sum pattern MP2_2+MP4_2, 120 pixels to which the code "1" has been allocated are not adjacent in the X direction to a pixel that has been allocated code value "1" in the logical sum pattern MP2_2+MP4_2. That is to say, in the present embodiment, of the pixels to which the code value "1" has been allocated in the logical sum pattern MP2_2+MP4_2, the number of pixels adjacent at both sides in the X direction to a pixel that has been allocated code value "1" in the logical sum pattern MP1_2+MP3_2, and the number of pixels not adjacent in the X direction, is the same number.

Figure 18A:
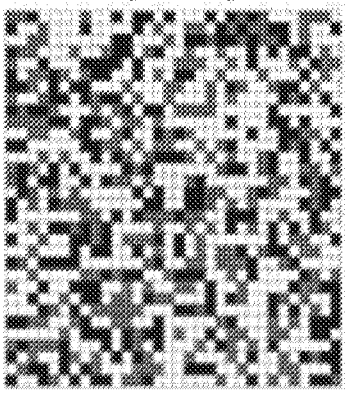
FIGS. 18A through 18F are diagrams illustrating mask patterns applied in an embodiment.
Figure 18B:
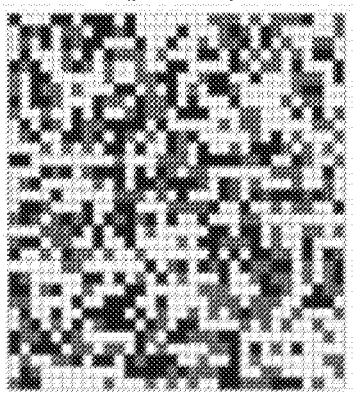
Figure 18C:
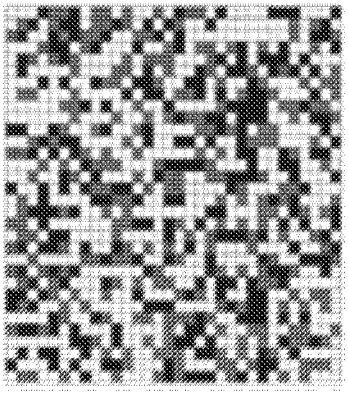
Figure 18D:
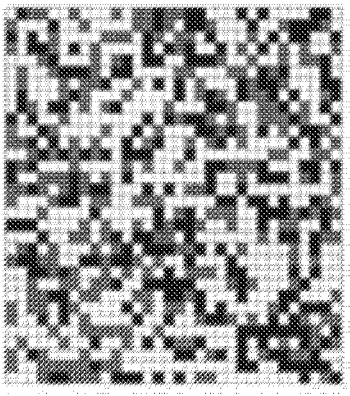
Figure 18E:
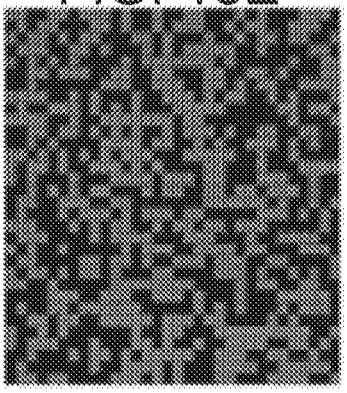
Figure 18F:
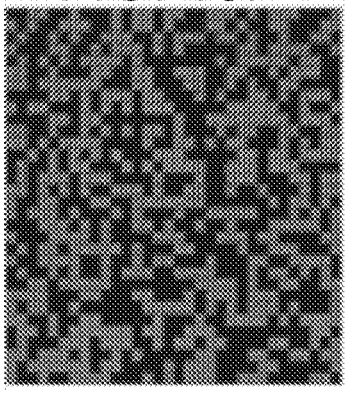
Figure 18F:
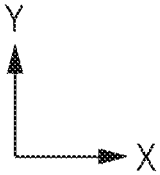

Next, mask patterns MP1_5 through MP4_5 corresponding to the 5 pl of cyan ink will be described. FIGS. 18A through 18F are diagrams illustrating mask patterns applied to the image data C4_5 for 5 pl of cyan ink in the present embodiment. Note that FIG. 18A illustrates a mask pattern MP1_5 for 5 pl of cyan ink corresponding to the first scan, FIG. 18B illustrates a mask pattern MP2_5 for 5 pl of cyan ink corresponding to the second scan, FIG. 18C illustrates a mask pattern MP3_5 for 5 pl of cyan ink corresponding to the third scan, and FIG. 18D illustrates a mask pattern MP4_5 for 5 pl of cyan ink corresponding to the fourth scan. Also, FIG. 18E illustrates a logical sum pattern MP1_5+MP3_5 obtained as the logical sum of the number of times of permitted discharge of ink stipulated in the mask pattern MP1_5 corresponding to the first scan in FIG. 18A and the mask pattern MP3_5 corresponding to the third scan in FIG. 18C. Further, FIG. 18F illustrates a logical sum pattern MP2_5+MP4_5 obtained as the logical sum of the number of times of permitted discharge of ink stipulated in the mask pattern MP2_5 corresponding to the second scan in FIG. 18B and the mask pattern MP4_5 corresponding to the fourth scan in FIG. 18D. In FIGS. 18A through 18F, the white pixels indicate pixels to which the code value "0" has been allocated, the gray pixels indicate pixels to which the code value "1" has been allocated, and the black pixels indicate pixels to which the code value "2" has been allocated. Further, the mask patterns MP1_5 through MP4_5 for 5 pl of cyan ink, illustrated in FIGS. 18A through 18D, are also allocated code values for each pixel, according to the same conditions as for the mask patterns MP1_2 through MP4_2 for 2 pl of cyan ink illustrated in FIGS. 17A through 17D described above.

Further, in the present embodiment, code values are allocated so that a pixel where code value "1" has been allocated to either one of mask patterns MP1_2 and MP3_2 for forward scanning for 2 pl of cyan ink and a pixel where code value "1" has been allocated to either one of mask patterns MP1_5 and MP3_5 for forward scanning for 5 pl of cyan ink have different arrays from each other. More specifically, a pixel where code value "1" has been allocated to either one of mask patterns MP1_2 and MP3_2 and a pixel where code value "1" has been allocated to either one of mask patterns MP1_5 and MP3_5 are arrayed so as to not be superimposed (i.e., be in an exclusive relationship). Accordingly, it can be seen by comparing the logical sum pattern MP1_2+MP3_2 illustrated in FIG. 17E with the logical sum pattern MP1_5+MP3_5 illustrated in FIG. 18E that gray pixels (code value is "1") are not superimposed between the logical sum patterns MP1_2+MP3_2 and MP1_5+MP3_5.

In the same way, code values are allocated so that a pixel where code value "1" has been allocated to either one of mask patterns MP2_2 and MP4_2 for backward scanning for 2 pl of cyan ink and a pixel where code value "1" has been allocated to either one of mask patterns MP2_5 and MP4_5 for backward scanning for 5 pl of cyan ink have different arrays from each other. More specifically, a pixel where code value "1" has been allocated to either one of mask patterns MP2_2 and MP4_2 and a pixel where code value "1" has been allocated to either one of mask patterns MP2_5 and MP4_5 are arrayed so as to not be superimposed (i.e., be in an exclusive relationship). Accordingly, it can be seen by comparing the logical sum pattern MP2_2+MP4_2 illustrated in FIG. 17F with the logical sum pattern MP2_5+MP4_5 illustrated in FIG. 18F that gray pixels (code value is "1") are not superimposed between the logical sum patterns MP2_2+MP4_2 and MP2_5+MP4_5.

In a case where relatively low-concentration image data where the pixel value is "1" is input by the above settings, recording data can be generated so that cyan ink corresponding to the 2 pl dot size and cyan ink corresponding to the 5 pl dot size are not discharged in the same pixel region in the same scanning direction. In other words, in a case where relatively low-concentration image data is input, cyan ink corresponding to the 2 pl dot size and cyan ink corresponding to the 5 pl dot size are discharged to the same pixel region in scans in different directions.

Note that while description has been made where mask patterns have been described here where the mask pattern MP1_5 illustrated in FIG. 18A is situated at the same position as the mask pattern MP2_2 illustrated in FIG. 17B, the mask pattern MP2_5 illustrated in FIG. 18B at the same position as the mask pattern MP1_2 illustrated in FIG. 17A, the mask pattern MP3_5 illustrated in FIG. 18C at the same position as the mask pattern MP4_2 illustrated in FIG. 17D, and the mask pattern MP4_5 illustrated in FIG. 18D at the same position as the mask pattern MP3_2 illustrated in FIG. 17C, this is not restrictive. As long as the above-described conditions are satisfied, the mask patterns do not have to be like those illustrated in FIGS. 17A through 17D and 18A through 18D. Thus, the mask patterns MP1_2 through MP4_2 for 2 pl of cyan ink and mask patterns MP1_5 through MP4_5 for 5 pl of cyan ink that are used in the present embodiment are set, based on the conditions such as described above.

Driving Order of Driving Blocks in Present Embodiment

FIG. 19A is a diagram illustrating a driving order in time-division driving control executed in the present embodiment. FIG. 19B is a schematic diagram illustrating the way in which dots are formed in a case of driving recording element No. 1 through No. 16 while scanning in the forward direction following the driving order shown in FIG. 19A. FIG. 19C is a schematic diagram illustrating the way in which dots are formed in a case of driving recording element No. 1 through No. 16 while scanning in the backward direction following the driving order shown in FIG. 19A.

Time-division driving is performed in the present embodiment for both forward scanning and backward scanning in the driving order of driving block No. 1, driving block No. 9, driving block No. 6, driving block No. 14, driving block No. 3, driving block No. 11, driving block No. 8, driving block No. 16, driving block No. 5, driving block No. 13, driving block No. 2, driving block No. 10, driving block No. 7, driving block No. 15, driving block No. 4, and driving block No. 12, as illustrated in FIG. 19A.

As described above, time-division driving is performed such that the landing positions of ink from the driving blocks differ between forward scanning and backward scanning in the present embodiment. More specifically, the driving order of driving blocks in forward scanning and the driving order of driving blocks in backward scanning are the same order to perform reciprocal scanning in the present embodiment. Note that this is not necessarily restricted to the driving order of driving blocks being the same in reciprocal scanning; it is sufficient for the driving order of driving blocks in the backward scan to be opposite to the driving order of driving blocks in the forward scan in order to differ the discharge position of ink when performing reciprocal scanning such as described above.

In a case of performing time-division driving of the recording elements No. 1 through No. 16 following the driving order illustrated in FIG. 19A, in forward scanning, the dot formed from recording element No. 1 driven first is situated farthest upstream in the X direction as illustrated in FIG. 19B, the dots formed in the order of recording element Nos. 9, 6, 14, 3, 11, 8, 16, 5, 13, 2, 10, 7, 15, and 4, are situated deviated from the upstream side in the X direction toward the downstream side, and the dot formed by the recording element No. 12 driven last is situated farthest downstream in the X direction.

On the other hand, in the backward scan, the dot formed from recording element No. 1 driven first is situated farthest downstream in the X direction as illustrated in FIG. 19C, the dots formed in the order of recording element Nos. 9, 6, 14, 3, 11, 8, 16, 5, 13, 2, 10, 7, 15, and 4, are situated deviated from the downstream side in the X direction toward the upstream side, and the dot formed by the recording element No. 12 driven last is situated farthest upstream in the X direction.

Thus, by driving the recording elements belonging to the driving blocks according to the driving order illustrated in FIG. 19A, the landing positions of ink in the same rows extending in the Y direction can be made to differ.

Note that in the present embodiment, the driving order is not changed between the recording element row for 2 pl of cyan ink and the recording element row for 5 pl of cyan ink. Accordingly, both the recording element row for 2 pl of cyan ink and the recording element row for 5 pl of cyan ink perform time-division driving in the driving order illustrated in FIG. 19A for both the forward scans and backward scans.

Recorded Image According to Present Embodiment

As described above, time-division driving is performed in the present embodiment following the driving order illustrated in FIG. 19A for both forward scanning and backward scanning, using the mask patterns MP1_2 through MP4_2 for 2 pl of cyan ink illustrated in FIGS. 17A through 17D and mask patterns MP1_5 through MP4_5 for 5 pl of cyan ink illustrated in FIGS. 18A through 18D. Accordingly, recording is performed with suppressed discharge position deviation between reciprocal scans, when performing high-concentration image recording. Further, recording can be performed where image quality defects do not readily occur even when using ink with multiple dot sizes.

First, description will be made regarding positions of dots formed by cyan ink corresponding to the 2 pl dot size, in a case where gradation data of which the gradation level is level 4 at all pixels has been input as gradation data C3. FIGS. 20A through 20E are diagrams illustrating images formed by cyan ink corresponding to 2 pl dot size in a case where gradation data wherein the gradation level is "4" has been input.

In a case where the gradation value of the gradation data is level 4 for all pixels in the unit region 211 in FIG. 8, image data for 2 pl of cyan ink is generated with pixel value of "2" for all pixels, which can be seen from the discharge orifice row rasterization table in FIG. 6. Accordingly, cyan ink corresponding to the 2 pl dot size is discharged to pixel regions corresponding to pixels where either of code values "1" and "2" have been allocated within the mask patterns MP1_2 through MP4_2 illustrated in FIGS. 17A through 17D. That is to say, cyan ink corresponding to the 2 pl dot size is discharged in pixel regions corresponding to gray pixels and black pixels in FIG. 17A in the first scan, FIG. 17B in the second scan, FIG. 17C in the third scan, and FIG. 17D in the fourth scan.

Of these, the first and third scans are forward scans, and the second and fourth scans are backward scans, so the pixels to which cyan ink corresponding to the 2 pl dot size is discharged in the forward scans are the gray pixels and black pixels in FIG. 17E, and the pixels to which cyan ink corresponding to the 2 pl dot size is discharged in the backward scans are the gray pixels and black pixels in FIG. 17F. That is to say, cyan ink corresponding to the 2 pl dot size is discharged to all pixels, in the forward scan and in the backward scan.

Figure 20A:
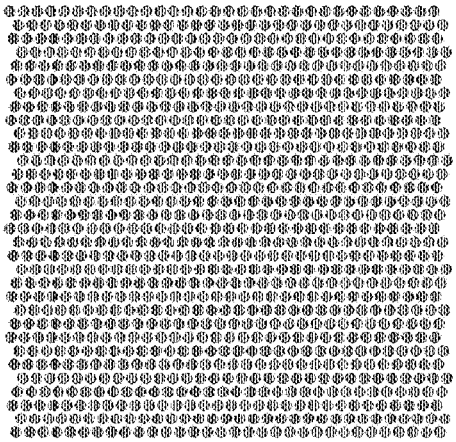
FIGS. 20A through 20E are schematic diagrams illustrating images to be recorded in an embodiment.
Figure 20B:
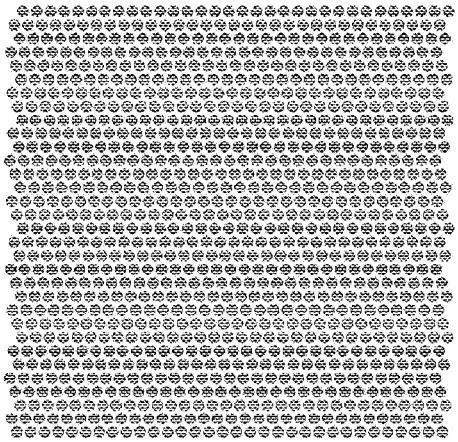
Figure 20C:
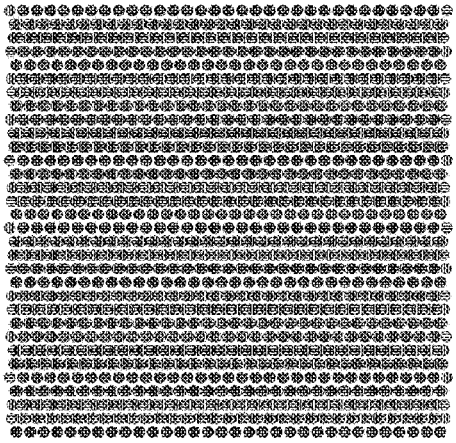
Figure 20D:
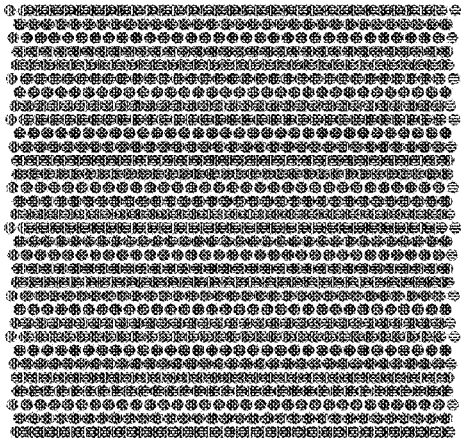

By performing time-division driving in the driving order illustrated in FIG. 19A for both forward scanning and backward scanning, cyan ink corresponding to the 2 pl dot size will be discharged and dots formed at the positions illustrated in FIG. 20A for the forward scans and in FIG. 20B for the backward scans, if there is no deviation between reciprocal scans. FIG. 20C illustrates a dot array where the dot arrays in FIGS. 20A and 20B have been overlaid with no positional deviation. FIG. 20D illustrates a case where the dot arrays have been overlaid with positional deviation of 21.2 μm (equivalent to 1200 dpi) toward the downstream side in the X direction in the backward scan, and FIG. 20E illustrates a case where the dot arrays have been overlaid with positional deviation of 42.3 μm (equivalent to 600 dpi) toward the downstream side in the X direction in the backward scan.

It can be seen in FIG. 20C that, with regard to the rows extending in the X direction, there are rows where dots from the forward scans and dots from the backward scans are recorded almost completely overlapped, rows partly overlapped, and rows recorded without hardly any overlapping, these various states being intermingled. In FIG. 20D, dots in rows overlapped to begin with newly emerge, while dots in rows that were deviated without overlapping to begin with newly overlap, thereby canceling out variation in concentration. This is also true in FIG. 20E, in that dots in rows overlapped to begin with newly emerge, while dots in rows that were deviated without overlapping to begin with newly overlap, thereby canceling out variation in concentration.

Figure 20E:
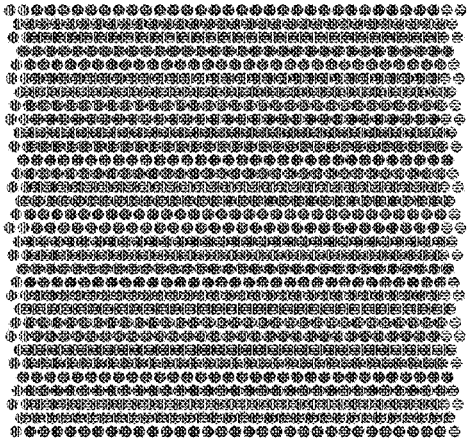
Figure 20E:
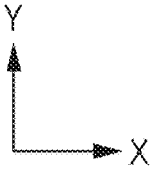

Thus, when viewed as an overall image, there is hardly any variation in concentration occurring in comparison with the case in FIG. 20C where there is no deviation between reciprocal scans, regardless of whether the amount deviation between reciprocal scans is 21.2 μm upstream in the X direction, illustrated in FIG. 20D, or the amount deviation between reciprocal scans is 42.3 μm upstream in the X direction, illustrated in FIG. 20E. Accordingly, it can be seen from FIGS. 20A through 20E that recording can be performed with suppressed discharge position deviation between reciprocal scans even when recording relatively high-concentration images, where two dots are recorded per pixel region, according to the mask patterns and driving order according to the present embodiment.

Figure 21A:
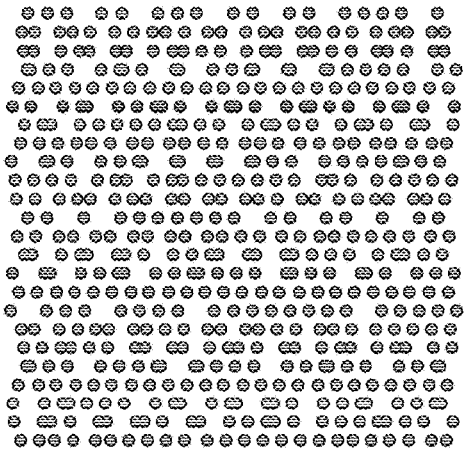
FIGS. 21A through 21C are schematic diagrams illustrating images to be recorded in an embodiment.
Figure 21B:
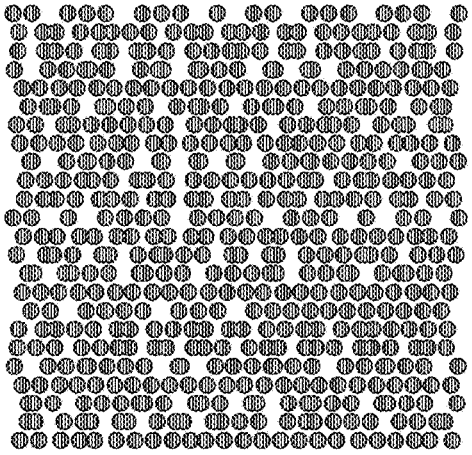
Figure 21C:
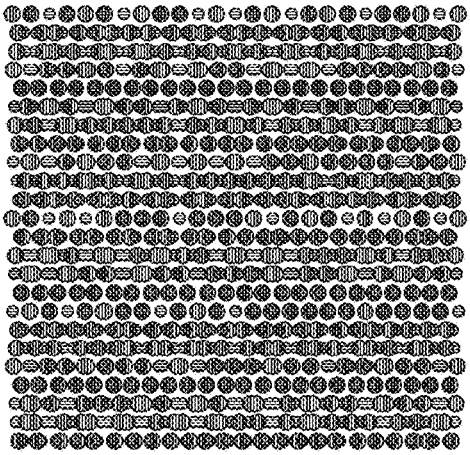
Figure 21C:
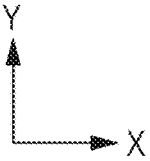

Description will be made next regarding dot positions formed in a case of using a mask pattern applied to image data for 2 pl of cyan ink and mask pattern applied to image data for 5 pl of cyan ink, made to differ as described above. FIGS. 21A through 21C are diagrams illustrating dot arrays formed by generating recording data using each of the mask patterns illustrated in FIGS. 17A through 17D for the image data for 2 pl of cyan ink and the mask patterns illustrated in FIGS. 18A through 18D for the image data for 5 pl of cyan ink, and scanning both the recording element row for 2 pl of cyan ink and the recording element row for 5 pl of cyan ink by time-division driving in the driving order illustrated in FIG. 19A for both forward scanning and backward scanning. Note that FIG. 21A illustrates the array of cyan ink dots corresponding to the 2 pl dot size, and FIG. 21B illustrates the array of cyan ink dots corresponding to the 5 pl dot size. Further, FIG. 21C illustrates the dots of cyan ink corresponding to the 2 pl dot size and cyan ink corresponding to the 5 pl dot size, illustrated in FIGS. 21A and 21B respectively, that have been superimposed. The circles in FIGS. 21A through 21C with horizontal lines inside represent cyan ink dots corresponding to the 2 pl dot size, and the circles with vertical lines inside represent cyan ink dots corresponding to the 5 pl dot size.

FIG. 21A schematically illustrates the positions of dots formed by cyan ink corresponding to the 2 pl dot size, in a case where gradation data of which the gradation level is level 2 at all pixels has been input as the gradation data C3. FIG. 21B schematically illustrates the positions of dots formed by cyan ink corresponding to the 5 pl dot size, in a case where gradation data of which the gradation level is level 2 at all pixels has been input as the gradation data C3. It can be seen from the discharge orifice row rasterization table in FIG. 6 that in a case where the gradation level of the gradation data is level 2, both pixel values of the image data for 2 pl of cyan ink and image data for 5 pl of cyan ink is "1". Accordingly, both cyan ink corresponding to the 2 pl dot size and cyan ink corresponding to the 5 pl dot size are applied to each pixel region, one time each.

In a case where image data of relatively low concentration is input in the present embodiment, mask patterns are set so that cyan ink corresponding to the 2 pl dot size and cyan ink corresponding to the 5 pl dot size are applied to the same pixel region in scans in different directions, as described with reference to FIGS. 17A through 18F. On the other hand, time-division driving is performed for the recording element row for 2 pl of cyan ink and the recording element row for 5 pl of cyan ink by time-division driving in the same driving order illustrated in FIG. 19A, so the driving order of recording elements for the cyan ink corresponding to the 2 pl dot size and cyan ink corresponding to the 5 pl dot size, discharged to the same pixel region, is the same.

In light of the above points, in a case where recording data is generated to apply cyan ink corresponding to the 2 pl dot size to a certain pixel region in the forward scans (first and third scans), recording data is generated to apply cyan ink corresponding to the 5 pl dot size to that pixel region in the backward scans (second and fourth scans). The driving order of recording elements discharging each of the cyan ink corresponding to the 2 pl dot size and the cyan ink corresponding to the 5 pl dot size to the pixel region is the same. Accordingly, even though discharging of the cyan ink corresponding to the 2 pl dot size and the cyan ink corresponding to the 5 pl dot size to the same pixel region is stipulated by the recording data, the cyan ink corresponding to the 2 pl dot size and the cyan ink corresponding to the 5 pl dot size are discharged to the same pixel region by scans in different direction at the same driving order, so the landing position of the dots will differ in the X direction.

Accordingly, the cyan ink corresponding to the 2 pl dot size and the cyan ink corresponding to the 5 pl dot size are applied to the pixel regions in the unit region at mutually different positions in the present embodiment, which can be seen by comparing FIGS. 21A and 21B. As a result, the surface of the recording medium can be sufficiently covered by the cyan ink corresponding to the 2 pl dot size and the cyan ink corresponding to the 5 pl dot size, as illustrated in FIG. 21C. The array of the cyan ink corresponding to the 2 pl dot size and the cyan ink corresponding to the 5 pl dot size can thus be avoided from being superimposed in the present embodiment, and accordingly graininess can be suppressed.

As described above, discharge position deviation between reciprocal scans of different dot sizes can be suitably suppressed by the present embodiment. Further, the mask patterns corresponding to the cyan ink for the 2 pl dot size and the cyan ink for the 5 pl dot size are made to differ, so graininess due to dot arrays being superimposed between the cyan ink corresponding to the 2 pl dot size and the cyan ink corresponding to the 5 pl dot size can be suppressed.

Comparative Example

A form used for comparison with the present embodiment will be described in detail. In the comparative example, the mask patterns MP1_2 through MP4_2 illustrated in FIGS. 17A through 17D, applied to the image data for cyan ink in the first embodiment, are applied to both image data of the image data for 2 pl of cyan ink and image data for 5 pl of cyan ink, and recording data is generated. The driving order in time-division driving is the driving order illustrated in FIG. 19A for both the recording element row for 2 pl of cyan ink and the recording element row for 5 pl of cyan ink, the same as in the first embodiment.

Figure 22A:
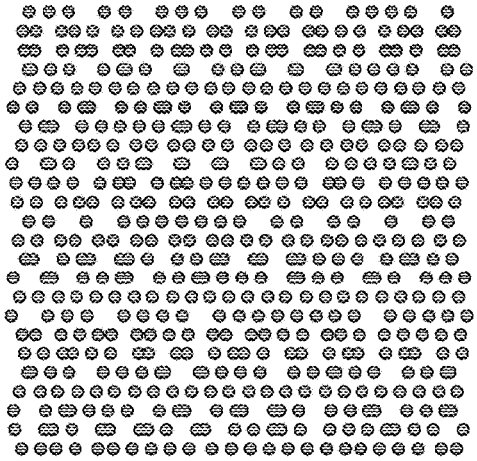
FIGS. 22A through 22C are schematic diagrams illustrating images to be recorded in a comparative example.
Figure 22B:
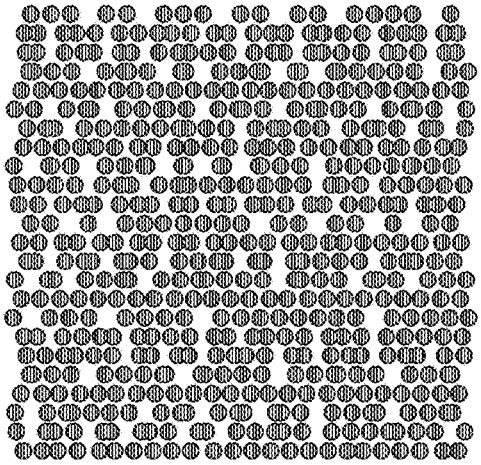
Figure 22C:
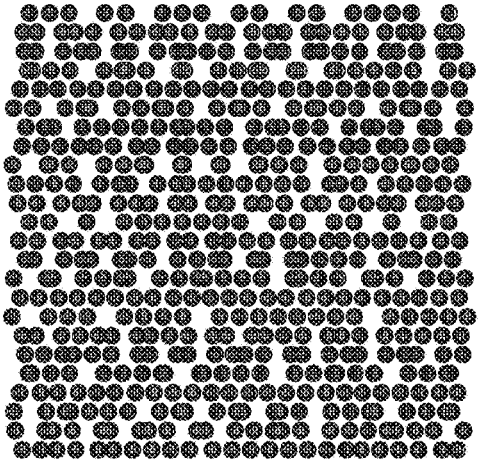
Figure 22C:
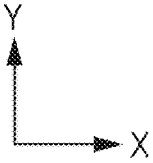

FIGS. 22A through 22C are diagrams illustrating dot arrays formed by generating recording data using each of the mask patterns illustrated in FIGS. 17A through 17D for the image data for 2 pl of cyan ink and the image data for 5 pl of cyan ink, and scanning both the recording element row for 2 pl of cyan ink and the recording element row for 5 pl of cyan ink by time-division driving in the driving order illustrated in FIG. 19A for both forward scanning and backward scanning. Note that FIG. 22A illustrates the array of cyan ink dots corresponding to the 2 pl dot size, and FIG. 22B illustrates the array of cyan ink dots corresponding to the 5 pl dot size. Further, FIG. 22C illustrates the dots of cyan ink corresponding to the 2 pl dot size and cyan ink corresponding to the 5 pl dot size, illustrated in FIGS. 22A and 22B respectively, that have been superimposed. The circles in FIGS. 22A through 22C with horizontal lines inside represent cyan ink dots corresponding to the 2 pl dot size, and the circles with vertical lines inside represent cyan ink dots corresponding to the 5 pl dot size.

FIG. 22A schematically illustrates the positions of dots formed by cyan ink corresponding to the 2 pl dot size, in a case where gradation data of which the gradation level is level 2 at all pixels has been input as the gradation data C3. FIG. 22B schematically illustrates the positions of dots formed by cyan ink corresponding to the 5 pl dot size, in a case where gradation data of which the gradation level is level 2 at all pixels has been input as the gradation data C3. It can be seen from the discharge orifice row rasterization table in FIG. 6 that in a case where the gradation level of the gradation data is level 2, both pixel values of the image data for 2 pl of cyan ink and image data for 5 pl of cyan ink is "1". Accordingly, both cyan ink corresponding to the 2 pl dot size and cyan ink corresponding to the 5 pl dot size are applied to each pixel region, one time each.

As described above, the mask patterns illustrated in FIGS. 17A through 17D are applied for both the image data for 2 pl of cyan ink and the image data for 5 pl of cyan ink in the comparative example. Accordingly, in a case where image data of relatively low concentration is input, cyan ink corresponding to the 2 pl dot size and cyan ink corresponding to the 5 pl dot size are applied to the same pixel region in scans in the same direction. On the other hand, scanning is performed for the recording element row for 2 pl of cyan ink and the recording element row for 5 pl of cyan ink by time-division driving in the driving order illustrated in FIG. 19A, so the driving order of recording elements for the cyan ink for the 2 pl dot size and cyan ink for the 5 pl dot size, discharged to the same pixel region, is the same.

In light of the above points, in a case where recording data is generated to apply cyan ink corresponding to the 2 pl dot size to a certain pixel region in the forward scans (first and third scans), recording data is generated to apply cyan ink corresponding to the 5 pl dot size to that pixel region in the forward scans (first and third scans). The driving order of recording elements discharging each of the cyan ink corresponding to the 2 pl dot size and the cyan ink corresponding to the 5 pl dot size to the pixel region is the same. Accordingly, the cyan ink corresponding to the 2 pl dot size and the cyan ink corresponding to the 5 pl dot size are discharged to the same pixel region in the same direction and in the same driving order, so the landing position of the dots will be the same in the X direction.

Accordingly, the cyan ink corresponding to the 2 pl dot size and the cyan ink corresponding to the 5 pl dot size are applied to the pixel regions in the unit region at the same positions in this comparative example, which can be seen from FIGS. 22A and 22B. As a result, the surface of the recording medium shows many gaps between dots of the cyan ink corresponding to the 2 pl dot size and dots of the cyan ink corresponding to the 5 pl dot size, as illustrated in FIG. 22C, and the dots tend to be scattered.

It can be clearly seen by comparing the dot array of the cyan ink for the 2 pl dot size and the cyan ink for the 5 pl dot size recorded by the first embodiment illustrated in FIG. 21C with the dot array of the cyan ink for the 2 pl dot size and the cyan ink for the 5 pl dot size recorded by the comparative example illustrated in FIG. 22C, that graininess in the image can be suppressed by applying the first embodiment.

Modification of First Embodiment

Although an arrangement has been described in the first embodiment where the driving order illustrated in FIG. 19A is performed for both forward scanning and backward scanning of the recording element row discharging 2 pl of cyan ink and the recording element row discharging 5 pl of cyan ink, i.e., where time-division driving is performed in the same driving order, other arrangements may be made. It is sufficient that the driving order of the recording element rows in the first embodiment be such that the driving order of driving blocks in the backward scan be the opposite order from the driving order of driving blocks in the forward scan, when scanning reciprocally.

The driving order in the first embodiment preferably is such that the driving order of driving blocks in the backward scan is the opposite order from an offset order of the driving order of the driving blocks in the forward scan when scanning reciprocally. This point will be described below in detail. In a case where the driving order for forward scanning is the order illustrated in FIG. 23A, and the driving order for backward scanning is the order illustrated in FIG. 23B, the driving order in FIG. 23B is the opposite order from an offset order of the driving order in FIG. 23A.

The driving order illustrated in FIG. 23A is the driving order of driving block No. 1, driving block No. 2, driving block No. 3, driving block No. 4, driving block No. 5, driving block No. 6, driving block No. 7, driving block No. 8, driving block No. 9, driving block No. 10, driving block No. 11, driving block No. 12, driving block No. 13, driving block No. 14, driving block No. 15, and driving block No. 16.

An example of an offset order of the driving order illustrated in FIG. 23A is the driving order of driving block No. 2, driving block No. 3, driving block No. 4, driving block No. 5, driving block No. 6, driving block No. 7, driving block No. 8, driving block No. 9, driving block No. 10, driving block No. 11, driving block No. 12, driving block No. 13, driving block No. 14, driving block No. 15, driving block No. 16, and driving block No. 1. In this order, the driving block No. 2 through driving block No. 16 have been shifted up one each, and the driving block No. 1 brought to the last. In other words, this order is an order where the driving order in FIG. 23A has been offset forward by one.

Another example of an offset order of the driving order illustrated in FIG. 23A is the driving order of driving block No. 3, driving block No. 4, driving block No. 5, driving block No. 6, driving block No. 7, driving block No. 8, driving block No. 9, driving block No. 10, driving block No. 11, driving block No. 12, driving block No. 13, driving block No. 14, driving block No. 15, driving block No. 16, driving block No. 1, and driving block No. 2. In this order, the driving block No. 3 through driving block No. 16 have been shifted up two each, and the driving block No. 1 and driving block No. 2 have been brought to the last, with their order maintained. In other words, this order is an order where the driving order in FIG. 23A has been offset forward by two.

Along the same line of thought, the driving order of driving block No. 9, driving block No. 10, driving block No. 11, driving block No. 12, driving block No. 13, driving block No. 14, driving block No. 15, driving block No. 16, driving block No. 1, driving block No. 2, driving block No. 3, driving block No. 4, driving block No. 5, driving block No. 6, driving block No. 7, and driving block No. 8, also is an offset order of the driving order illustrated in FIG. 23A, offset by eight. Note that the driving order illustrated in FIG. 23B is the opposite order of this order. Thus, it can be seen that the driving order illustrated in FIG. 23B is the opposite order of an offset order of the driving order illustrated in FIG. 23A.

FIG. 23C is a schematic diagram illustrating the way in which dots are formed in a case of driving recording element No. 1 through No. 16 while scanning in the forward direction following the driving order shown in FIG. 23A. FIG. 23D is a schematic diagram illustrating the way in which dots are formed in a case of driving recording element No. 1 through No. 16 while scanning in the backward direction following the driving order shown in FIG. 23B. In such an arrangement where the driving order for backward scanning is the opposite order of an offset order of the driving order for forward scanning, the ink landing positions from the driving blocks differ in the forward scan and backward scan, but are discharged in a parallel positional relationship.

Figure 24A:
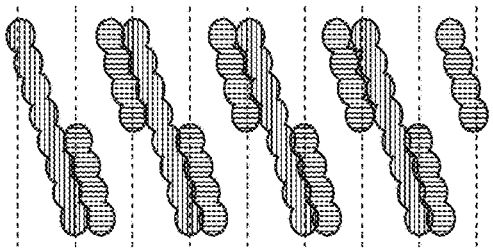
FIGS. 24A through 24D are diagrams for describing the degree of ink discharge position deviation among scans.
Figure 24B:
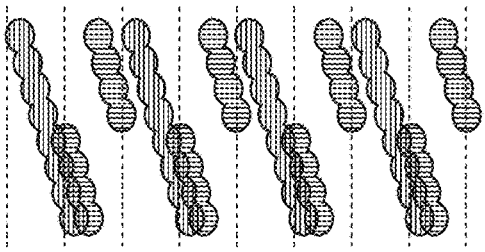
Figure 24C:
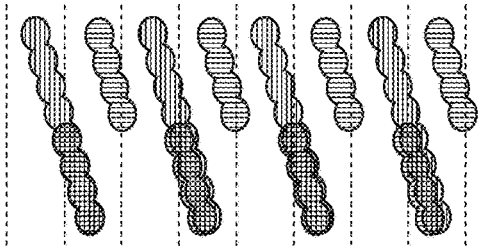
Figure 24D:
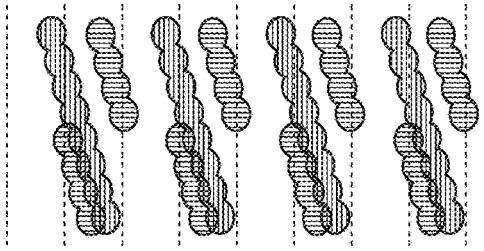
Figure 24D:
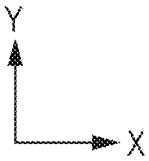

FIGS. 24A through 24D are diagrams schematically illustrating images recorded when setting using the recording data illustrated in FIGS. 12A1 and 12A2 for recording data in both forward scanning and backward scanning, at the driving order illustrated in FIG. 23A for forward scanning and the driving order illustrated in FIG. 23B for backward scanning. FIG. 24A schematically illustrate an image recorded in a case where there is no deviation between the forward scan and the backward scan, FIG. 24B illustrates an image recorded in a case where there is deviation of approximately 1/4 dot in the X direction between the forward scan and the backward scan, FIG. 24C illustrates an image recorded in a case where there is deviation of approximately 2/4 dot in the X direction between the forward scan and the backward scan, and FIG. 24D illustrates an image recorded in a case where there is deviation of approximately 3/4 dot in the X direction between the forward scan and the backward scan. In all of the illustrations, the circles with vertical lines inside represent dots formed in the forward scan, and the circles with horizontal lines inside represent dots formed in the backward scan.

Comparing FIGS. 24A through 24D with FIGS. 14A through 14D and FIGS. 16A through 16D, the images in FIGS. 24A through 24D have been improved over the images in FIGS. 14A through 14D in that the overlapping and missing dots are not as conspicuous, although the improvement is not as marked as in FIGS. 16A through 16D. As described above, FIGS. 14A through 14D are images where the driving order of the backward scan is the opposite order to the driving order in the forward scan, while FIGS. 16A through 16D are images where the driving order of the backward scan is the same order as the driving order of the forward scan. Accordingly, discharge position deviation between reciprocal scans can be suppressed more in a case where the driving order of the backward scan is the opposite order as to the driving order of the forward scan when the order is offset, as compared to a case where the driving order of the backward scan is the opposite order from the driving order of the forward scan. On the other hand, it can be seen from FIGS. 16A through 16D that a case where the driving order of the backward scan is the same order as the driving order of the forward scan is more preferable.

In light of the above points, the driving order at the time of backward scanning first needs to be different from the opposite order to the driving order at the time of forward scanning at each recording element row in the present embodiment. In doing so, the driving order at the time of backward scanning preferably is different from the opposite order to an offset order of the driving order at the time of forward scanning. More preferably, the order is the same as the driving order at the time of forward scanning.

Description has been made above in the first embodiment regarding an arrangement where pixels to which code value "1" has been allocated in either one of mask patterns MP1_2 and MP3_2 corresponding to forward scanning for the 2 pl dot size of cyan ink, and pixels to which code value "2" has been allocated in either one of mask patterns MP2_2 and MP4_2 corresponding to backward scanning for the 2 pl dot size of cyan ink, have the same array, in order to suppress discharge position deviation of ink between reciprocal scans when recording high-concentration images. However, these pixels do not have to have completely the same array. That is to say, an arrangement may be made where there are some places where pixels to which code value "1" has been allocated in either one of mask patterns MP1_2 and MP3_2 corresponding to forward scanning for the 2 pl dot size of cyan ink, and pixels to which code value "2" has been allocated in either one of mask patterns MP2_2 and MP4_2 corresponding to backward scanning for the 2 pl dot size of cyan ink, do not have the same array, as long as the number is not great. In other words, the advantages of the present embodiment can be obtained as long as pixels to which code value "1" has been allocated in either one of mask patterns MP1_2 and MP3_2 corresponding to forward scanning for the 2 pl dot size of cyan ink, and pixels to which code value "2" has been allocated in either one of mask patterns MP2_2 and MP4_2 corresponding to backward scanning for the 2 pl dot size of cyan ink, have approximately the same array. Note that in the following description, in a case where a certain pixel and another pixel have the same placement, and in a case where a certain pixel and another pixel have approximately the same placement, these pixels will be referred to as having a mutually corresponding placement.

Now, approximately 75% or more of the pixels to which code value "1" has been allocated in either one of mask patterns MP1_2 and MP3_2 corresponding to forward scanning for the 2 pl dot size of cyan ink preferably have the same array as pixels to which code value "2" has been allocated in either one of mask patterns MP2_2 and MP4_2 corresponding to backward scanning for the 2 pl dot size of cyan ink. In the same way, it is sufficient that pixels to which code value "2" has been allocated in either one of mask patterns MP1_2 and MP3_2 corresponding to forward scanning for the 2 pl dot size of cyan ink, and pixels to which code value "1" has been allocated in either one of mask patterns MP2_2 and MP4_2 corresponding to backward scanning for the 2 pl dot size of cyan ink, have approximately the same array.

This also holds true for the mask patterns corresponding to 5 pl of cyan ink. It is sufficient that pixels to which code value "1" has been allocated in either one of mask patterns MP1_5 and MP3_5 corresponding to forward scanning for the 5 pl dot size of cyan ink, and pixels to which code value "2" has been allocated in either one of mask patterns MP2_5 and MP4_5 corresponding to backward scanning for the 5 pl dot size of cyan ink, have approximately the same array. Further, it is sufficient that pixels to which code value "2" has been allocated in either one of mask patterns MP1_5 and MP3_5 corresponding to forward scanning for the 5 pl dot size of cyan ink, and pixels to which code value "1" has been allocated in either one of mask patterns MP2_5 and MP4_5 corresponding to backward scanning for the 5 pl dot size of cyan ink, have approximately the same array.

Description has been made above in the first embodiment regarding an arrangement where pixels to which code value "1" has been allocated in either one of mask patterns corresponding to forward scanning for the 2 pl dot size of cyan ink, and pixels to which code value "1" has been allocated in either one of mask patterns corresponding to backward scanning for the 5 pl dot size of cyan ink, have an array where they are not superimposed (i.e., in an exclusive relationship), but other arrangements may be made as well. That is to say, it is sufficient that not all of pixels to which code value "1" has been allocated in either one of mask patterns corresponding to forward scanning for the 2 pl dot size of cyan ink, and pixels to which code value "1" has been allocated in either one of mask patterns corresponding to forward scanning for the 2 pl dot size of cyan ink, are of the same array, and it is permissible that some of the pixels are of the same array.

Still, the smaller the number of pixels to which code value "1" has been allocated in either one of mask patterns corresponding to forward scanning for the 2 pl dot size of cyan ink, and pixels to which code value "1" has been allocated in either one of mask patterns corresponding to backward scanning for the 5 pl dot size of cyan ink, having the same array are, the more suitably the surface of the recording medium can be covered. More specifically, approximately half of the pixels to which code value "1" has been allocated in either one of mask patterns corresponding to forward scanning for the 2 pl dot size of cyan ink, have a different array from pixels to which code value "1" has been allocated in either one of mask patterns corresponding to forward scanning for the 5 pl dot size of cyan ink. The reason is that the surface of the recording medium can be sufficiently covered as long as there is no superimposing of approximately half of the pixels to which code value "1" has been allocated in either one of mask patterns corresponding to forward scanning for the 2 pl dot size of cyan ink, and pixels to which code value "1" has been allocated in either one of mask patterns corresponding to backward scanning for the 5 pl dot size of cyan ink. This also holds true for the relationship between pixels to which code value "1" has been allocated in either one of mask patterns corresponding to forward scanning for the 2 pl dot size of cyan ink, and pixels to which code value "1" has been allocated in either one of mask patterns corresponding to backward scanning for the 5 pl dot size of cyan ink.

Second Embodiment

Description has been made in the first embodiment regarding an arrangement of using mask patterns where the pixels in the mask patterns have code values allocated such that the pixels allocated code value "1" in the logical sum pattern for forward scanning and the logical sum pattern for backward scanning have an array with random white noise properties, for each of the mask patterns for cyan ink corresponding to the 2 pl dot size and for cyan ink corresponding to the 5 pl dot size. Accordingly, the mask patterns for each of the 2 pl dot size and the 5 pl dot size used in the first embodiment were set such that, of the pixels to which code value "1" has been allocated in the logical sum pattern for backward scanning, the number of pixels that are adjacent at both sides in the X direction to pixels to which code value "1" has been allocated in the logical sum pattern for forward scanning, and the number of pixels that are not adjacent in the X direction to pixels to which code value "1" has been allocated in the logical sum pattern for backward scanning, are approximately the same.

Conversely, mask patterns used for each of the cyan ink of the 2 pl dot size and the cyan ink of the 5 pl dot size in the present embodiment have had code values set for each of the pixels such that, of pixels to which the code value "1" has been allocated in a logical sum pattern for backward scanning, the number of pixels that are adjacent at both sides in the X direction to pixels to which code value "1" has been allocated in the logical sum pattern for forward scanning is greater than the number of pixels that are not adjacent at both sides in the X direction to pixels to which code value "1" has been allocated in the logical sum pattern for forward scanning.

Portions which are the same as in the above-described first embodiment will be omitted from description. Deterioration in image quality due to deviation in the X direction between reciprocal scans has been suppressed in the first embodiment, by an arrangement where the driving order in backward scanning is a different order from the driving order in forward scanning, as described with reference to FIGS. 12A1 through 16D. However, it can be seen by comparing FIGS. 15A through 15D with FIGS. 16A through 16D that when recording a relatively low-concentration image, such as where only one dot is formed per pixel, the degree of deterioration of image quality occurring due to deviation in the X direction between reciprocal scans changes not only in accordance with the driving order alone, but also in accordance with the recording data as well.

Figure 16D:
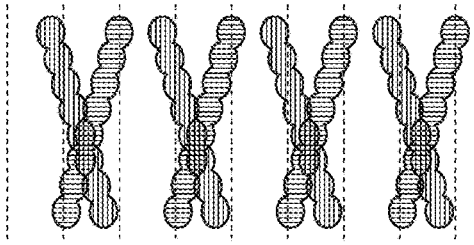
Figure 16D:
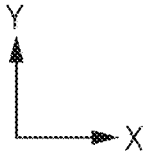

In a case of generating recording data so that dots recorded in forward scanning and dots recording in backward scanning do not alternate in the X direction, as illustrated in FIGS. 15A through 15D, Deterioration in image quality can be suppressed well in a case where deviation in the X direction between reciprocal scans is small. However, in a case where deviation in the X direction between reciprocal scans is large, there may be more missing and overlapping dots even if the driving order is an order that is not opposite to each other, which can be seen in FIG. 15D. In comparison with this, generating recording data so that the dots recorded in forward scanning and dots recording in backward scanning alternate in the X direction enables missing and overlapping dots to be reduced even in a case where the deviation in the X direction between reciprocal scans is large, as illustrated in FIG. 16D.

In light of the above points, recording data is generated in the present embodiment so that dots recorded in forward scanning and dots recording in backward scanning alternate in the X direction when recording low-concentration images, in order to suppress image quality deterioration due to deviation in the X direction between reciprocal scans when recording low-concentration images. For low-concentration image data here, e.g., image data where the pixel value is "1", dots are formed only at pixels where the code value "1" is set in the mask pattern, as illustrated in the decoding table in FIG. 10. The reason is that this is the code value where the number of ink charge permitted is the greatest out of the code values "0", "1", and "2". Accordingly, in order to cause dots to alternate in recording between forward scans and backward scans when recording low-concentration images mask patterns can be used where pixels to which the code value "1" have been set alternate in the X direction in the logical sum pattern for forward scanning and the logical sum pattern for backward scanning.

Figure 25A:
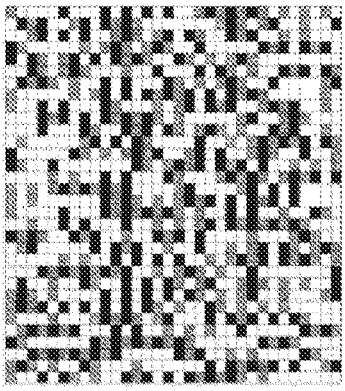
FIGS. 25A through 25F are diagrams illustrating examples of mask patterns.
Figure 25B:
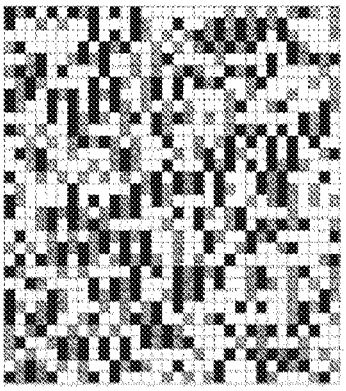
Figure 25C:
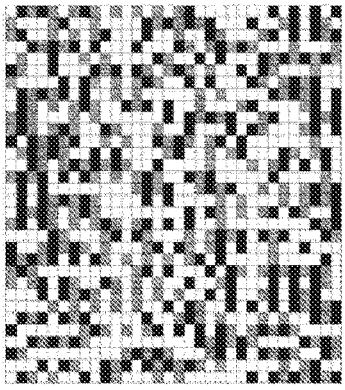
Figure 25D:
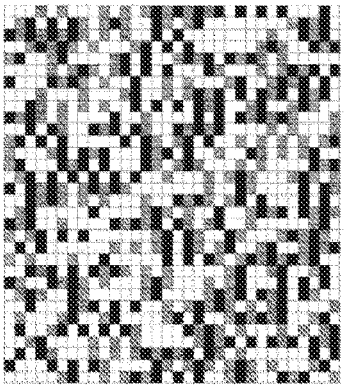
Figure 25E:
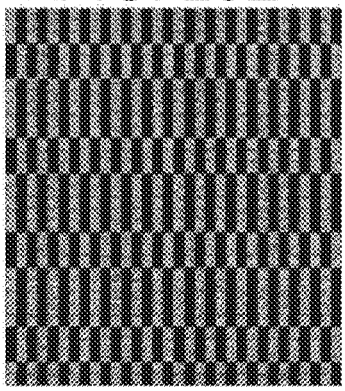
Figure 25F:
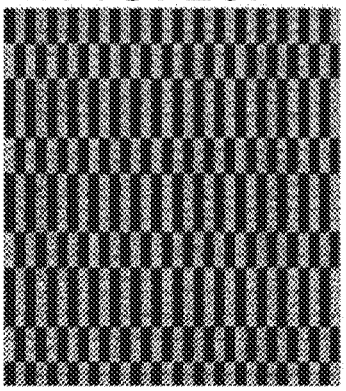
Figure 25F:
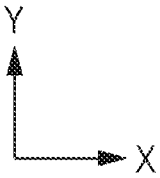

Now, detailed description will be made regarding a mechanism whereby missing and overlapping dots, due to deviation in the X direction between reciprocal scans when recording low-concentration images, can be reduced by using mask patterns where pixels to which the code value "1" have been set alternate in the X direction in the logical sum pattern for forward scanning and the logical sum pattern for backward scanning. FIGS. 25A through 25F are diagrams illustrating mask patterns where code values have been set for each of the pixels, such that pixels to which the code value "1" have been set alternate in the X direction in the logical sum pattern for forward scanning and the logical sum pattern for backward scanning. Note that FIG. 25A illustrates a mask pattern MP1' corresponding to the first scan, FIG. 25B illustrates a mask pattern MP2' corresponding to the second scan, FIG. 25C illustrates a mask pattern MP3' corresponding to the third scan, and FIG. 25D illustrates a mask pattern MP4' corresponding to the fourth scan. Also, FIG. 25E illustrates a logical sum pattern MP1'+MP3' obtained as the logical sum of the number of times of permitted discharge of ink stipulated in the mask pattern MP1' corresponding to the first scan in FIG. 25A and the mask pattern MP3' corresponding to the third scan in FIG. 25C. Further, FIG. 25F illustrates a logical sum pattern MP2'+MP4' obtained as the logical sum of the number of times of permitted discharge of ink stipulated in the mask pattern MP2' corresponding to the second scan in FIG. 25B and the mask pattern MP4' corresponding to the fourth scan in FIG. 25D. In FIGS. 25A through 25F, the white pixels indicate pixels to which the code value "0" has been allocated, the gray pixels indicate pixels to which the code value "1" has been allocated, and the black pixels indicate pixels to which the code value "2" has been allocated.

Now, with regard to the mask patterns MP1' through MP4' illustrated in FIGS. 25A through 25D, pixels to which the code value "1" has been allocated in the logical sum pattern MP1'+MP3' illustrated in FIG. 25E, and pixels to which the code value "1" has been allocated in the logical sum pattern MP2'+MP4' illustrated in FIG. 25F, occur alternately in the X direction in the rows extending in the X direction, unlike the mask patterns MP1_2 through MP4_2 illustrated in FIGS. 17A through 17D and the mask patterns MP1_5 through MP4_5 illustrated in FIGS. 18A through 18D. Note that the mask patterns MP1' through MP4' illustrated in FIGS. 25A through 25D are the same as the mask patterns MP1_2 through MP4_2 illustrated in FIGS. 17A through 17D and the mask patterns MP1_5 through MP4_5 illustrated in FIGS. 18A through 18D, except for the above setting conditions.

The above settings will be described in detail. The logical sum pattern MP1'+MP3' according to the present embodiment illustrated in FIG. 25E has code value "1" allocated to 512 of the 1024 pixels therein, and all of these, i.e., 512 pixels to which the code "1" has been allocated are adjacent at both sides in the X direction to a pixel that has been allocated code value "1" in the logical sum pattern MP2'+MP4' illustrated in FIG. 25F. On the other hand, of the 512 pixels to which the code value "1" has been allocated in the logical sum pattern MP1'+MP3' illustrated in FIG. 25E, there are no pixels to which the code "1" has been allocated that are adjacent in the X direction to a pixel that has been allocated code value "1" in the logical sum pattern MP2'+MP4' in FIG. 25F.

For example, in the row at the edge portion of the logical sum pattern MP1'+MP3' farthest downstream in the Y direction (the top in FIG. 25E), the code value "1" is allocated to the 1st, 3rd, 5th, 7th, 9th, 11th, 13th, 15th, 17th, 19th, 21st, 23rd, 25th, 27th, 29th, and 31st pixels (odd-numbered pixels from the upstream side in the X direction (left side) in FIG. 25E). On the other hand, in the row at the edge portion of the logical sum pattern MP2'+MP4' farthest downstream in the Y direction (the top in FIG. 25F), the code value "1" is allocated to the 2nd, 4th, 6th, 8th, 10th, 12th, 14th, 16th, 18th, 20th, 22nd, 24th, 26th, 28th, 30th, and 32nd pixels from the upstream side in the X direction (even-numbered pixels from the upstream side in the X direction (left side) in FIG. 25F).

Now, of the row at the edge portion of the logical sum pattern MP1'+MP3', farthest downstream in the Y direction (the top in FIG. 25E), the 3rd pixel from the upstream side in the X direction (left side in FIG. 25E) is allocated code value "1", and code value "1" has been allocated in the logical sum pattern MP2'+MP4' illustrated in FIG. 25F to the 2nd and 4th pixels from the upstream side in the X direction (left side in FIG. 25E) adjacent thereto at both sides in the X direction, in the row at the edge at the downstream side in the Y direction (the top in FIG. 25E). That is to say, of the row at the edge portion of the logical sum pattern MP1'+MP3', farthest downstream in the Y direction (the top in FIG. 25E), the 3rd pixel from the upstream side in the X direction (left side in FIG. 25E) is allocated code value "1", and also the pixels adjacent at both sides in the X direction in the logical sum pattern MP2'+MP4' illustrated in FIG. 25F are allocated code value "1".

Here, a pixel at the edge portion upstream in the X direction (left side in the FIGS. 25A through 25F) and a pixel at the edge portion downstream in the X direction (right side in FIGS. 25A through 25F) that are in the same row, are considered to be adjacent. The reason for this is that the mask patterns MP1' through MP4' illustrated in FIGS. 25A through 25D indicate units of repetition of the mask pattern, and these mask patterns actually are used in repetition sequentially in the X direction. Accordingly, when actually applying to image data, situated to the right side of a region within quantization data equivalent to the pixel at the edge portion downstream in the X direction (right side in FIGS. 25A through 25F) of a certain mask pattern is quantization data equivalent to the pixel at the edge portion upstream in the X direction (left side in FIGS. 25A through 25F) of the next mask pattern.

Thus, regarding a pixel allocated code value "1" that is the 1st pixel upstream in the X direction (left side in FIG. 25E) in a row at the edge farthest downstream in the Y direction (top in FIG. 25E) within the logical sum pattern MP1'+MP3' for example, code value "1" is allocated to the 32nd and 2nd pixels adjacent at both sides in the X direction, upstream in the X direction (left side in FIG. 25E) in a row at the edge downstream in the Y direction (top in FIG. 25E) within the logical sum pattern MP2'+MP4' illustrated in FIG. 25F.

Also, the logical sum pattern MP2'+MP4' according to the present embodiment illustrated in FIG. 25F has the code value "1" allocated to 512 of the 1024 pixels therein, and all of these, i.e., 512 pixels to which the code "1" has been allocated are adjacent at both sides in the X direction to a pixel that has been allocated code value "1" in the logical sum pattern MP1'+MP3' illustrated in FIG. 25E. On the other hand, of the 512 pixels to which the code value "1" has been allocated in the logical sum pattern MP2'+MP4' illustrated in FIG. 25F, there are no pixels to which the code "1" has been allocated that are adjacent in the X direction to a pixel that has been allocated code value "1" in the logical sum pattern MP1'+MP3' illustrated in FIG. 25E.

FIGS. 26A through 26E are diagrams for describing the array of dots when recording a low-concentration image, using the mask patterns MP1' through MP4' illustrated in FIGS. 25A through 25D. Description will be made here regarding a case where gradation data, in which the gradation data is level 2 for all pixels, has been input as gradation data corresponding to a low-concentration image. Accordingly, ink of each dot size is applied once to each pixel area, as can be seen from the discharge orifice row rasterization table illustrated in FIG. 6.

In a case where the gradation value of gradation data is level 1 for all pixels corresponding to pixel regions in the unit region 211 in FIG. 8, image data for 2 pl where the pixel value is "1" is generated for all pixels, as can be seen from the discharge orifice row rasterization table illustrated in FIG. 6. Accordingly, ink is discharged to pixel regions corresponding to pixels allocated code value "1" in the mask patterns MP1' through MP4' in FIGS. 25A through 25D, as can be seen from the discharge orifice row rasterization table illustrated in FIG. 10. That is to say, ink is discharged to pixel region corresponding to the gray pixels in FIG. 25A in the first scan, in FIG. 25B in the second scan, in FIG. 25C in the third scan, and in FIG. 25D in the fourth scan. Of these the first and third scans are forward scans, and the second and fourth scans are backward scans, so the pixels to which ink is discharged in the forward scans are the gray pixels in FIG. 25E, and the pixels to which ink is discharged in the backward scans are the gray pixels and black pixels in FIG. 25F.

Figure 26A:
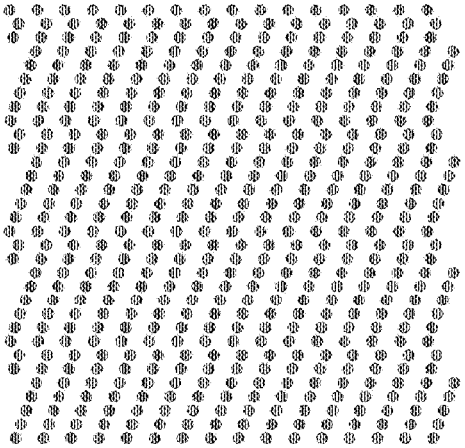
FIGS. 26A through 26E are schematic diagrams illustrating images to be recorded in an embodiment.
Figure 26B:
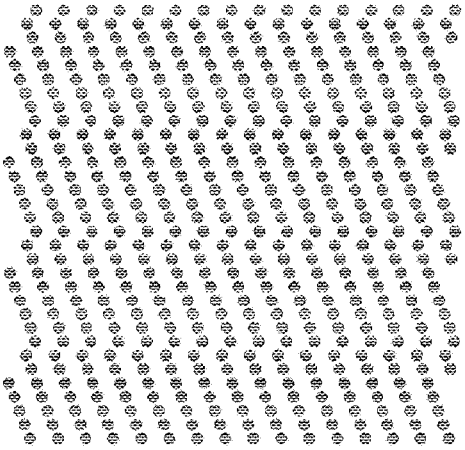
Figure 26C:
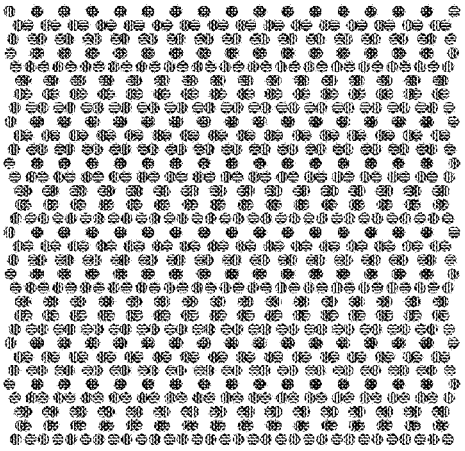
Figure 26D:
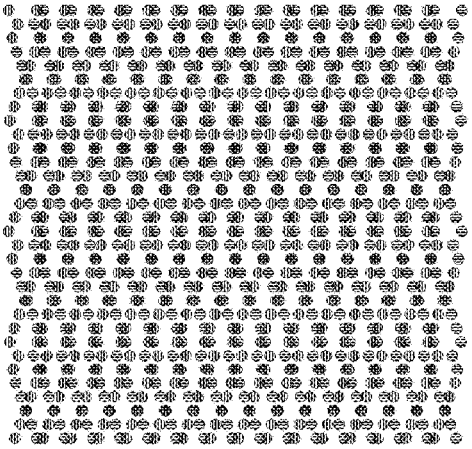

By performing time-division driving in the driving order illustrated in FIG. 19A for both forward scanning and backward scanning, ink will be discharged and dots formed at the positions illustrated in FIG. 26A for the forward scans and in FIG. 26B for the backward scans, if there is no deviation between reciprocal scans. FIG. 26C illustrates a dot array where the dot arrays in FIGS. 26A and 26B have been overlaid with no positional deviation. FIG. 26D illustrates a case where the dot arrays have been overlaid with positional deviation of 21.2 μm (equivalent to 1200 dpi) toward the downstream side in the X direction in the backward scan, and FIG. 26E illustrates a case where the dot arrays have been overlaid with positional deviation of 42.3 μm (equivalent to 600 dpi) toward the downstream side in the X direction in the backward scan.

It can be seen in FIG. 26C that, with regard to the rows extending in the X direction, there are rows where dots from the forward scans and dots from the backward scans are recorded almost completely overlapped, rows partly overlapped, and rows recorded without hardly any overlapping, these various states being intermingled. In FIG. 26D, dots in rows overlapped to begin with newly emerge, while dots in rows that were deviated without overlapping to begin with newly overlap, thereby canceling out variation in concentration. This is also true in FIG. 26E, in that dots in rows overlapped to begin with newly emerge, while dots in rows that were deviated without overlapping to begin with newly overlap, thereby canceling out variation in concentration.

Figure 26E:
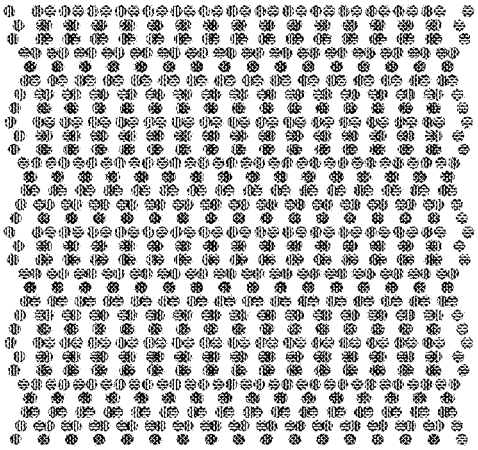
Figure 26E:
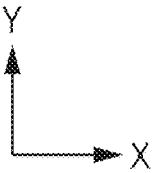

Thus, when viewed as an overall image, there is hardly any variation in concentration occurring in comparison with the case in FIG. 26C where there is no deviation between reciprocal scans, regardless of whether the amount deviation between reciprocal scans is 21.2 μm upstream in the X direction, illustrated in FIG. 26D, or the amount deviation between reciprocal scans is 42.3 μm upstream in the X direction, illustrated in FIG. 26E. Accordingly, it can be seen from FIGS. 26A through 26E that recording can be performed with suppressed discharge position deviation between reciprocal scans when recording images with relatively low concentration where one dot is recorded in one pixel region, according to the mask patterns and driving order where pixels to which code value "1" has been set alternately occur in the X direction, in the logical sum pattern for forward scanning and the logical sum pattern for backward scanning.

In comparison, description will be made regarding dot positions formed in a case of gradient data where the gradient level is level 2 at all pixels being input as gradient data, using the mask patterns illustrated in FIGS. 17A through 17D in the first embodiment, and all other conditions being the same as in the present embodiment. FIGS. 26A through 26E are diagrams illustrating images recorded by ink in a case where gradation data is input where the gradation level is level 2, using the mask patterns illustrated in FIGS. 17A through 17D.

In a case where the gradation value of gradation data is 2 for all pixels in the unit region 211 in FIG. 8, image data where the pixel value is "1" is generated to all pixels as image data for each dot size, as can be seen from the discharge orifice row rasterization table illustrated in FIG. 6. Accordingly, ink is discharged to pixel regions corresponding to pixels allocated code value "1" in the mask patterns in FIGS. 17A through 17D, as illustrated in the decoding table in FIG. 10. That is to say, ink is discharged to pixel region corresponding to the gray pixels and the black pixels in FIG. 17A in the first scan, in FIG. 17B in the second scan, in FIG. 17C in the third scan, and in FIG. 17D in the fourth scan. Of these, the first and third scans are forward scans, and the second and fourth scans are backward scans, so the pixels to which ink is discharged in the forward scans are the gray pixels and black pixels in FIG. 17E, and the pixels to which ink is discharged in the backward scans are the gray pixels and black pixels in FIG. 17F.

Figure 27A:
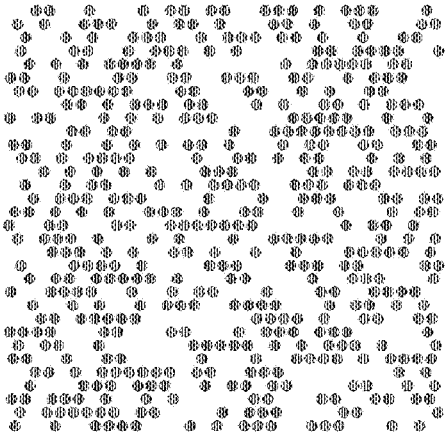
FIGS. 27A through 27E are schematic diagrams illustrating images to be recorded in a comparative example.
Figure 27B:
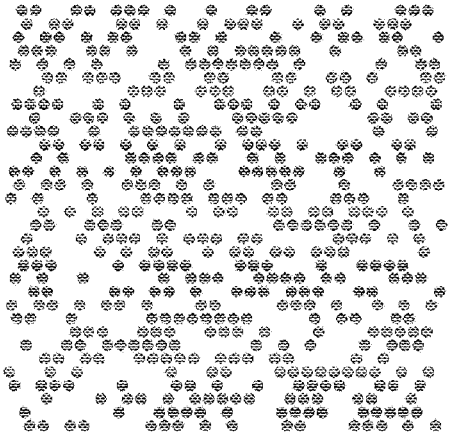
Figure 27C:
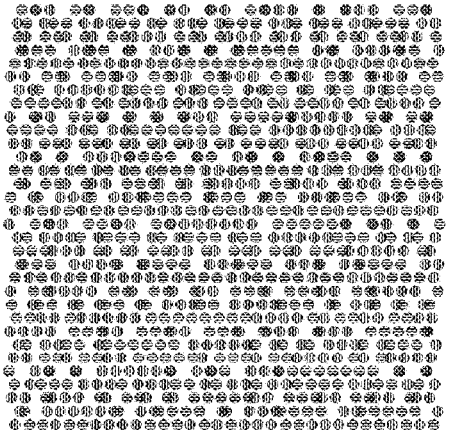
Figure 27D:
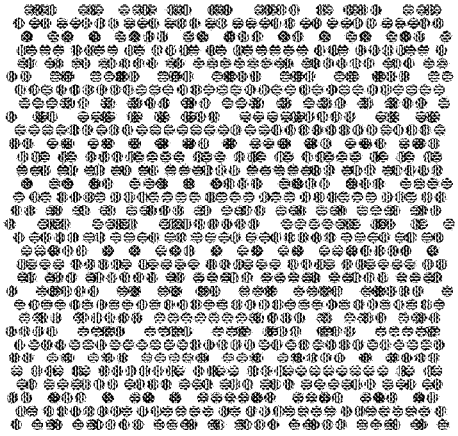
Figure 27E:
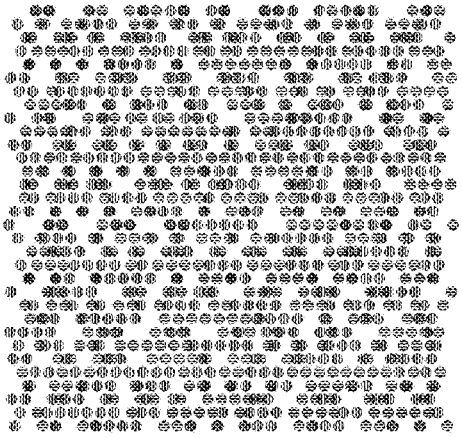
Figure 27E:
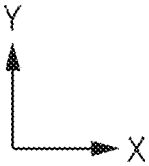

By performing time-division driving in the driving order illustrated in FIG. 19A for both forward scanning and backward scanning, ink will be discharged and dots formed at the positions illustrated in FIG. 27A for the forward scans and in FIG. 27B for the backward scans, if there is no deviation between reciprocal scans. FIG. 27C illustrates a dot array where the dot arrays in FIGS. 27A and 27B have been overlaid with no positional deviation. FIG. 27D illustrates a case where the dot arrays have been overlaid with positional deviation of 21.2 μm (equivalent to 1200 dpi) toward the downstream side in the X direction in the backward scan, and FIG. 27E illustrates a case where the dot arrays have been overlaid with positional deviation of 42.3 μm (equivalent to 600 dpi) toward the downstream side in the X direction in the backward scan.

It can be seen in FIG. 27C that there are places where dots from the forward scans and dots from the backward scans are recorded almost completely overlapped, places partly overlapped, and places recorded without hardly any overlapping, these various states being intermingled. Accordingly, in a case where the deviation among reciprocal scans is relatively small as illustrated in FIG. 27D, there are dots overlapping and gaps than in FIG. 27C, but an image that does not change that much can be recorded. However, in a case where the deviation among reciprocal scans is relatively large as illustrated in FIG. 27E, the dots overlapping and gaps become conspicuous, and deterioration in image quality becomes visibly recognizable. Dispersion in the X direction is low for the pixels set for recording, is deterioration in image quality is uncontrollable in a case where deviation among reciprocal scans becomes large.

Thus, according to mask patterns where code values have been set such that pixels to which code value "1" has been set alternately occur in the X direction in the logical sum pattern for forward scanning and the logical sum pattern for backward scanning, it can be experimentally configured that ink discharge position deviation of one dot size between reciprocal scans when recording low-concentration images can be suppressed, in comparison with mask patterns that have code values allocated such that the pixels allocated code value "1" in logical sum patterns for forward scanning and logical sum patterns for backward scanning have an array with random white noise properties.

Mask Patterns Applied in Present Embodiment

In light of the above, a mask pattern is applied in the present embodiment in which code values have been such that pixels to which code value "1" has been set in a logical sum pattern for forward scanning, i.e., pixels to which code value "1" has been set in either of the mask patterns for forward scanning, and pixels to which code value "1" has been set in a logical sum pattern for backward scanning, i.e., pixels to which code value "1" has been set in either of the mask patterns for backward scanning, occur alternately in the X direction. In doing so, code values are allocated to the pixels in the mask patterns applied in the present embodiment such that pixels to which code value "1" has been allocated in either one of mask patterns for the 2 pl dot size of cyan ink for forward scanning, and pixels to which code value "1" has been allocated in either one of mask patterns for the 5 pl dot size of cyan ink for forward scanning, are of different arrays as each other. In the same way, code values are allocated to the pixels in the mask patterns applied in the present embodiment such that pixels to which code value "1" has been allocated in either one of mask patterns for the 2 pl dot size of cyan ink for backward scanning, and pixels to which code value "1" has been allocated in either one of mask patterns for the 5 pl dot size of cyan ink for backward scanning, are of different arrays as each other.

Figure 28A:
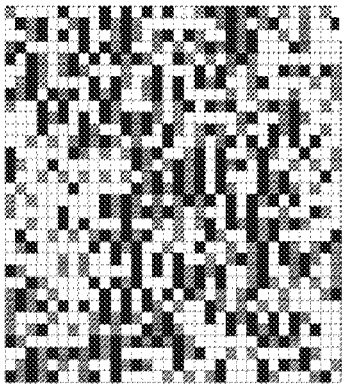
FIGS. 28A through 28F are diagrams illustrating mask patterns applied in an embodiment.
Figure 28B:
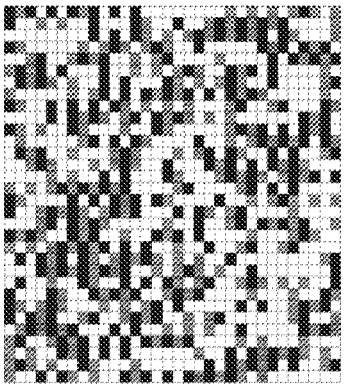
Figure 28C:
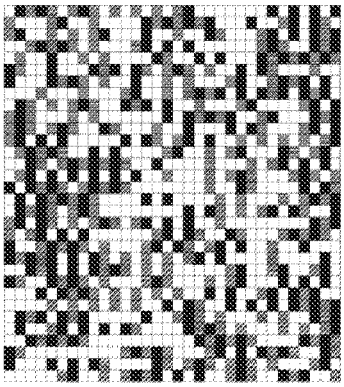
Figure 28D:
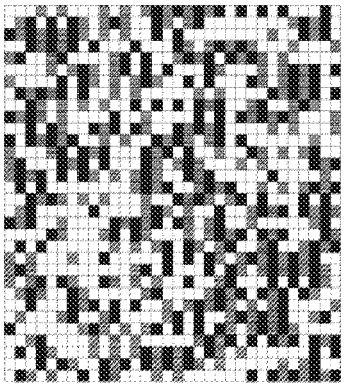
Figure 28E:
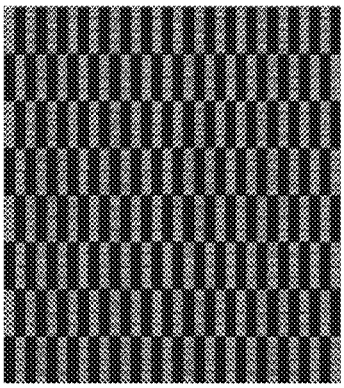
Figure 28F:
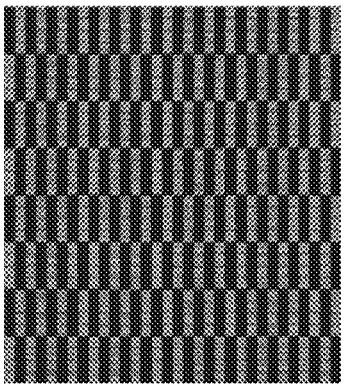
Figure 28F:
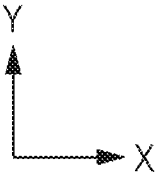

FIGS. 28A through 28F are diagrams illustrating mask patterns used for image data C4_2 for the 2 pl dot size of cyan ink in the present embodiment. Note that FIG. 28A illustrates a mask pattern MP1_2' for 2 pl of cyan ink corresponding to the first scan, FIG. 28B illustrates a mask pattern MP2_2' for 2 pl of cyan ink corresponding to the second scan, FIG. 28C illustrates a mask pattern MP3_2' for 2 pl of cyan ink corresponding to the third scan, and FIG. 28D illustrates a mask pattern MP4_2' for 2 pl of cyan ink corresponding to the fourth scan. Also, FIG. 28E illustrates a logical sum pattern MP1_2'+MP3_2' obtained as the logical sum of the number of times of permitted discharge of ink stipulated in the mask pattern MP1_2' corresponding to the first scan in FIG. 28A and the mask pattern MP3_2' corresponding to the third scan in FIG. 28C. Further, FIG. 28F illustrates a logical sum pattern MP2_2'+MP4_2' obtained as the logical sum of the number of times of permitted discharge of ink stipulated in the mask pattern MP2_2' corresponding to the second scan in FIG. 28B and the mask pattern MP4_2' corresponding to the fourth scan in FIG. 28D.

Figure 29A:
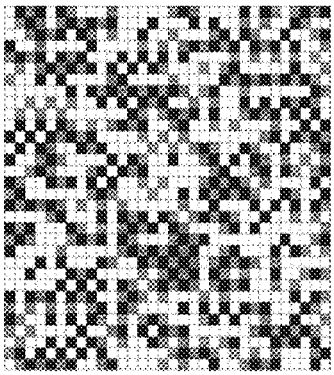
FIGS. 29A through 29F are diagrams illustrating mask patterns applied in an embodiment.
Figure 29B:
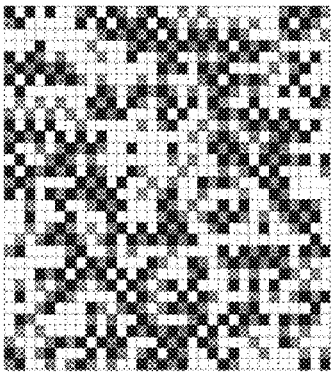
Figure 29C:
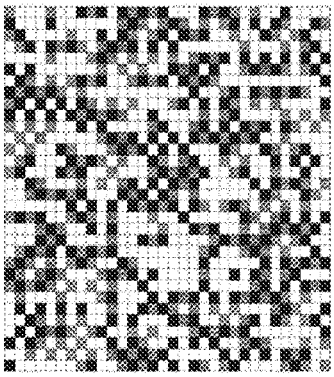
Figure 29D:
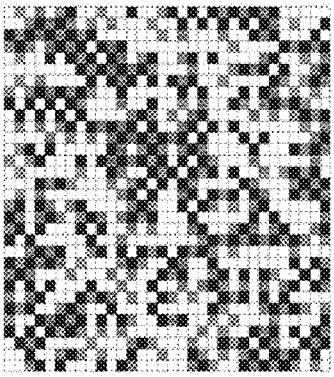
Figure 29E:
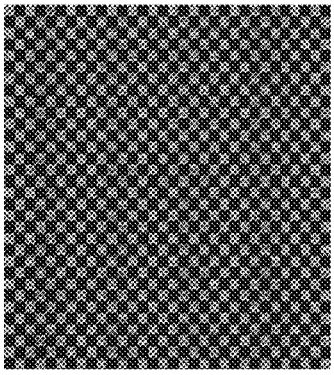
Figure 29F:
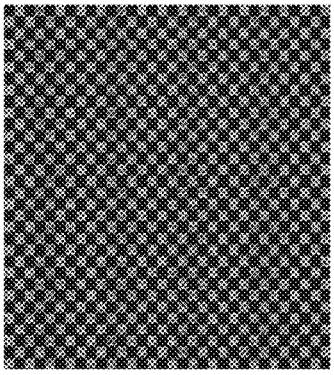
Figure 29F:
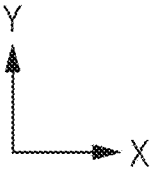

Also, FIGS. 29A through 29F are diagrams illustrating mask patterns used for image data C4_5 for the 5 pl dot size of cyan ink in the present embodiment. Note that FIG. 29A illustrates a mask pattern MP1_5' for 5 pl of cyan ink corresponding to the first scan, FIG. 29B illustrates a mask pattern MP2_5' for 5 pl of cyan ink corresponding to the second scan, FIG. 29C illustrates a mask pattern MP3_5' for 5 pl of cyan ink corresponding to the third scan, and FIG. 29D illustrates a mask pattern MP4_5' for 5 pl of cyan ink corresponding to the fourth scan. Also, FIG. 29E illustrates a logical sum pattern MP1_5'+MP3_5' obtained as the logical sum of the number of times of permitted discharge of ink stipulated in the mask pattern MP1_5' corresponding to the first scan in FIG. 29A and the mask pattern MP3_5' corresponding to the third scan in FIG. 29C. Further, FIG. 29F illustrates a logical sum pattern MP2_5'+MP4_5' obtained as the logical sum of the number of times of permitted discharge of ink stipulated in the mask pattern MP2_5' corresponding to the second scan in FIG. 29B and the mask pattern MP4_5' corresponding to the fourth scan in FIG. 29D. Note that in FIGS. 28A through 29F, pixels indicated by white represent pixels to which code value "0" has been allocated, pixels indicated by gray represent pixels to which code value "1" has been allocated, and pixels indicated by black represent pixels to which code value "2" has been allocated.

It can be seen from the logical sum pattern MP1_2'+MP3_2' and the logical sum pattern MP2_2'+MP4_2' illustrated in FIGS. 28E and 28F that the mask patterns MP1_2' through MP4_2' for 2 pl of cyan ink, illustrated in FIGS. 28A through 28D, are set such that pixels to which code value "1" has been allocated in either one of mask patterns MP1_2' and MP3_2' for forward scanning, and pixels to which code value "1" has been allocated in either one of mask patterns MP2_2' and MP4_2' for backward scanning, alternate in the X direction. In the same way, it can be seen from the logical sum pattern MP1_5'+MP3_5' and the logical sum pattern MP2_5'+MP4_5' illustrated in FIGS. 29E and 29F that the mask patterns MP1_5' through MP4_5' for 5 pl of cyan ink, illustrated in FIGS. 29A through 29D, are set such that pixels to which code value "1" has been allocated in either one of mask patterns MP1_5' and MP3_5' for forward scanning, and pixels to which code value "1" has been allocated in either one of mask patterns MP2_5' and MP4_5' for backward scanning, alternate in the X direction.

It can further be seen by comparing FIGS. 28E and 29E that of the pixels allocated code value "1" in either one of mask patterns MP1_2' and MP3_2' for the 2 pl dot size of cyan ink for forward scanning, around half are arrayed so as to not be superimposed on pixels allocated code value "1" in either one of mask patterns MP1_5' and MP3_5' for the 5 pl dot size of cyan ink for forward scanning. The remaining half or so are arrayed the same as pixels allocated code value "1" in either one of mask patterns MP1_5' and MP3_5' for the 5 pl dot size of cyan ink for forward scanning.

For example, in the row at the edge portion of the logical sum pattern MP1_2'+MP3_2' illustrated in FIG. 28E farthest downstream in the Y direction (the top in FIG. 28E), the code value "1" is allocated to the 1st, 3rd, 5th, 7th, 9th, 11th, 13th, 15th, 17th, 19th, 21st, 23rd, 25th, 27th, 29th, and 31st pixels (odd-numbered pixels from the upstream side in the X direction (left side) in FIG. 28E). Also, in the row at the edge portion of the logical sum pattern MP1_5'+MP3_5' illustrated in FIG. 29E farthest downstream in the Y direction (the top in FIG. 29E), the code value "1" is allocated to the 1st, 3rd, 5th, 7th, 9th, 11th, 13th, 15th, 17th, 19th, 21st, 23rd, 25th, 27th, 29th, and 31st pixels (odd-numbered pixels from the upstream side in the X direction (left side) in FIG. 29E). Accordingly, it can be seen that pixels allocated code value "1" in the row at the edge portion of the logical sum pattern MP1_2'+MP3_2' illustrated in FIG. 28E farthest downstream in the Y direction (the top in in FIG. 28E) are all of the same array as the pixels allocated code value "1" in the row at the edge portion of the logical sum pattern MP1_5'+MP3_5' illustrated in FIG. 29E farthest downstream in the Y direction (the top in FIG. 29E).

On the other hand, in the second row from the edge portion of the logical sum pattern MP1_2'+MP3_2' illustrated in FIG. 28E farthest downstream in the Y direction (the top in FIG. 28E), the code value "1" is allocated to the 1st, 3rd, 5th, 7th, 9th, 11th, 13th, 15th, 17th, 19th, 21st, 23rd, 25th, 27th, 29th, and 31st pixels (odd-numbered pixels from the upstream side in the X direction (left side) in FIG. 28E). Conversely, in the second row from the edge portion of the logical sum pattern MP1_5'+MP3_5' illustrated in FIG. 29E farthest downstream in the Y direction (the top in FIG. 29E), the code value "1" is allocated to the 2nd, 4th, 6th, 8th, 10th, 12th, 14th, 16th, 18th, 20th, 22nd, 24th, 26th, 28th, 30th, and 32nd pixels from the upstream side in the X direction (even-numbered pixels from the upstream side in the X direction (left side) in FIG. 29F). Accordingly, it can be seen that pixels allocated code value "1" in the second row from the edge portion of the logical sum pattern MP1_2'+MP3_2' illustrated in FIG. 28E farthest downstream in the Y direction (the top in FIG. 28E) are have a different array from the pixels allocated code value "1" in the second row from the edge portion of the logical sum pattern MP1_5'+MP3_5' illustrated in FIG. 29E farthest downstream in the Y direction (the top in FIG. 29E).

Applying this idea to all subsequent rows, it can be seen that of the pixels allocated code value "1" in the logical sum pattern MP1_2'+MP3_2', around half of the pixels are of the same array as pixels allocated code value "1" in the logical sum pattern MP1_5'+MP3_5'. It can further be seen by comparing FIGS. 28F and 29F that of the pixels allocated code value "1" in either one of mask patterns MP2_2' and MP4_2' for the 2 pl dot size of cyan ink for forward scanning, around half are arrayed so as to not be superimposed on pixels allocated code value "1" in either one of mask patterns MP2_5' and MP4_5' for the 5 pl dot size of cyan ink for forward scanning. The remaining half or so are arrayed the same as pixels allocated code value "1" in either one of mask patterns MP2_5' and MP4_5' for the 5 pl dot size of cyan ink for forward scanning. The mask patterns MP1_2' through MP4_2' for the 2 pl cyan ink and the mask patterns MP1_5' through MP4_5' for the 5 pl cyan ink used in the present embodiment are set based on conditions such as described above.

Recording Images by the Present Embodiment

As described above, the present embodiment performs time-division driving using the mask patterns MP1_2' through MP4_2' for 2 pl of cyan ink, illustrated in FIGS. 28A through 28D, and the mask patterns MP1_5' through MP4_5' for 5 pl of cyan ink, illustrated in FIGS. 29A through 29D, following the driving order illustrated in FIG. 19A for both forward scanning and backward scanning. Accordingly, recording is performed that suppresses discharge position deviation between reciprocal scans, not only when recording high-concentration images, but when recording low-concentration images as well. Further, making the mask patterns MP1_2' through MP4_2' for 2 pl of cyan ink and the mask patterns MP1_5' through MP4_5' for 5 pl of cyan ink to be different enables recording that does not readily cause image quality defects, even in a case of using ink of multiple dot sizes, as in the first embodiment.

Figure 30A:
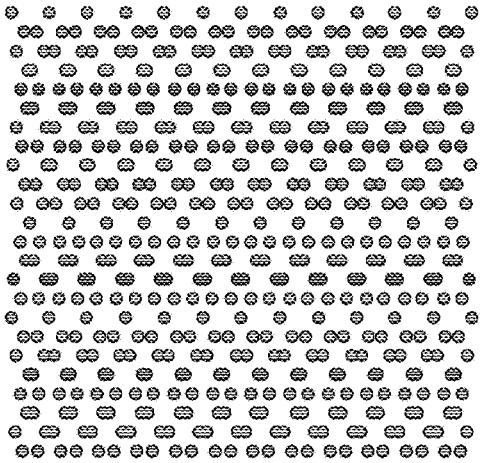
FIGS. 30A through 30C are schematic diagrams illustrating images to be recorded in an embodiment.
Figure 30B:
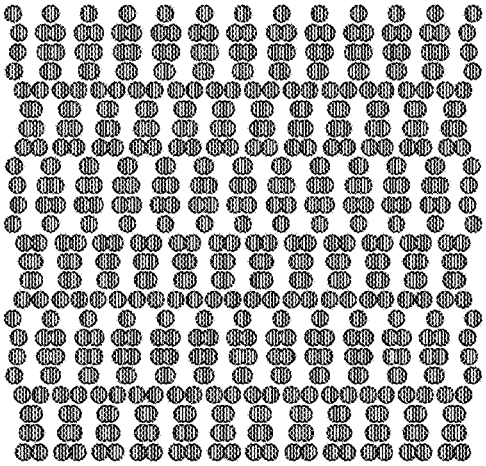
Figure 30C:
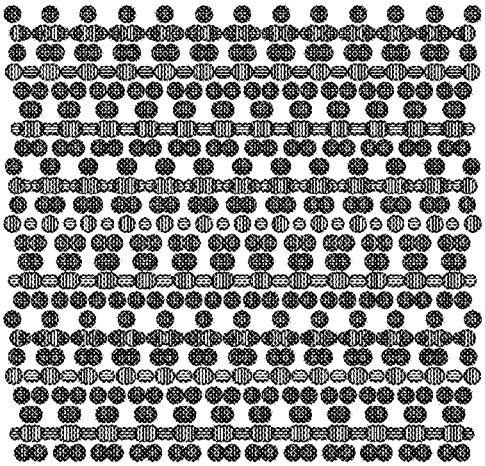
Figure 30C:
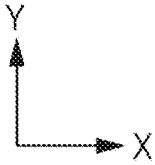

Description will be made regarding positions of dots formed in a case of using mask patterns applied to image data for 2 pl of cyan ink and mask patterns applied to image data for 5 pl of cyan ink, that have been made to differ, as described above. FIGS. 30A through 30C are diagrams illustrating the array of dots formed in a case of generating recording data for image data for 2 pl of cyan ink using the mask patterns illustrated in FIGS. 28A through 28D, and image data for 5 pl of cyan ink using the mask patterns illustrated in FIGS. 29A through 29D, and scanning both the recording element row for 2 pl of cyan ink and the recording element row for 5 pl of cyan ink by time-division driving by the driving order illustrated in FIG. 19A, for both forward scanning and backward scanning. FIG. 30A illustrates the array of cyan ink dots corresponding to the 2 pl dot size, FIG. 30B illustrates the array of cyan ink dots corresponding to the 5 pl dot size, and FIG. 30C illustrates the dots of cyan ink corresponding to the 2 pl dot size and cyan ink corresponding to the 5 pl dot size in FIGS. 30A and 30B superimposed. The circles in FIGS. 30A through 30C with horizontal lines inside represent cyan ink dots formed corresponding to the 2 pl dot size, and the circles with vertical lines inside represent dots represent cyan ink dots formed corresponding to the 5 pl dot size.

FIG. 30A schematically illustrates the positions of dots formed by cyan ink corresponding to the 2 pl dot size, in a case where gradation data of which the gradation level is level 2 at all pixels has been input as the gradation data C3. FIG. 30B schematically illustrates the positions of dots formed by cyan ink corresponding to the 5 pl dot size, in a case where gradation data of which the gradation level is level 2 at all pixels has been input as the gradation data C3. It can be seen from the discharge orifice row rasterization table in FIG. 6 that in a case where the gradation level of the gradation data is level 2, both pixel values of the image data for 2 pl of cyan ink and image data for 5 pl of cyan ink is "1". Accordingly, both cyan ink corresponding to the 2 pl dot size and cyan ink corresponding to the 5 pl dot size are applied to each pixel region, one time each.

In a case where image data of relatively low concentration is input in the present embodiment, mask patterns are set so that cyan ink corresponding to the 2 pl dot size and cyan ink corresponding to the 5 pl dot size are applied to the same pixel region in scans in different directions for approximately half of the pixel regions, and cyan ink corresponding to the 2 pl dot size and cyan ink corresponding to the 5 pl dot size are applied to the same pixel region in scans in the same direction for the remaining approximately half of the pixel regions, as described with reference to FIGS. 28A through 29F. On the other hand, scanning is performed for the recording element row for 2 pl of cyan ink and the recording element row for 5 pl of cyan ink by time-division driving in the same driving order illustrated in FIG. 19A, so the driving order of recording elements for the cyan ink corresponding to the 2 pl dot size and cyan ink corresponding to the 5 pl dot size is the same.

In light of the above points, in a case where recording data is generated to apply cyan ink corresponding to the 2 pl dot size to a certain pixel region in the forward scans (first and third scans), the configuration is such that recording data is generated to apply cyan ink corresponding to the 5 pl dot size to that pixel region in the backward scans (second and fourth scans) for approximately half of the pixel regions. The driving order of recording elements discharging each of the cyan ink corresponding to the 2 pl dot size and the cyan ink corresponding to the 5 pl dot size as to the pixel region is the same. Accordingly, the cyan ink corresponding to the 2 pl dot size and the cyan ink corresponding to the 5 pl dot size are discharged to the aforementioned half of the pixel region by scans in different direction at the same driving order, so the landing position of the dots will differ in the X direction, which can be seen in FIG. 30C.

Note that with regard to the remaining approximately half of pixel regions where recording data is generated to apply cyan ink corresponding to the 2 pl dot size in the forward scans (first and third scans), recording data is generated to apply cyan ink corresponding to the 5 pl dot size to these pixel regions in the forward scans (first and third scans). Accordingly, the cyan ink corresponding to the 2 pl dot size and the cyan ink corresponding to the 5 pl dot size are discharged to the remaining half of the pixel regions by scans in the same direction at the same driving order, so the landing position of the dots will be the same in the X direction, which can be seen in FIG. 30C. Although the coverage of the surface of the recording medium is somewhat lower in the image illustrated in FIG. 30C, the cyan ink corresponding to the 2 pl dot size and the cyan ink corresponding to the 5 pl dot size land at mutually different positions in the X direction at half of the pixel regions, so superimposing of dots can be reduced to a certain level. Thus, recording can be performed while suppressing graininess.

As described above, discharge position deviation between reciprocal scans of different dot sizes of ink can be suitably suppressed by the present embodiment, not only for recording high-concentration images, but also for recording low-concentration images. Further, the mask patterns have been made to differ for the cyan ink corresponding to the 2 pl dot size and the cyan ink corresponding to the 5 pl dot size, so graininess due to dot arrays being superimposed between the cyan ink corresponding to the 2 pl dot size and the cyan ink corresponding to the 5 pl dot size can be suppressed.

Comparative Example

A form used for comparison with the second embodiment will be described in detail. In the comparative example, the mask patterns MP1_2' through MP4_2' illustrated in FIGS. 28A through 28D, applied to the image data for 2 pl of cyan ink in the second embodiment, are applied to both image data of the image data for 2 pl of cyan ink and image data for 5 pl of cyan ink, and recording data is generated. The driving order in time-division driving is the driving order illustrated in FIG. 19A for both the recording element row for 2 pl of cyan ink and the recording element row for 5 pl of cyan ink, the same as in the second embodiment.

Figure 31A:
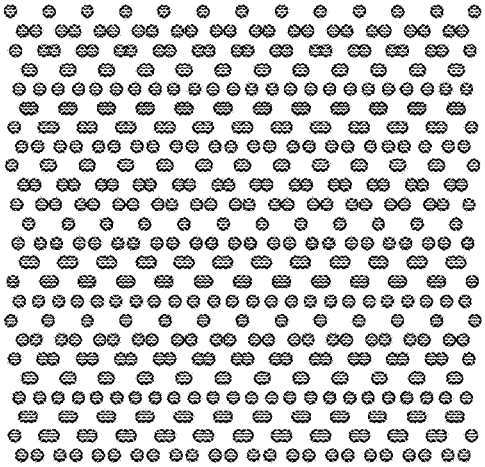
FIGS. 31A through 31C are schematic diagrams illustrating images to be recorded in a comparative example.
Figure 31B:
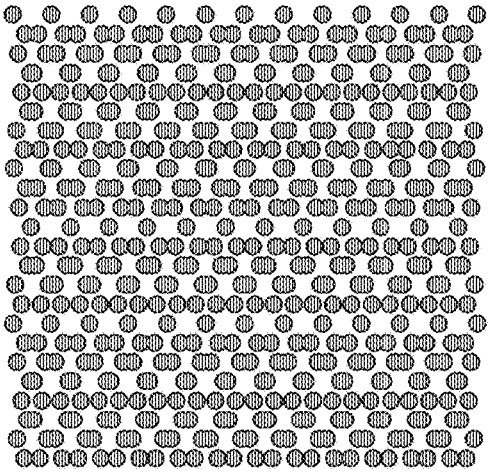
Figure 31C:
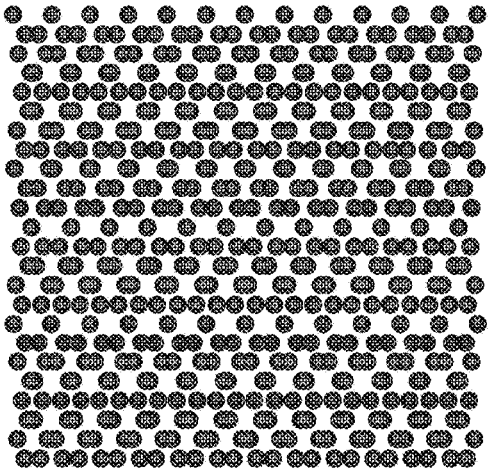
Figure 31C:
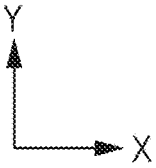

FIGS. 31A through 31C are diagrams illustrating dot arrays formed by generating recording data using each of the mask patterns illustrated in FIGS. 28A through 28D for the image data for 2 pl of cyan ink and the image data for 5 pl of cyan ink, and scanning both the recording element row for 2 pl of cyan ink and the recording element row for 5 pl of cyan ink by time-division driving in the driving order illustrated in FIG. 19A for both forward scanning and backward scanning. Note that FIG. 31A illustrates the array of cyan ink dots corresponding to the 2 pl dot size, and FIG. 31B illustrates the array of cyan ink dots corresponding to the 5 pl dot size. Further, FIG. 31C illustrates the dots of cyan ink corresponding to the 2 pl dot size and cyan ink corresponding to the 5 pl dot size, illustrated in FIGS. 31A and 31B respectively, that have been superimposed. The circles in FIGS. 31A through 31C with horizontal lines inside represent cyan ink dots corresponding to the 2 pl dot size, and the circles with vertical lines inside represent cyan ink dots corresponding to the 5 pl dot size.

FIG. 31A schematically illustrates the positions of dots formed by cyan ink corresponding to the 2 pl dot size, in a case where gradation data of which the gradation level is level 2 at all pixels has been input as the gradation data C3. FIG. 31B schematically illustrates the positions of dots formed by cyan ink corresponding to the 5 pl dot size, in a case where gradation data of which the gradation level is level 2 at all pixels has been input as the gradation data C3. It can be seen from the discharge orifice row rasterization table in FIG. 6 that in a case where the gradation level of the gradation data is level 2, both pixel values of the image data for 2 pl of cyan ink and image data for 5 pl of cyan ink is "1". Accordingly, both cyan ink corresponding to the 2 pl dot size and cyan ink corresponding to the 5 pl dot size are applied to each pixel region, one time each.

As described above, the mask patterns illustrated in FIGS. 28A through 28D are applied for both the image data for 2 pl of cyan ink and the image data for 5 pl of cyan ink. Accordingly, in a case where image data of relatively low concentration is input, cyan ink corresponding to the 2 pl dot size and cyan ink corresponding to the 5 pl dot size are applied to the same pixel region in scans in the same direction. On the other hand, scanning is performed for the recording element row for 2 pl of cyan ink and the recording element row for 5 pl of cyan ink by time-division driving in the same driving order illustrated in FIG. 19A, so the driving order of recording elements discharging the cyan ink corresponding to the 2 pl dot size and cyan ink corresponding to the 5 pl dot size on the same pixel region is the same.

In light of the above points, in a case where recording data is generated to apply cyan ink corresponding to the 2 pl dot size to a certain pixel region in the forward scans (first and third scans), recording data is generated to apply cyan ink corresponding to the 5 pl dot size to that pixel region in the forward scans (first and third scans). The driving order of recording elements discharging each of the cyan ink corresponding to the 2 pl dot size and the cyan ink corresponding to the 5 pl dot size to the pixel region is the same. Accordingly, the cyan ink corresponding to the 2 pl dot size and the cyan ink corresponding to the 5 pl dot size are discharged to the same pixel region in the same direction and in the same driving order, so the landing position of the dots will be the same in the X direction in all pixel regions.

Accordingly, the cyan ink corresponding to the 2 pl dot size and the cyan ink corresponding to the 5 pl dot size are applied to the pixel regions in the unit region at the same positions in the comparative example, which can be seen from FIGS. 31A and 31B. As a result, the surface of the recording medium cannot be sufficiently covered by the cyan ink corresponding to the 2 pl dot size and the cyan ink corresponding to the 5 pl dot size in the comparative example, as illustrated in FIG. 31C. As a result, an image with conspicuous graininess may be recorded.

It can be clearly seen by comparing the cyan ink corresponding to the 2 pl dot size and the cyan ink corresponding to the 5 pl dot size recorded by the first embodiment illustrated in FIG. 30C with the cyan ink for the 2 pl dot size and the cyan ink for the 5 pl dot size recorded by the comparative example illustrated in FIG. 31C, that graininess in the image can be suppressed by applying the second embodiment.

Although description has been made in the present embodiment regarding an arrangement in which mask patterns are used where, of pixels to which code value "1" has been allocated in one of the logical sum patterns, all pixels are adjacent on both sides in the X direction to pixels in the other logical sum pattern to which code value "1" has been allocated, as exemplified in FIGS. 28E and 28F, other arrangements may be made. It is sufficient to obtain the advantages of the present embodiment by using mask patterns where, of pixels to which code value "1" has been allocated in one of the logical sum patterns, the number of pixels adjacent on both sides in the X direction to pixels in the other logical sum pattern to which code value "1" has been allocated is greater than the number of pixels not adjacent in the X direction to pixels in the other logical sum pattern to which code value "1" has been allocated.

Also, description has been made in the present embodiment regarding an arrangement in which mask patterns are used stipulating code values to the pixels where, of pixels allocated code value "1" in a logical sum pattern for the 2 pl dot size of cyan ink for forward scanning, around half of the pixels have the same array as pixels allocated code value "1" in a logical sum pattern for the 5 pl dot size of cyan ink for forward scanning, but other arrangements may be made. For example, an arrangement may be made in which mask patterns are used stipulating code values to the pixels where, all pixels allocated code value "1" in a logical sum pattern for the 2 pl dot size of cyan ink for forward scanning have the same array as pixels allocated code value "1" in a logical sum pattern for the 5 pl dot size of cyan ink for forward scanning, as in the first embodiment. FIGS. 32A through 32E illustrate an example of such mask patterns.

Figure 32A:
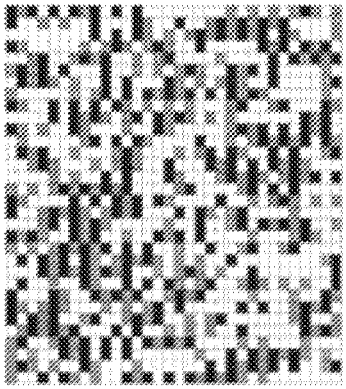
FIGS. 32A through 32F are diagrams illustrating mask patterns applied in an embodiment.
Figure 32B:
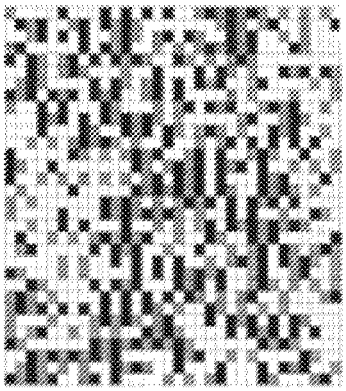
Figure 32C:
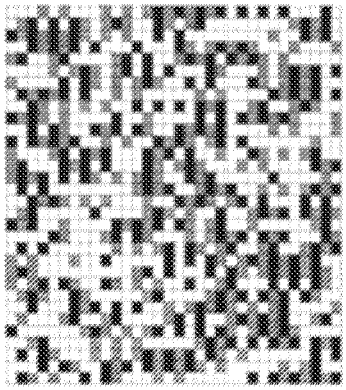
Figure 32D:
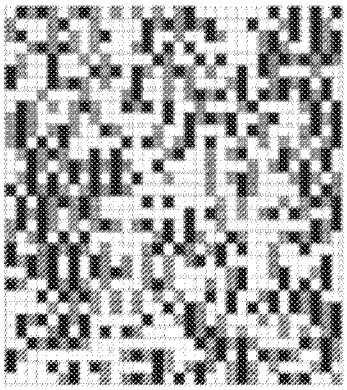
Figure 32E:
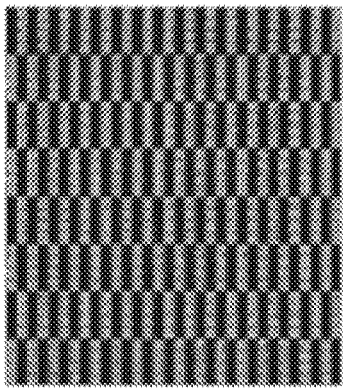
Figure 32F:
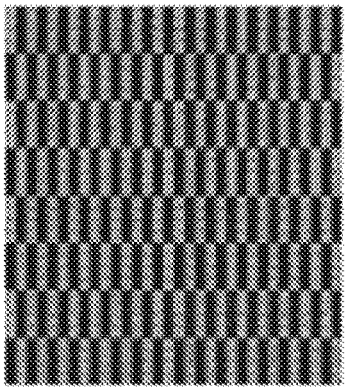
Figure 32F:
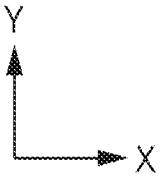

FIG. 32A illustrates a mask pattern MP1_5" for 5 pl of cyan ink corresponding to the first scan, FIG. 32B illustrates a mask pattern MP2_5" for 5 pl of cyan ink corresponding to the second scan, FIG. 32C illustrates a mask pattern MP3_5" for 5 pl of cyan ink corresponding to the third scan, and FIG. 32D illustrates a mask pattern MP4_5" for 5 pl of cyan ink corresponding to the fourth scan. Also, FIG. 32E illustrates a logical sum pattern MP1_5"+MP3_5" obtained as the logical sum of the number of times of permitted discharge of ink stipulated in the mask pattern MP1_5" corresponding to the first scan in FIG. 32A and the mask pattern MP3_5" corresponding to the third scan in FIG. 32C. FIG. 32F illustrates a logical sum pattern MP2_5"+MP4_5" obtained as the logical sum of the number of times of permitted discharge of ink stipulated in the mask pattern MP2_5" corresponding to the second scan in FIG. 32B and the mask pattern MP4_5" corresponding to the fourth scan in FIG. 32D.

A pixel where code value "1" has been allocated to either one of mask patterns MP1_5" and MP3_5" illustrated in FIGS. 32A and 32C, and a pixel where code value "1" has been allocated to either one of mask patterns MP1_2' and MP3_2' illustrated in FIGS. 28A and 28C, are arrayed so as to not be superimposed (i.e., be in an exclusive relationship). Accordingly, it can be seen by comparing the logical sum pattern MP1_5"+MP3_5" illustrated in FIG. 32E with the logical sum pattern MP1_2'+MP3_2' illustrated in FIG. 28E that gray pixels (code value is "1") are not superimposed between the logical sum patterns MP1_5"+MP3_5" and MP1_2'+MP3_2'.

In the same way, pixel where code value "1" has been allocated to either one of mask patterns MP2_5" and MP4_5" illustrated in FIGS. 32B and 32D, and a pixel where code value "1" has been allocated to either one of mask patterns MP2_2' and MP4_2' illustrated in FIGS. 28B and 28D, are arrayed so as to not be superimposed (i.e., be in an exclusive relationship). Accordingly, it can be seen by comparing the logical sum pattern MP2_5"+MP4_5" illustrated in FIG. 32F with the logical sum pattern MP2_2'+MP4_2' illustrated in FIG. 28F that gray pixels (code value is "1") are not superimposed between the logical sum patterns MP2_5"+MP4_5" and MP2_2'+MP4_2'.

Accordingly, by applying the mask patterns illustrated in FIGS. 28A through 28D to image data for 2 pl of cyan ink, and mask patterns illustrated in FIGS. 32A through 32D to image data for 5 pl of cyan ink, in a case where relatively low-concentration image data where pixel values is "1", for example, is input, recording data can be generated such that cyan ink corresponding to 2 pl dot size and cyan ink corresponding to 5 pl dot size is not discharged to the same pixel regions, at all pixel regions in scans in the same direction. Thus, using the mask patterns MP1_2' through MP4_2' illustrated in FIGS. 28A through 28D and the mask patterns MP1_5" through MP4_5" illustrated in FIGS. 32A through 32D gives more coverage of the surface of the recording media as compared to a case of using the mask patterns MP1_2' through MP4_2' illustrated in FIGS. 28A through 28D and the mask patterns MP1_5' through MP4_5' illustrated in FIGS. 29A through 29D. As a result graininess can be suppressed even better.

Third Embodiment

Description has been made in the first and second embodiments above regarding a case of using a recording head that discharges two dot sizes per color. In the present embodiment, description will be made regarding a case of using a recording head that discharges three dot sizes per color. Note that description of portions that are the same as in the first and second embodiments will be omitted.

Figure 33A:
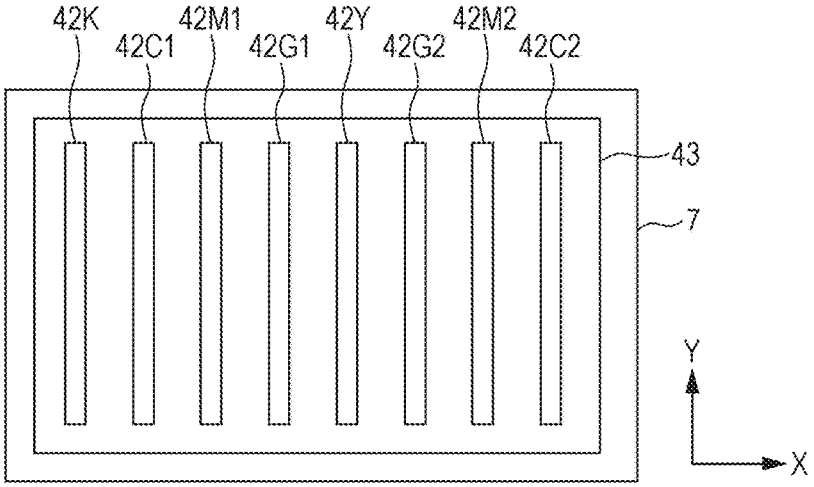
FIGS. 33A through 33C are schematic diagrams of a recording head according to an embodiment.
Figure 33B:
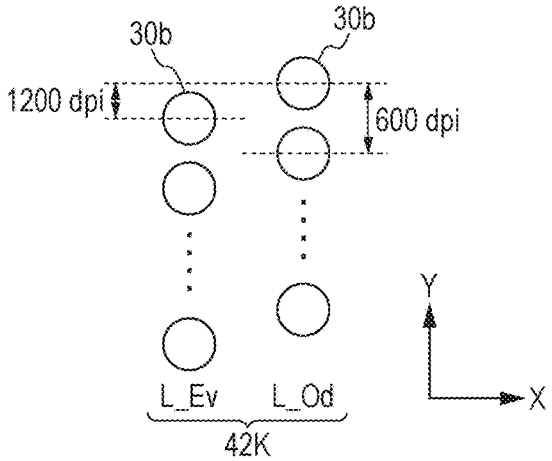
Figure 33C:
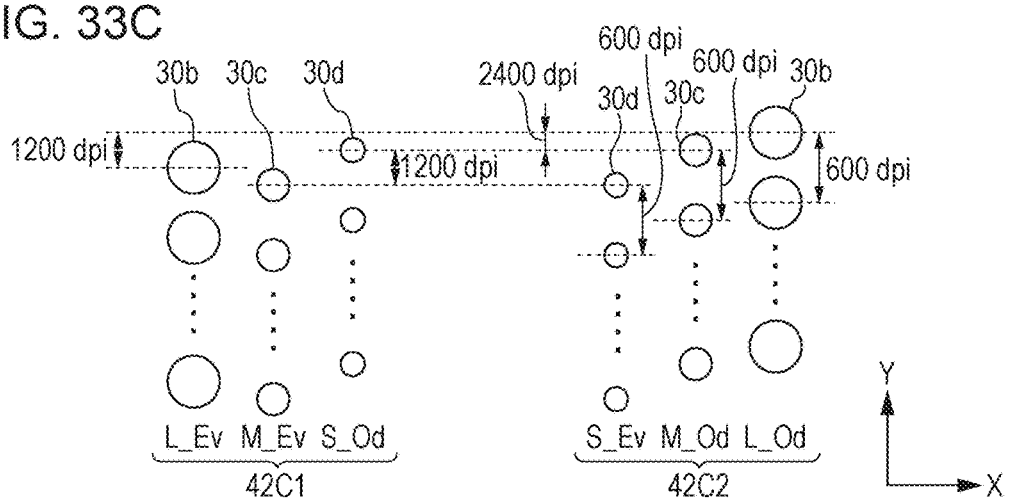

FIG. 33A is a perspective view illustrating the recording head 7 according to the present embodiment. FIG. 33B is an enlarged view of a discharge orifice row 42K for black ink inside the recording head 7. FIG. 33C is an enlarged view of discharge orifice rows 42C1 and 42C2 for cyan ink in the recording head.

It can be seen from FIG. 33A that a single recording chip 43 is provided within the recording head 7 in the present embodiment. Formed on the chip 43 are the discharge orifice row 42K for discharging black ink, discharge orifice rows 42C1 and 42C2 for discharging cyan ink, discharge orifice rows 42M1 and 42M2 for discharging magenta ink, a discharge orifice row 42Y for discharging yellow ink, and discharge orifice rows 42G1 and 42G2 for discharging gray ink, for a total of eight discharge orifice rows 42.

The discharge orifice row 42K for black ink is formed with rows where discharge orifices 30*b* arrayed in the Y direction at an inch density of 1/600 (equivalent to 600 dpi), are arrayed shifted in the Y direction by a recording resolution of inch density of 1/600 (equivalent to 1200 dpi), which is illustrated in FIG. 33B. The discharge orifices 30*b* are capable of discharging approximately 5 pl of ink, in the same way as the first and second embodiments. The diameter of a dot formed by a discharge orifice 30*b* discharging ink onto the recording medium is approximately 50 μm. Although only six discharge orifices 30*b* are illustrated in FIG. 33B for the sake of brevity, in reality 256 discharge orifices 30*b* are arrayed to make up the discharge orifice row 42K. The discharge orifice row 42Y for yellow ink is also in a configuration such as illustrated in FIG. 33B.

As illustrated in FIG. 33C, the discharge orifice row 42C1 for cyan ink is formed having three rows, which are a row L_Ev where discharge orifices 30*b* are arrayed at a density of 600 dpi, a row M_Ev where discharge orifices 30*c* are arrayed at a density of 600 dpi, and a row S_Od where discharge orifices 30*d* are arrayed at a density of 600 dpi. The discharge orifices 30*c* are capable of discharging approximately 2 pl of ink in the same way as in the first and second embodiments. The diameter of a dot formed by a discharge orifice 30*c* discharging ink is approximately 35 μm. Further, the discharge orifices 30*d* are capable of discharging approximately 1 pl of ink. The diameter of a dot formed by a discharge orifice 30*d* discharging ink is approximately 28 μm.

The discharge orifice row 42C2 for cyan ink is formed having three rows, which are a row L_Od where discharge orifices 30*b* are arrayed at a density of 600 dpi, a row M_Od where discharge orifices 30*c* are arrayed at a density of 600 dpi, and a row S_Ev where discharge orifices 30*d* are arrayed at a density of 600 dpi.

Now, the rows L_Ev, L_Od, M_Ev, M_Od, S_Ev, and S_Od, within the discharge orifice rows 42C1 and 42C2 are arranged based on the following arrangement conditions. The row L_Od within the discharge orifice row 42C2 is disposed shifted toward the downstream side in the Y direction (upwards in FIG. 33C) from the row L_Ev within the discharge orifice row 42C1 by 1200 dpi. The row M_Od within the discharge orifice row 42C2 is disposed shifted toward the downstream side in the Y direction (upwards in FIG. 33C) from the row M_Ev within the discharge orifice row 42C1 by 1200 dpi. Note that the row M_Od within the discharge orifice row 42C2 is disposed shifted toward the upstream side in the Y direction (downwards in FIG. 33C) from the row L_Od within the discharge orifice row 42C2 by 2400 dpi.

Also, the row S_Od within the discharge orifice row 42C1 and the row M_Od within the discharge orifice row 42C2, and the row S_Ev within the discharge orifice row 42C2 and the row M_Ev within the discharge orifice row 42C1, are arranged so that the middle positions of each in the Y direction are at approximately the same position.

Accordingly, the row S_Od within the discharge orifice row 42C1 is disposed shifted toward the downstream side in the Y direction (upwards in FIG. 33C) from the row S_Ev within the discharge orifice row 42C2 by 1200 dpi.

Although only three discharge orifices are illustrated in FIG. 33C as discharge orifices making up the rows L_Ev, L_Od, M_Ev, M_Od, S_Ev, and S_Od, for the sake of brevity, in reality each row is formed having 128 discharge orifices. Accordingly, with two rows that discharge the same amount of ink (e.g., S_Od and S_Ev) as one row, this row is formed including 256 discharge orifices.

Also note that discharge orifice rows 42M1 and 42M2 for magenta ink have the same configuration as illustrated in FIG. 33C. Further, the discharge orifice rows 42G1 and 42G2 for gray ink have the same configuration as illustrated in FIG. 33C.

Thus, with regard to cyan ink, magenta ink, and gray ink, the present embodiment has recording element rows corresponding to three dot sizes. These are a recording element row for discharging ink corresponding to the 1 pl dot size, a recording element row for discharging ink corresponding to the 2 pl dot size, and a recording element row for discharging ink corresponding to the 5 pl dot size.

The data processing procedures are performed in the same way as the first and second embodiments through step 404 in FIG. 5. In step S405, unlike the first and second embodiments, the data C2 obtained in step 404 is subjected to quantization processing by error diffusion to obtain data C3' having six gradations (gradation levels 0, 1, 2, 3, 4, 5). Although error diffusion has been described as being used here, dithering may be used instead.

In step 406, the gradation data C3' is converted into image data C4'_1, C4'_2, and C4'_2, in accordance with the discharge orifice row rasterization table illustrated in FIG. 34. In the present embodiment, image data C4'_1 for 1 pl discharge orifice rows, image data C4'_2 for 2 pl discharge orifice rows, and image data C4'_2 for 5 pl discharge orifice rows, are each rasterized in the three gradations of "0", "1", and "2". Specifically, in a case where the gradation level of the gradation data C3' is 0, rasterization is performed so that the image data C4'_1 for 1 pl discharge orifice rows is "0", image data C4'_2 for 2 pl discharge orifice rows is "0", and image data C4'_2 for 5 pl discharge orifice rows is "0". In a case where the gradation level of the gradation data C3 is 1, rasterization is performed so that the image data C4'_1 for 1 pl discharge orifice rows is "1", image data C4'_2 for 2 pl discharge orifice rows is "0", and image data C4'_2 for 5 pl discharge orifice rows is "0". In a case where the gradation level of the gradation data C3 is 2, rasterization is performed so that the image data C4'_1 for 1 pl discharge orifice rows is "1", image data C4'_2 for 2 pl discharge orifice rows is "1" and image data C4'_2 for 5 pl discharge orifice rows is "0". In a case where the gradation level of the gradation data C3 is 3, rasterization is performed so that the image data C4'_1 for 1 pl discharge orifice rows is "0", image data C4'_2 for 2 pl discharge orifice rows is "1", and image data C4'_2 for 5 pl discharge orifice rows is "1". In a case where the gradation level of the gradation data C3 is 4, rasterization is performed so that the image data C4'_1 for 1 pl discharge orifice rows is "0", image data C4'_2 for 2 pl discharge orifice rows is "2", and image data C4'_2 for 5 pl discharge orifice rows is "1". In a case where the gradation level of the gradation data C3 is 5, rasterization is performed so that the image data C4'_1 for 1 pl discharge orifice rows is "0", image data C4'_2 for 2 pl discharge orifice rows is "2", and image data C4'_2 for 5 pl discharge orifice rows is "2".

In step 407, later-described distribution processing is performed regarding image data C4'_1, C4'_2, and C4'_2, and recording data C5'_1, C5'_2, and C5'_5 stipulating discharge or non-discharge of ink for each dot size of 1 pl, 2 pl, and 5 pl, as to each pixel region in each scan, is generated. Thereafter, the recording data C5'_1, C5'_2, and C5'_5 is transmitted to the recording head in step 408, and in step 409 ink is discharged in accordance with the recording data C5'_1, C5'_2, and C5'_5.

Mask Pattern and Driving Order

In the present embodiment, the driving order of each driving block in the recording element row discharging cyan ink of the 1 pl dot size, the recording element row discharging cyan ink of the 2 pl dot size, and the recording element row discharging cyan ink of the 5 pl dot size, is the same as each other, as in the first and second embodiments. The same mask patterns, the mask patterns illustrated in FIGS. 18A through 18D for example, are applied to the image data C4'_1 for 1 pl of cyan ink and the image data C4'_2 for 5 pl of cyan ink. On the other hand, different mask patterns are applied to the image data C4'_2 for 2 pl of cyan ink from the mask patterns applied to the image data C4_1' for 1 pl of cyan ink and the image data C4_5' for 5 pl of cyan ink, the mask patterns illustrated in FIGS. 17A through 17D for example. The reason why different mask patterns are applied to the image data C4'_2 for 2 pl of cyan ink from the mask patterns applied to the image data C4_1' for 1 pl of cyan ink and the image data C4_5' for 5 pl of cyan ink will be described below in detail.

It can be seen from the discharge orifice row rasterization table illustrated in FIG. 34 that there are cases in the present embodiment where cyan ink corresponding to the 1 pl dot size and cyan ink corresponding to the 2 pl dot size are used at the same time for a certain pixel, depending on the gradation level of the gradation data C3'. There also are cases where cyan ink corresponding to the 2 pl dot size and cyan ink corresponding to the 5 pl dot size are used at the same time for a certain pixel, depending on the gradation level of the gradation data C3'. However, there are no cases where cyan ink corresponding to the 1 pl dot size and cyan ink corresponding to the 5 pl dot size are used at the same time for a certain pixel, regardless of the gradation level of the gradation data C3'.

In light of this point, same mask patterns are applied to the image data for 1 pl of cyan ink and the image data for 5 pl of cyan ink in the present embodiment, so that ink is applied pixels at the same positions. Regardless of the gradation data C3', cyan ink corresponding to the 1 pl dot size and cyan ink corresponding to the 5 pl dot size are not discharged at the same pixel region, so even if the position where these inks are applied are made to be the same, graininess does not readily occur. Accordingly, separate mask patterns do not have to be provided as a mask pattern for 1 pl and a mask pattern for 5 pl, and consequently ROM memory capacity can be reduced.

On the other hand, different mask patterns are applied to the image data for 2 pl of cyan ink from the mask patterns applied to the image data for 1 pl of cyan ink and the image data for 5 pl of cyan ink in the present embodiment. The reason is that, depending on the gradation level of the gradation data C3', there are cases where the image data C4'_2 is generated such that cyan ink corresponding to the 2 pl dot size is discharged to the same pixel region as the pixel region where cyan ink corresponding to the 1 pl dot size or cyan ink corresponding to the 5 pl dot size.

Even in such cases, scans performing discharge following the recording data C5'_2 for 2 pl of cyan ink, and scans performing discharge following the recording data C5'_1 for 1 pl of cyan ink or the recording data C5'_5 for 5 pl of cyan ink, can be made to scan in different directions in at least part of the pixel regions in the present embodiment. In this part of the pixel regions, cyan ink corresponding to the 2 pl dot size and cyan ink corresponding to the 1 pl dot size or cyan ink corresponding to the 5 pl dot size can be scanned in different directions and perform discharging in the same driving order, so the landing positions of the dots in the X direction can be made to differ. Accordingly, the recording medium can be efficiently covered by cyan ink corresponding to the 2 pl dot size, and cyan ink corresponding to the 1 pl dot size or cyan ink corresponding to the 5 pl dot size, contributing to improvement regarding graininess.

As described above, according to the present embodiment, graininess due to superimposing of ink dots of different dot sizes can be suppressed, even in cases of using ink of three or more dot sizes per color.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

Although description has been made above in the embodiments regarding an arrangement where mask patterns for ink of different dot sizes are made to differ, but other arrangements may be made as well. For example, the array of mask patterns for different colored ink may be made to differ such as illustrated in FIGS. 17A through 18F. Accordingly, the landing positions of different colored inks, such as cyan ink and magenta ink for example, can be shifted. Thus, the present invention is not restricted to mask patterns for ink of different dot sizes, and may be applied to mask patterns for ink of different colors.

Description has been made in the above embodiments regarding an arrangement where discharge position deviation between forward scans and backward scans is suppressed in a case where forward scans and backward scans are performed as to a unit region. Accordingly, description has been made that the driving order for backward scans needs to be different from the opposite order of the driving order for forward scans, and that the driving order preferably is different from the opposite order of an offset order of the driving order for forward scanning, and more preferably the same as the driving order for forward scanning.

However, the present invention is not restricted to this arrangement. In a case of recording multiple times by scans only in one direction to a unit region, discharge position deviation between a first type of scan and a second type of scan can be suppressed. For example, in a case where the first type of scan is the first half of multiple scans and the second type of scan is the latter half of multiple scans, discharge position deviation between the scans in the first half and the scans in the later half can be suppressed. At this time, the driving order for the second type of scan needs to be different from the driving order for first type of scan, the driving order preferably is different from an offset order of the driving order for the first type of scan, and more preferably the opposite order of from the driving order for the first type of scan.

The reason for this is that, as described with reference to FIGS. 11A through 11C and other drawings, when reciprocal scanning is performed using the same driving order, the landing positions of ink from each driving block under time-division driving control will be inverted positions, and when one-way scanning is performed using the same driving order, the landing positions of ink from each driving block under time-division driving control will be the same positions. It can thus be understood that the ink landing positions from the driving blocks in time-division driving where one-way driving for example is performed at the driving order of the second type of scan is the opposite order from the driving order of the first type of scan, and the ink landing positions from the driving blocks in time-division driving where reciprocal scanning is performed with the driving order for backward scans and the driving order for forward scans is the same order, will be the same positions.

An arrangement has been described in the above embodiments that multiple recording element rows that discharge ink of multiple dot sizes are provided regarding cyan, out of multiple colors of ink, and description has been made regarding mask patterns, and time-division driving and driving order for cyan ink corresponding to multiple dot sizes, and no mention has been made in particular regarding other colors of ink. However, it is needless to say that the present invention can be applied to other colors of ink, such as magenta ink for example, as long as multiple recording element rows are provided that discharge ink of multiple dot sizes per color.

Although an arrangement has been described in the above embodiments where multi-value mask patterns are configured using multi-bit information indicating the number of times of ink discharge permitted to each pixel, other arrangements may be made as well. For example, binary mask patterns may be used that are configured using 1-bit information indicating permission/non-permission of ink discharge to each pixel. In this case, it is sufficient that, with regard to a first logical sum pattern obtained from mask patterns corresponding to forward scans and a second logical sum pattern obtained from mask patterns corresponding to backward scans, multiple mask patterns are set such that, of pixels where recording is set to be permitted in the second logical sum pattern, the number of pixels adjacent at both sides in the X direction to pixels where recording is set to be permitted in the first logical sum pattern is larger than the number of pixels not adjacent at both sides in the X direction to pixels where recording is set to be permitted in the first logical sum pattern.

Although description has been made in the embodiments regarding an arrangement where two passes each are performed of a forward scan and a backward scan as to a unit region, and to an arrangement where two passes each are performed for one of a forward scan and a backward scan as to a unit region and one pass for the other, other arrangements may be made. That is, the present invention can be applied as long as K ($K \geq 1$) forward scans and L ($L \geq 1$) backward scans are performed as to a unit region. In this case, K mask patterns for forward scanning and L mask patterns for backward scanning may be used.

In the above-describe embodiments, description has been made regarding an arrangement where recording data is generated using image data that is made up of two bits of information per pixel and sets the number of times of ink discharge to one of 0, 1, and 2, and mask patterns that is made up of two bits of information per pixel and sets the number of times of discharge permitted to one of 0, 1, and 2, but other arrangements may be made. Image data and mask patterns may be used that are made up of information having three bits or more per pixel. In a case where the information per pixel making up the image data and mask patterns is n bits, the number of times of ink discharge and the number of times permitted can be set to a maximum of ($2^n$).

An example will be made regarding a case of forming image data and mask patterns from information having three or more bits per pixel. That is, 3-bit information making up the image data and mask patterns will be one of "000", "001", "010", "011", "100", "101", "110", and "111".

In a case where the 3-bit information making up image data for a certain pixel is "000", the pixel value is "0", so the number of times of ink discharge to that pixel is zero times. In a case where the 3-bit information making up image data for a certain pixel is "001", the pixel value is "1", so the number of times of ink discharge to that pixel is once. In a case where the 3-bit information making up image data for a certain pixel is "010", the pixel value is "2", so the number of times of ink discharge to that pixel is twice. In a case where the 3-bit information making up image data for a certain pixel is "011", the pixel value is "3", so the number of times of ink discharge to that pixel is three times. In a case where the 3-bit information making up image data for a certain pixel is "100", the pixel value is "4", so the number of times of ink discharge to that pixel is four times. In a case where the 3-bit information making up image data for a certain pixel is "101", the pixel value is "5", so the number of times of ink discharge to that pixel is five times. In a case where the 3-bit information making up image data for a certain pixel is "110", the pixel value is "6", so the number of times of ink discharge to that pixel is six times. In a case where the 3-bit information making up image data for a certain pixel is "111", the pixel value is "7", so the number of times of ink discharge to that pixel is seven times.

On the other hand, in a case where the 3-bit information making up a mask pattern for a certain pixel is "000", the code value is "0", so the number of times of ink discharge permitted for that pixel is zero times. In a case where the 3-bit information making up a mask pattern for a certain pixel is "001", the code value is "1", so the number of times of ink discharge permitted for that pixel is once. In a case where the 3-bit information making up a mask pattern for a certain pixel is "010", the code value is "2", so the number of times of ink discharge permitted for that pixel is twice. In a case where the 3-bit information making up a mask pattern for a certain pixel is "011", the code value is "3", so the number of times of ink discharge permitted for that pixel is three times. In a case where the 3-bit information making up a mask pattern for a certain pixel is "100", the code value is "4", so the number of times of ink discharge permitted for that pixel is four times. In a case where the 3-bit information making up a mask pattern for a certain pixel is "101", the code value is "5", so the number of times of ink discharge permitted for that pixel is five times. In a case where the 3-bit information making up a mask pattern for a certain pixel is "110", the code value is "6", so the number of times of ink discharge permitted for that pixel is six times. In a case where the 3-bit information making up a mask pattern for a certain pixel is "111", the code value is "7", so the number of times of ink discharge permitted for that pixel is seven times.

FIG. 35 shows a decoding table setting the rules described above. For example, if a pixel has been allocated code value "1", recording data is generated where non-discharge of ink is stipulated in a case where the pixel value is "0" to "6" and discharge of ink is stipulated if the pixel value is "7". If a pixel has been allocated code value "7" for example, recording data is generated where non-discharge of ink is stipulated in a case where the pixel value is "0" and discharge of ink is stipulated if the pixel value is "1" to "7".

Pixels regarding which discharge of ink is set even in a case where the image is low in concentration, such as in a case where the pixel value of the image data is "1" for example, are pixels to which the code value "7" has been allocated, which is the largest number of times of ink discharge permitted in the mask pattern. Accordingly, in order to use the decoding table such as illustrated in FIG. 35 and obtain the advantages of the present invention, using the image data and mask patterns made up of 3-bit information per pixel for example, pixels allocated the code value "7" in the mask pattern are of particular interest. Specifically, it is sufficient to satisfy the following Condition A, Condition B, and Condition C, in order to obtain the advantages of the first embodiment of the present invention.

Condition A

Almost all pixels allocated code value "7" in a mask pattern for the 2 pl dot size of cyan ink for forward scanning are arrayed to be superimposed on pixels allocated code values other than "7" and "0" in a mask pattern for the 2 pl dot size of cyan ink for backward scanning.

Condition B

Almost all pixels allocated code value "7" in a mask pattern for the 5 pl dot size of cyan ink for forward scanning are arrayed to be superimposed on pixels allocated code values other than "7" and "0" in a mask pattern for the 5 pl dot size of cyan ink for backward scanning.

Condition C

Pixels allocated code value "7" in a mask pattern for the 2 pl dot size of cyan ink for forward scanning and pixels allocated code value "7" in a mask pattern for the 5 pl dot size of cyan ink for forward scanning are arrayed differently from each other.

Further, the following Condition A', Condition B', and Condition C' are preferably satisfied.

Condition A'

Almost all pixels allocated code value "7" in a mask pattern for the 2 pl dot size of cyan ink for backward scanning are arrayed to be superimposed on pixels allocated code values other than "7" and "0" in a mask pattern for the 2 pl dot size of cyan ink for forward scanning.

Condition B'

Almost all pixels allocated code value "7" in a mask pattern for the 5 pl dot size of cyan ink for backward scanning are arrayed to be superimposed on pixels allocated code values other than "7" and "0" in a mask pattern for the 5 pl dot size of cyan ink for forward scanning.

Condition C'

Pixels allocated code value "7" in a mask pattern for the 2 pl dot size of cyan ink for backward scanning and pixels allocated code value "7" in a mask pattern for the 5 pl dot size of cyan ink for backward scanning are arrayed differently from each other.

Further, it is sufficient to satisfy the following Condition D, in addition to Condition A, Condition B, and Condition C, in order to obtain the advances of the second embodiment of the present invention.

Condition D

Of the pixels allocated code value "7" in a mask pattern for the 2 pl dot size of cyan ink for forward scanning, the number of pixels that are adjacent on both sides in the X direction to pixels allocated code value "7" in a mask pattern for the 2 pl dot size of cyan ink for backward scanning is greater than the number of pixels that are not adjacent on both sides in the X direction to pixels allocated code value "7" in a mask pattern for the 2 pl dot size of cyan ink for backward scanning.

It is further preferable to satisfy the following Condition D'.

Condition D'

Of the pixels allocated code value "7" in a mask pattern for the 5 pl dot size of cyan ink for forward scanning, the number of pixels that are adjacent on both sides in the X direction to pixels allocated code value "7" in a mask pattern for the 5 pl dot size of cyan ink for backward scanning is greater than the number of pixels that are not adjacent on both sides in the X direction to pixels allocated code value "7" in a mask pattern for the 5 pl dot size of cyan ink for backward scanning.

Pixels to which code value "6" have been allocated, so that non-discharge of ink is stipulated if the pixel value of the image data is "1" but discharge is stipulated if the pixel value is "2", and pixels to which code value "5" have been allocated, so that non-discharge of ink is stipulated if the pixel value of the image data is "1" or "2" but discharge is stipulated if the pixel value is "3", also are pixels set to discharge ink with recording relatively low-concentration images. Accordingly, in order to obtain the advantages of the second embodiment, pixels to which code value "6" and code value "5" are allocated preferably are set to the same conditions as the pixels to which the code value "7" has been set. In order to suppress position deviation between reciprocal scans when recording low-concentration images, pixels to which code values have been allocated where the number of times of ink discharge permitted is S (S≥R/2, where R is the greatest value of number of times of ink discharge that the image data is capable of expressing) preferably have been set under the same conditions as the pixels to which the above-described code value "7" has been set.

Although description has been made in the embodiments regarding an arrangement where recording is performed while conveying a recording medium between multiple scans as to a unit region, the present invention may be carried out by other arrangements as well. That is to say, an arrangement may be made where multiple scans are performed for recording on a unit region without performing conveyance of the recording medium.

The present invention is not restricted to a thermal-jet ink jet recording apparatus. The present invention can be effectively applied to various recording apparatuses, such as a piezoelectric ink jet recording apparatus that discharges ink using piezoelectric elements, for example.

Although a recording method using a recording apparatus has been described in the embodiments, an arrangement may be made where an image processing apparatus, image processing method, and program, to generate data for performing the recording method described in the embodiments, are provided separately from the recording apparatus. It is needless to say that the present invention is widely applicable to an arrangement provided to part of a recording apparatus.

Also, the term "recording medium" is not restricted to paper used in general recording apparatuses, and broadly includes any material capable of accepting ink, including cloth, plastic film, metal plates, glass, ceramics, wood, leather, and so forth.

Further, the term "ink" refers to a liquid that, by being applied onto a recording medium, is used to form images designs, patterns, or the like, or to process the recording medium, or for processing of ink (e.g., solidification or insolubilization of coloring material in the ink applied to the recording medium).

According to the recording apparatus of the present invention, recording can be performed with suppressed discharge position deviation of ink between two types of scans, without causing other image defects, even when discharging ink of multiple types, such as multiple colors or multiple dot sizes.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2015-214962 and 2015-214964, filed Oct. 30, 2015, which are hereby incorporated by reference herein in their entirety.

What is claimed is:

1. A recording apparatus comprising:

a recording head including a first recording element row where a plurality of recording elements configured to generate energy to discharge a first type of ink are arrayed in a predetermined direction, and a second recording element row where a plurality of recording elements configured to generate energy to discharge a second type of ink, that is different from the first type of ink, are arrayed in the predetermined direction;

a scanning unit configured to execute a first scan of the recording head over a unit region on a recording medium, K (K≥1) times in a first direction following an intersecting direction intersecting the predetermined direction, and a second scan of the recording head over the unit region, L (L≥1) times in a second direction opposite to the first direction;

a first generating unit configured to generate K+L sets of first recording data stipulating discharge or non-discharge of the first type of ink, as to each of a plurality of pixels, corresponding to the K+L scans by the scanning unit, based on first image data that corresponds to an image to be recorded in the unit region and stipulates a plurality of combinations of number of times of discharge of the first type of ink to each of the plurality of pixel regions, and K+L first mask patterns corresponding to the K+L scans by the scanning unit and stipulating a plurality of combinations of number of times of discharge of the first type ink to each of the plurality of pixel regions;

a second generating unit configured to generate K+L sets of second recording data stipulating discharge or non-discharge of the second type of ink, as to each of a plurality of pixels, corresponding to the K+L scans by the scanning unit, based on second image data that corresponds to an image to be recorded in the unit region and stipulates a plurality of combinations of number of times of discharge of the second type of ink to each of the plurality of pixel regions, and K+L second mask patterns corresponding to the K+L scans by the scanning unit and stipulating a plurality of combinations of number of times of discharge of the second type ink to each of the plurality of pixel regions;

a driving unit configured to drive a plurality of first recording elements corresponding to the unit region in the K first scans within the first and second recording element rows, at a first driving order, and drive a plurality of second recording elements corresponding to the unit region in the L second scans within the first and second recording element rows, at a second driving order that is different from the opposite order from the first driving order; and a control unit configured to effect control to discharge the first and second types of ink to a plurality of pixel regions equivalent to the plurality of pixels within the unit region by driving the plurality of recording elements within the first and second recording element rows, based on the K+L sets of first and second recording data, in the K+L scans by the scanning unit, wherein (i) an array of pixels regarding which an M (M≥1) number of ink discharge permitted is stipulated by one of the K first mask patterns corresponding to the K first scans, and an array of pixels regarding which an N (N>M) number of ink discharge permitted is stipulated by one of the L first mask patterns corresponding to the L second scans, correspond to each other, (ii) an array of pixels regarding which an M number of ink discharge permitted is stipulated by one of the K second mask patterns corresponding to the K first scans, and an array of pixels regarding which an N number of ink discharge permitted is stipulated by one of the L second mask patterns corresponding to the L second scans, correspond to each other, and (iii) an array of pixels regarding which an N number of ink discharge permitted is stipulated by one of the K first mask patterns corresponding to the K first scans, and an array of pixels regarding which an N number of ink discharge permitted is stipulated by one of the K second mask patterns corresponding to the K first scans, are different from each other.

2. The recording apparatus according to claim 1, wherein the second driving order is different from an opposite order of the first driving order that has been offset.

3. The recording apparatus according to claim 2, wherein the second driving order is the same driving order as the first driving order.

4. The recording apparatus according to claim 1, wherein an array of pixels regarding which an M number of ink discharge permitted is stipulated by one of the K first mask patterns corresponding to the K first scans, and an array of pixels regarding which an M number of ink discharge permitted is stipulated by one of the K second mask patterns corresponding to the K first scans, are different from each other.

5. The recording apparatus according to claim 1, wherein an array of pixels regarding which an N number of ink discharge permitted is stipulated by one of the K first mask patterns corresponding to the K first scans, and an array of pixels regarding which an N number of ink discharge permitted is stipulated by one of the K second mask patterns corresponding to the K first scans, are not superimposed on each other.

6. The recording apparatus according to claim 1, wherein an array of pixels regarding which an M number of ink discharge permitted is stipulated by one of the K first mask patterns corresponding to the K first scans, and an array of pixels regarding which an N number of ink discharge permitted is stipulated by one of the L second mask patterns corresponding to the L second scans, are different from each other.

7. The recording apparatus according to claim 1, wherein an array of pixels regarding which an N number of ink discharge permitted is stipulated by one of the K first mask patterns corresponding to the K first scans, and an array of pixels regarding which an M number of ink discharge permitted is stipulated by one of the L second mask patterns corresponding to the L second scans, correspond each other.

8. The recording apparatus according to claim 1, wherein, of the pixels regarding which an N number of ink discharge permitted is stipulated by one of the L first mask patterns corresponding to the L times of second scans, the number of pixels adjacent on both sides in the intersecting direction to pixels regarding which an N number of ink discharge permitted is stipulated by one of the K first mask patterns corresponding to the K times of first scans, is larger than the number of pixels not adjacent on both sides in the intersecting direction to pixels regarding which an N number of ink discharge permitted is stipulated by one of the K first mask patterns corresponding to the K times of first scans.

9. The recording apparatus according to claim 1, wherein pixels, regarding which an N number of ink discharge permitted is stipulated by one of the K first mask patterns corresponding to the K times of first scans, have an N number of ink discharge permitted stipulated by one first mask pattern of the K first mask patterns, and have zero ink discharge permitted stipulated by the other K−1 first mask pattern of the K first mask patterns.

10. The recording apparatus according to claim 1, wherein pixels, regarding which an M number of ink discharge permitted is stipulated by one of the K first mask patterns corresponding to the K times of first scans, have an M number of ink discharge permitted stipulated by one first mask pattern of the K first mask patterns, and have zero ink discharge permitted stipulated by the other K−1 first mask pattern of the K first mask patterns.

11. The recording apparatus according to claim 1, further comprising:

a conveying unit configured to convey the recording medium in the predetermined direction, between consecutive scans if the K+L scans by the scanning unit, wherein the plurality of first recording elements and the plurality of second recording elements are positioned at different positions in the predetermined direction.

12. The recording apparatus according to claim 1, wherein the scanning unit alternately performs the first scan and the second scan as to the unit region.

13. The recording apparatus according to claim 1, wherein M=1 and N=2.

14. The recording apparatus according to claim 1, wherein K=L.

15. The recording apparatus according to claim 1, wherein the first type of ink is ink of a first color, and wherein the second type of ink is ink of a second color that is different from the first color.

16. The recording apparatus according to claim 1, wherein the first type of ink is ink of a first dot size, and wherein the second type of ink is ink of a second dot size that is different from the first dot size.

17. A recording apparatus comprising:

a recording head including a first recording element row where a plurality of recording elements configured to generate energy to discharge a first type of ink are arrayed in a predetermined direction, and a second recording element row where a plurality of recording elements configured to generate energy to discharge a second type of ink, that is different from the first type of ink, are arrayed in the predetermined direction;

a scanning unit configured to execute a first scan of the recording head over a unit region on a recording medium, K (K≥1) times in a first direction following an intersecting direction intersecting the predetermined direction, and a second scan of the recording head over the unit region, L (L≥1) times in the first direction;

a first generating unit configured to generate K+L sets of first recording data stipulating discharge or non-discharge of the first type of ink, as to each of a plurality of pixels, corresponding to the K+L scans by the scanning unit, based on first image data that corresponds to an image to be recorded in the unit region and stipulates a plurality of combinations of number of times of discharge of the first type of ink to each of the plurality of pixel regions, and K+L first mask patterns corresponding to the K+L scans by the scanning unit and stipulating a plurality of combinations of number of times of discharge of the first type ink to each of the plurality of pixel regions;

a second generating unit configured to generate K+L sets of second recording data stipulating discharge or non-discharge of the second type of ink, as to each of a plurality of pixels, corresponding to the K+L scans by the scanning unit, based on second image data that corresponds to an image to be recorded in the unit region and stipulates a plurality of combinations of number of times of discharge of the second type of ink to each of the plurality of pixel regions, and K+L second mask patterns corresponding to the K+L scans by the scanning unit and stipulating a plurality of combinations of number of times of discharge of the second type ink to each of the plurality of pixel regions;

a driving unit configured to drive a plurality of first recording elements corresponding to the unit region in the K first scans within the first and second recording element rows, at a first driving order, and drive a plurality of second recording elements corresponding to the unit region in the L second scans within the first and second recording element rows, at a second driving order that is different from the opposite order from the first driving order; and a control unit configured to effect control to discharge the first and second types of ink to a plurality of pixel regions equivalent to the plurality of pixels within the unit region by driving the plurality of recording elements within the first and second recording element rows, based on the K+L sets of first and second recording data, in the K+L scans by the scanning unit, wherein (i) an array of pixels regarding which an N (N≥1) number of ink discharge permitted is stipulated by one of the K first mask patterns corresponding to the K first scans, and an array of pixels regarding which an M (M>N) number of ink discharge permitted is stipulated by one of the L first mask patterns corresponding to the L second scans, correspond to each other, (ii) an array of pixels regarding which an M number of ink discharge permitted is stipulated by one of the K second mask patterns corresponding to the K first scans, and an array of pixels regarding which an N number of ink discharge permitted is stipulated by one of the L second mask patterns corresponding to the L second scans, correspond to each other, and (iii) an array of pixels regarding which an N number of ink discharge permitted is stipulated by one of the K first mask patterns corresponding to the K first scans, and an array of pixels regarding which an N number of ink discharge permitted is stipulated by one of the K second mask patterns corresponding to the K first scans, are different from each other.

18. The recording apparatus according to claim 17, wherein the second driving order is different from an order where the first driving order has been offset.

19. The recording apparatus according to claim 18, wherein the second driving order is an opposite order from the first driving order.

20. A recording method of performing recording using a recording head including a first recording element row where a plurality of recording elements configured to generate energy to discharge a first type of ink are arrayed in a predetermined direction, and a second recording element row where a plurality of recording elements configured to generate energy to discharge a second type of ink, that is different from the first type of ink, are arrayed in the predetermined direction, the method comprising:

executing scanning of a first scan of the recording head over a unit region on a recording medium, K (K≥1) times in a first direction following an intersecting direction intersecting the predetermined direction, and a second scan of the recording head over the unit region, L (L≥1) times in a second direction opposite to the first direction;

first generating of K+L sets of first recording data stipulating discharge or non-discharge of the first type of ink, as to each of a plurality of pixels, corresponding to the K+L scans in the scanning, based on first image data that corresponds to an image to be recorded in the unit region and stipulates a plurality of combinations of number of times of discharge of the first type of ink to each of the plurality of pixel regions, and K+L first mask patterns corresponding to the K+L scans in the scanning and stipulating a plurality of combinations of number of times of discharge of the first type ink to each of the plurality of pixel regions;

second generating of K+L sets of second recording data stipulating discharge or non-discharge of the second type of ink, as to each of a plurality of pixels, corresponding to the K+L scans in the scanning, based on second image data that corresponds to an image to be recorded in the unit region and stipulates a plurality of combinations of number of times of discharge of the second type of ink to each of the plurality of pixel regions, and K+L second mask patterns corresponding to the K+L scans in the scanning and stipulating a plurality of combinations of number of times of discharge of the second type ink to each of the plurality of pixel regions;

driving of a plurality of first recording elements corresponding to the unit region in the K first scans within the first and second recording element rows, at a first driving order, and a plurality of second recording elements corresponding to the unit region in the L second scans within the first and second recording element rows, at a second driving order that is different from the opposite order from the first driving order; and effecting control to discharge the first and second types of ink to a plurality of pixel regions equivalent to the plurality of pixels within the unit region by driving, in the driving, the plurality of recording elements within the first and second recording element rows, based on the K+L sets of first and second recording data generated in the first and second generating, in the K+L scans in the scanning, wherein (i) an array of pixels regarding which an M (M≥1) number of ink discharge permitted is stipulated by one of the K first mask patterns corresponding to the K first scans, and an array of pixels regarding which an N (N>M) number of ink discharge permitted is stipulated by one of the L first mask patterns corresponding to the L second scans, correspond to each other, (ii) an array of pixels regarding which an M number of ink discharge permitted is stipulated by one of the K second mask patterns corresponding to the K first scans, and an array of pixels regarding which an N number of ink discharge permitted is stipulated by one of the L second mask patterns corresponding to the L second scans, correspond to each other, and (iii) an array of pixels regarding which an N number of ink discharge permitted is stipulated by one of the K first mask patterns corresponding to the K first scans, and an array of pixels regarding which an N number of ink discharge permitted is stipulated by one of the K second mask patterns corresponding to the K first scans, are different from each other.

21. A recording method of performing recording using a recording head including a first recording element row where a plurality of recording elements configured to generate energy to discharge a first type of ink are arrayed in a predetermined direction, and a second recording element row where a plurality of recording elements configured to generate energy to discharge a second type of ink, that is different from the first type of ink, are arrayed in the predetermined direction, the method comprising:

executing scanning of a first scan of the recording head over a unit region on a recording medium, K (K≥1) times in a first direction following an intersecting direction intersecting the predetermined direction, and a second scan of the recording head over the unit region, L (L≥1) times in the first direction;

first generating of K+L sets of first recording data stipulating discharge or non-discharge of the first type of ink, as to each of a plurality of pixels, corresponding to the K+L scans in the scanning, based on first image data that corresponds to an image to be recorded in the unit region and stipulates a plurality of combinations of number of times of discharge of the first type of ink to each of the plurality of pixel regions, and K+L first mask patterns corresponding to the K+L scans in the scanning and stipulating a plurality of combinations of number of times of discharge of the first type ink to each of the plurality of pixel regions;

second generating of K+L sets of second recording data stipulating discharge or non-discharge of the second type of ink, as to each of a plurality of pixels, corresponding to the K+L scans in the scanning, based on second image data that corresponds to an image to be recorded in the unit region and stipulates a plurality of combinations of number of times of discharge of the second type of ink to each of the plurality of pixel regions, and K+L second mask patterns corresponding to the K+L scans in the scanning and stipulating a plurality of combinations of number of times of discharge of the second type ink to each of the plurality of pixel regions;

driving of a plurality of first recording elements corresponding to the unit region in the K first scans within the first and second recording element rows, at a first driving order, and a plurality of second recording elements corresponding to the unit region in the L second scans within the first and second recording element rows, at a second driving order that is different from the opposite order from the first driving order; and effecting control to discharge the first and second types of ink to a plurality of pixel regions equivalent to the plurality of pixels within the unit region by driving, in the driving, the plurality of recording elements within the first and second recording element rows, based on the K+L sets of first and second recording data generated in the first and second generating, in the K+L scans in the scanning, wherein (i) an array of pixels regarding which an N (N≥1) number of ink discharge permitted is stipulated by one of the K first mask patterns corresponding to the K first scans, and an array of pixels regarding which an M (M>N) number of ink discharge permitted is stipulated by one of the L first mask patterns corresponding to the L second scans, correspond to each other, (ii) an array of pixels regarding which an M number of ink discharge permitted is stipulated by one of the K second mask patterns corresponding to the K first scans, and an array of pixels regarding which an N number of ink discharge permitted is stipulated by one of the L second mask patterns corresponding to the L second scans, correspond to each other, and (iii) an array of pixels regarding which an N number of ink discharge permitted is stipulated by one of the K first mask patterns corresponding to the K first scans, and an array of pixels regarding which an N number of ink discharge permitted is stipulated by one of the K second mask patterns corresponding to the K first scans, are different from each other.

* * * * *